US007031474B1

(12) United States Patent
Yuen et al.

(10) Patent No.: US 7,031,474 B1
(45) Date of Patent: Apr. 18, 2006

(54) ACOUSTIC CORRECTION APPARATUS

(75) Inventors: Thomas C. K. Yuen, Newport Beach, CA (US); Alan D. Kraemer, Tustin, CA (US); Richard Oliver, Laguna Beach, CA (US)

(73) Assignee: SRS Labs, Inc., Santa Ana, CA (US)

( * ) Notice: Subject to any disclaimer, the term of this patent is extended or adjusted under 35 U.S.C. 154(b) by 0 days.

(21) Appl. No.: 09/411,143

(22) Filed: Oct. 4, 1999

(51) Int. Cl.
*H04R 5/00* (2006.01)

(52) U.S. Cl. ..... 381/1; 381/98

(58) Field of Classification Search ..... 381/1, 381/10, 17, 303, 310, 98–104, 106, 107, 381/61

See application file for complete search history.

(56) References Cited

U.S. PATENT DOCUMENTS

| | | | |
|---|---|---|---|
| 1,616,639 | A | 2/1927 | Sprague |
| 1,951,669 | A | 3/1934 | Ramsey |
| 2,113,976 | A | 4/1938 | Bagno |
| 2,315,248 | A | 3/1943 | De Rosa |
| 2,315,249 | A | 3/1943 | De Rosa |
| 2,461,344 | A | 2/1949 | Olson |
| 3,170,991 | A | 2/1965 | Glasgal |
| 3,229,038 | A | 1/1966 | Richter |
| 3,246,081 | A | 4/1966 | Edwards |
| 3,249,696 | A | 5/1966 | Sickle |
| 3,398,810 | A | 8/1968 | Clark, III |
| 3,612,211 | A | 10/1971 | Clark, III |
| 3,665,105 | A | 5/1972 | Chowning |
| 3,697,692 | A | 10/1972 | Hafler |
| 3,745,254 | A | 7/1973 | Ohta et al. |
| 3,757,047 | A | 9/1973 | Ito et al. |
| 3,761,631 | A | 9/1973 | Ito et al. |
| 3,772,479 | A | 11/1973 | Hilbert |
| 3,849,600 | A | 11/1974 | Ohshima |
| 3,885,101 | A | 5/1975 | Ito et al. |
| 3,892,624 | A | 7/1975 | Shimada |

(Continued)

FOREIGN PATENT DOCUMENTS

DE 3 331 352 A1 8/1983

(Continued)

OTHER PUBLICATIONS

Davies, Jeff and Bohn, Dennis "Squeeze Me, Stretch Me: The DC 24 Users Guide" RaneNote 130 [online]. Rane Corporation. 1993 [retrieved Apr. 26, 2005]. Retrieved from the Internet: <URL:http://www.rane.com/pdf/note130.pdf>. pp. 2-3.*

(Continued)

*Primary Examiner*—Xu Mei
(74) *Attorney, Agent, or Firm*—Knobbe, Martens, Olson & Bear LLP

(57) ABSTRACT

An acoustic correction apparatus processes a pair of left and right input signals to compensate for spatial distortion as a function of frequency when said input signals are reproduced through loudspeakers in a sound system. The sound-energy of the left and right input signals is separated and corrected in a first low-frequency range and a second high-frequency range. The resultant signals are recombined to create image-corrected audio signals having a desired sound-pressure response when reproduced by the loudspeakers in the sound system. The desired sound-pressure response creates an apparent sound image location with respect to a listener. The image-corrected signals can also be spatially-enhanced to broaden the apparent sound image and improve the low frequency characteristics of the sound when played on small loudspeakers.

35 Claims, 53 Drawing Sheets

U.S. PATENT DOCUMENTS 3,921,104 A 11/1975 Gundry
3,925,615 A 12/1975 Nakano
3,943,293 A 3/1976 Bailey
3,970,787 A * 7/1976 Searle ..... 381/310
4,024,344 A 5/1977 Dolby et al.
4,045,748 A 8/1977 Filliman
4,052,560 A 10/1977 Santmann
4,063,034 A 12/1977 Peters
4,069,394 A 1/1978 Doi et al.
4,118,599 A 10/1978 Iwahara et al.
4,118,600 A 10/1978 Stahl
4,139,728 A 2/1979 Haramoto et al.
4,177,356 A * 12/1979 Jaeger et al. ..... 381/103
4,182,930 A 1/1980 Blackmer
4,191,852 A * 3/1980 Nishikawa ..... 381/1
4,192,969 A 3/1980 Iwahara
4,204,092 A 5/1980 Bruney
4,209,665 A 6/1980 Iwahara
4,218,583 A 8/1980 Poulo
4,218,585 A 8/1980 Carver
4,219,696 A 8/1980 Kogure et al.
4,237,343 A 12/1980 Kurtin et al.
4,239,937 A 12/1980 Kampmann
4,303,800 A 12/1981 DeFreitas
4,306,113 A 12/1981 Morton
4,308,423 A 12/1981 Cohen
4,308,424 A 12/1981 Bice, Jr
4,309,570 A 1/1982 Carver
4,329,544 A 5/1982 Yamada
4,332,979 A 6/1982 Fischer
4,349,698 A 9/1982 Iwahara
4,355,203 A 10/1982 Cohen
4,356,349 A 10/1982 Robinson
4,393,270 A 7/1983 van den Berg
4,394,536 A 7/1983 Shima et al.
4,408,095 A 10/1983 Ariga et al.
4,479,235 A 10/1984 Griffs
4,481,662 A 11/1984 Long et al.
4,489,432 A 12/1984 Polk
4,495,637 A 1/1985 Bruney
4,497,064 A 1/1985 Polk
4,503,554 A 3/1985 Davis
4,567,607 A 1/1986 Bruney et al.
4,569,074 A 2/1986 Polk
4,589,129 A 5/1986 Blackmer et al.
4,593,696 A 6/1986 Hochmair et al.
4,594,610 A 6/1986 Patel
4,594,729 A 6/1986 Weingartner
4,594,730 A 6/1986 Rosen
4,622,691 A 11/1986 Tokumo et al.
4,648,117 A 3/1987 Kunugi et al.
4,696,036 A 9/1987 Julstrom
4,698,842 A 10/1987 Mackie et al.
4,703,502 A 10/1987 Kasai et al.
4,739,514 A * 4/1988 Short et al. ..... 381/103
4,748,669 A 5/1988 Klayman
4,790,014 A 12/1988 Watanabe et al.
4,803,727 A 2/1989 Holt et al.
4,817,149 A * 3/1989 Myers ..... 381/1
4,819,269 A 4/1989 Klayman
4,831,652 A * 5/1989 Anderson et al. ..... 381/1
4,836,329 A 6/1989 Klayman
4,837,824 A 6/1989 Orban
4,841,572 A 6/1989 Klayman
4,856,064 A 8/1989 Iwamatsu
4,866,774 A 9/1989 Klayman
4,866,776 A 9/1989 Kasai et al.
4,888,809 A 12/1989 Knibbeler
4,891,560 A 1/1990 Okumura et al.
4,891,841 A 1/1990 Bohn
4,910,779 A 3/1990 Cooper et al.
4,953,213 A 8/1990 Tasaki et al.
4,955,058 A 9/1990 Rimkeit et al.
5,018,205 A * 5/1991 Takagi et al. ..... 381/86
5,033,092 A 7/1991 Sadaie
5,042,068 A 8/1991 Scholten et al.
5,046,097 A 9/1991 Lowe et al.
5,067,157 A 11/1991 Ishida et al.
5,105,462 A 4/1992 Lowe et al.
5,124,668 A 6/1992 Christian
5,146,507 A 9/1992 Satoh et al.
5,177,329 A 1/1993 Klayman
5,180,990 A 1/1993 Ohkuma
5,208,493 A * 5/1993 Lendaro et al. ..... 327/430
5,208,860 A 5/1993 Lowe et al.
5,228,085 A 7/1993 Aylward
5,251,260 A 10/1993 Gates
5,255,326 A 10/1993 Stevenson
5,319,713 A 6/1994 Waller, Jr. et al.
5,325,435 A 6/1994 Date et al.
5,333,201 A 7/1994 Waller, Jr.
5,359,665 A 10/1994 Werrbach
5,371,799 A 12/1994 Lowe et al.
5,386,082 A 1/1995 Higashi
5,390,364 A 2/1995 Webster et al.
5,400,405 A * 3/1995 Petroff ..... 381/1
5,420,929 A 5/1995 Geddes et al.
5,452,364 A 9/1995 Bonham
5,459,813 A 10/1995 Klayman
5,533,129 A 7/1996 Gefvert
5,596,931 A 1/1997 Rössler et al.
5,638,452 A 6/1997 Waller, Jr.
5,661,808 A 8/1997 Klayman
5,668,885 A 9/1997 Oda
5,771,295 A 6/1998 Waller, Jr.
5,771,296 A * 6/1998 Unemura ..... 381/28
5,784,468 A 7/1998 Klayman
5,822,438 A 10/1998 Sekine et al.
5,850,453 A 12/1998 Klayman et al.
5,872,851 A * 2/1999 Petroff ..... 381/18
5,892,830 A 4/1999 Klayman
5,930,375 A 7/1999 East et al.
5,999,630 A * 12/1999 Iwamatsu ..... 381/17
6,134,330 A * 10/2000 De Poortere et al. ..... 381/61
6,285,767 B1 9/2001 Klayman
6,597,791 B1 7/2003 Klayman
6,718,039 B1 4/2004 Klayman et al.

FOREIGN PATENT DOCUMENTS

EP 0 094 762 A2 5/1983
EP 0 095 902 A1 5/1983
EP 0 097 982 A3 6/1983
EP 0 312 406 A2 10/1988
EP 0 320 270 A2 12/1988
EP 0 354 517 A2 8/1989
EP 0 357 402 A2 8/1989
EP 0 526 880 A2 8/1992
EP 0 546 619 A2 12/1992
EP 0 637 191 A2 7/1994
EP 0 699 012 A2 6/1995
EP 0 729 287 A2 2/1996
FI 35 014 2/1966
GB 2 016 248 A 2/1979
GB 2 073 977 A 3/1981
GB 2 154 835 A 2/1985
GB 2 277 855 A 5/1993
JP 40-29936 10/1940
JP 43-12585 5/1943
JP 58146200 A * 8/1983
JP 58-144989 9/1983
JP 59-27692 2/1984
JP 61-33600 2/1986
JP 61-166696 10/1986

| | | | | |
|---|---|---|---|---|
| JP | 62097500 | | | 5/1987 |
| JP | 05300596 | A | * | 11/1993 |
| JP | 09224300 | A | * | 8/1997 |
| WO | WO 87/06090 | | | 1/1987 |
| WO | WO 91/19407 | | | 6/1991 |
| WO | WO 94/16538 | | | 12/1993 |
| WO | WO 98/46044 | | | 4/1997 |
| WO | WO 97/42789 | | | 5/1997 |
| WO | WO 98/21915 | | | 10/1997 |
| WO | WO 99/26454 | | | 10/1998 |

OTHER PUBLICATIONS

PCT Search Report.

Schroeder, M.R., "An Artificial Stereophonic Effect Obtained from a Single Audio Signal", Journal of the Audio Engineering Society, vol. 6, No. 2, pp. 74-79, Apr. 1958.

Kurozumi, K., et al., "A New Sound Image Broadening Control System Using a Correlation Coefficient Variation Method", Electronics and Communications in Japan, vol. 67-A, No. 3, pp. 204-211, Mar. 1984.

Sundberg, J., "The Acoustics of the Singing Voice", The Physics of Music, pp. 16-23, 1978.

Ishihara, M., "A New Analog Signal Processor For A Stereo Enhancement System", IEEE Transactions on Consumer Electronics, vol. 37, No. 4, pp 806-813, Nov. 1991.

Allison, R., "The Loudspeaker / Living Room System", Audio, pp. 18-22, Nov. 1971.

Vaughan, D., "How We Hear Direction", Audio, pp. 51-55, Dec. 1983.

Stevens, S., et al., "Chapter 5: The Two-Eared Man", Sound And Hearing, pp. 98-106 and 196, 1965.

Eargle, J., "Multichannel Stereo Matrix Systems: An Overview", Journal of the Audio Engineering Society, pp. 552-558 (no date listed).

Wilson, Kim, "AC-3 Is Here! But Are You Ready To Pay The Price?", Home Theater, pp. 60-65, Jun. 1995.

Kaufman, Richard J., "Frequency Contouring For Image Enhancement", Audio, pp. 34-39, Feb. 1985.

Philips Components, "Integrated Circuits Data Handbook: Radio, audio and associated systems, Bipolar, MOS, CA3089 to TDA1510A", Oct. 7, 1987, pp. 103-110.

* cited by examiner

| FIG. 26A | FIG. 26A |
|---|---|

| | | |
|---|---|---|
| FIG. 37A | FIG. 37B | FIG. 37C |

FIG. 37

3716
R13
1
2
80.6k 1%
3719
R18
1
2
110k 1%
.0047UF 10%
1
2
C2
3721
R19
3720
1
2
47.5k 1%
R14
1
2
3722
1.5k 1%
3725
R21
1
2
33.2k 1%
3.74k 1%
R17
3023
1
C3
2
0.47UF 10%
3024
CENTER
1
R18
2
3745
10k LIN
3
3746
R11
1
2
80.6k 1%

R25
3726
121k 1%
U1
3727
TL074
3734
R34
38.3k 1%
U2
LOUT
TL074
3735
3729
R26
11.5k 1%
16.2k 1%
R32
3732
SPACE
R22
3728
R27
30.0 k 1%
3730
3731
16.2k 1%
R30
R35
3754
38.3k 1%
U2
ROUT
TL074
3755
3747
R23
16.2k 1%
R28
3750
11.5k 1%
3751
R29
30.9k 1%
16.2k 1%
R33
3753
R24
3748
16.2k 1%
U1
TL074
3749
3752
16.2k 1%
R31

ACOUSTIC CORRECTION APPARATUS

FIELD OF THE INVENTION

This invention relates generally to audio enhancement systems, and especially those systems and methods designed to improve the realism of stereo sound reproduction. More particularly, this invention relates to an apparatus for overcoming the acoustic imaging and frequency response deficiencies of a sound system as perceived by a listener.

BACKGROUND OF THE INVENTION

In a sound reproduction environment, various factors may serve to degrade the quality of reproduced sound as perceived by a listener. Such factors distinguish the sound reproduction from that of an original sound stage. One such factor is the location of loudspeakers in a sound stage which, if inappropriately placed, may lead to a distorted sound-pressure response over the audible frequency spectrum. The placement of loudspeakers also affects the perceived width of a soundstage. For example, loudspeakers act as point sources of sound limiting their ability to reproduce reverberant sounds that are easily perceived in a live sound stage. In fact, the perceived sound stage width of many audio reproduction systems is limited to the distance separating a pair of loudspeakers when placed in front of a listener. Another factor degrading the quality of reproduced sound may result from microphones which record sound differently from the way the human hearing system perceives sound. In an attempt to overcome the factors which degrade the quality of reproduced sound, countless efforts have been expended to alter the characteristics of a sound reproduction environment to mimic that heard by a listener in a live sound stage.

Some efforts at stereo image enhancement have focused on the acoustic abilities and limitations of the human ear. The human ear's auditory response is sensitive to sound intensity, phase differences between certain sounds, the frequency of the sound itself, and the direction from which sound emanates. Despite the complexity of the human auditory system, the frequency response of the human ear is relatively constant from person to person.

When sound waves having a constant sound pressure level across all frequencies are directed at a listener from a single location, the human ear will react differently to the individual frequency components of the sound. For example, when sound of equal sound pressure is directed towards a listener from in front of the listener, the pressure level created within the listener's ear by a sound of 1000 hertz will be different from that of 2000 hertz.

In addition to frequency sensitivity, the human auditory system reacts differently to sounds impinging upon the ear from various angles. Specifically, the sound pressure level within the human ear will vary with the direction of sound. The shape of the outer ear, or pinna, and the inner ear canal are largely responsible for the frequency contouring of sounds as a function of direction.

The human auditory response is sensitive to both azimuth and elevation changes of a sound's origin. This is particularly true for complex sound signals, i.e., those having multiple frequency components, and for higher frequency components in general. The variance in sound pressure among the frequency components within the ear is interpreted by the brain to provide indications of a sound's origin. When a recorded sound is reproduced, the directional cues to the sound's origin, as interpreted by the ear from sound pressure information, will thus be dependent upon the actual location of loudspeakers that reproduce the sound.

A constant sound pressure level, i.e., a "flat" sound pressure versus frequency response, can be obtained at the ears of a listener from loudspeakers positioned directly in front of the listener. Such a response is often desirable to achieve a realistic sound image. However, the quality of a set of loudspeakers may be less than ideal, and they may not be placed in the most acoustically-desirable location. Both such factors often lead to disrupted sound pressure characteristics. Sound systems of the prior art have disclosed methods to "correct" the sound pressure emanating from loudspeakers to create a spatially correct response thereby improving the resulting sound image.

To achieve a more spatially correct response for a given sound system, it is known to select and apply head-related-transfer-functions (HRTFs) to an audio signal. HRTFs are based on the acoustics of the human hearing system. Application of an HRTF is used to adjust the amplitudes of portions of the audio signal to compensate for spatial distortion. HRTF-based principles may also be used to relocate a stereo image from non-optimally placed loudspeakers.

A second type of deficiency often occurs because it is difficult to adequately reproduce low-frequency sounds such as bass. Various conventional approaches to improving the output of low-frequency sounds include the use of higher quality loudspeakers with greater cone areas, larger magnets, larger housings, or greater cone excursion capabilities. In addition, conventional systems have attempted to reproduce low-frequency sounds with resonant chambers and horns that match the acoustic impedance of the loudspeaker to the acoustic impedance of free space surrounding the loudspeaker.

Not all systems, however, can simply use more expensive or more powerful loudspeakers to reproduce low-frequency sounds. For example, some conventional sound systems such as compact audio systems and multimedia computer systems rely on small loudspeakers. In addition, to conserve costs, many audio systems use less accurate loudspeakers. Such loudspeakers typically do not have the capability to properly reproduce low-frequency sounds and consequently, the sounds are typically not as robust or enjoyable as systems that more accurately reproduce low-frequency sounds.

Some conventional enhancement systems attempt to compensate for poor reproduction of low-frequency sounds by amplifying the low-frequency signals prior to inputting the signals into the loudspeakers. Amplifying the low-frequency signals delivers a greater amount of energy to the loudspeakers, which in turn, drives the loudspeakers with greater forces. Such attempts to amplify the low-frequency signals, however, can result in overdriving the loudspeakers. Unfortunately, overdriving the loudspeakers can increase the background noise, introduce distracting distortions, and damage the loudspeakers.

Still other conventional systems, in an attempt to compensate for the lack of the lower-frequencies, distort the reproduction of the higher frequencies in ways that add undesirable sound coloration.

A third difficulty arises because sounds emanating from multiple locations are often not properly reproduced in an audio system. One approach directed to improving the reproduction of sound includes surround sound systems that have multiple recording tracks. The multiple recording tracks are used to record the spatial information associated with sounds that emanate from multiple locations.

For example, in a surround sound system, some of the recording tracks contain sounds that originate from in front of the listener, while other recording tracks contain sounds, which originate from behind the listener. When multiple loudspeakers are placed around the listener, the audio information contained in the recording tracks makes the produced sounds appear more realistic to the listener. Such systems, however, are typically more expensive than systems which do not use multiple recording tracks and multiple speaker arrangements.

To conserve costs, many conventional two-speaker systems attempt to simulate a surround sound experience by introducing unnatural time-delays or phase-shifts between left and right signal sources. Unfortunately, such systems often suffer from unrealistic effects in the reproduced sound.

Other known sound enhancement techniques operate on what are called "sum" and "difference" signals. The sum signal, which is also called the monophonic signal, is the sum of the left and right signals. This can be conceptualized as adding or combining the left and right signals (L+R).

The difference signal, on the other hand, represents the difference between the two left and right audio signals. This is best conceptualized as subtracting the right signal from the left signal (L-R). The difference signal is also often called the ambient signal.

It is known that modifying certain frequencies in the difference signal can widen the perceived sound projected from the left and right loudspeakers. The widened sound image typically results from altering the reverberant sounds, which are present in the difference signal.

The circuitry that generates the sum and difference signals, however, generates the sum and difference signals by processing of the left and right input signals. Furthermore, once the circuitry generates the sum and difference signals, additional circuitry then separately processes and recombines the sum and difference signals in order to produce an enhanced sound effect.

Typically, the creation and processing of the sum and difference signal are accomplished with digital signal processors, operational amplifiers and the like. Such implementations usually require complicated circuitry that increases the cost of such systems. Thus, despite the contributions from the prior art, there exists a need for a simplified audio enhancement system that reduces costs associated with producing an enhanced listening experience.

SUMMARY OF THE INVENTION

The present invention solves these and other problems by providing a signal processing technique that significantly improves the image size, bass performance and dynamics of an audio system, surrounding the listener with an engaging and powerful representation of the audio performance. It improves the listening experience for a variety of applications, including computer, multimedia, televisions, boomboxes, automobiles, home audio, and portable audio systems. In one embodiment, the sound correction system corrects for the apparent placement of the loudspeakers, the image created by the loudspeakers, and the low frequency response produced by the loudspeakers. In one embodiment, the sound correction system enhances spatial and frequency response characteristics of sound reproduced by two or more loudspeakers. The audio correction system includes an image correction module that corrects the listener-perceived vertical image of the sound reproduced by the loudspeakers, a bass enhancement module that improves the listener-perceived bass response of the loudspeakers, and an image enhancement module that enhances the listener-perceived horizontal image of the apparent sound stage.

In one embodiment, three processing techniques are used. Spatial cues responsible for positioning sound outside the boundaries of the speaker are equalized using Head Related Transfer Functions (HRTFs). These HRTF correction curves account for how the brain perceives the location of sounds to the sides of a listener even when played back through speakers in front of the listener. As a result the presentation of instruments and vocalists occur in their proper place, with the addition of indirect and reflected sounds all about the room. A second set of HRTF correction curves expands and elevates the apparent size of the stereo image, such that the sound stage takes on a scale of immense proportion compared to the speaker locations. Finally, bass performance is enhanced through a psychoacoustic technique that restores the perception of low frequency fundamental tones by dynamically augmenting harmonics that the speaker can more easily reproduce.

The acoustic correction system, and the associated methods of operation, provide a sophisticated and effective system for improving the vertical, horizontal, and spectral sound image in an imperfect reproduction environment. In one embodiment, the system first corrects the vertical image produced by the loudspeakers, then the bass is enhanced, and finally, the horizontal image is corrected. The vertical image enhancement typically includes some emphasis of the lower frequency portions of the sound, and thus providing vertical enhancement before bass enhancement contributes to the overall effect of the bass enhancement processing. The bass enhancement provides some mixing of the common portions of the left and right portions of the low frequency information in a stereophonic signal (common-mode). By contrast, the horizontal image enhancement provides some enhancement and shaping of the differences between the left and right portions (differential-mode). Thus, in one embodiment, bass enhancement is advantageously provided before horizontal image enhancement in order to balance the common-mode and differential-mode portions of the stereophonic signal to produce a pleasing effect for the listener.

To achieve an improved stereo image in the vertical plane, an image correction device divides an input signal into first and second frequency ranges that collectively contain substantially all of the audio frequency spectrum. The frequency response characteristics of the input signal within the first and second frequency ranges are separately corrected and combined to create an output signal having a relatively flat frequency-response characteristic with respect to a listener. The level of frequency correction, i.e., sound-energy correction, is dependent upon the reproduction environment and tailored to overcome the acoustic limitations of such an environment. The design of the acoustic correction apparatus allows for easy and independent correction of the input signal within individual frequency ranges to achieve a spatially-corrected and relocated sound image.

Within an audio reproduction environment, loudspeakers may be poorly located, thereby adversely affecting a sound image perceived by the listener. For example, headphones often produce an unpleasing sound image because the transducers are located right next to the listener's ears. The acoustic correction apparatus of the present invention relocates the sound image to a more pleasing apparent position.

Through application of the acoustic correction apparatus, a stereo image generated from playback of an audio signal may be spatially corrected to convey a perceived source of origin having a vertical and/or horizontal position distinct from the position of the loudspeakers. The exact source of origin perceived by a listener will depend on the level of spatial correction.

Once a perceived sound origin is obtained through correction of spatial distortion, the corrected audio signal may be enhanced to provide an expanded stereo image. In accordance with one embodiment, stereo image enhancement of a relocated audio image takes into account acoustic principles of human hearing to envelop the listener in a realistic sound stage. In those sound reproduction environments where a listening position is relatively fixed, (such as the interior of an automobile, multimedia computer systems, bookshelf speaker systems, etc.) the amount of stereo image enhancement applied to the audio signal is partially determined by the actual position of the loudspeakers with respect to the listener.

In loudspeakers that do not reproduce certain low-frequency sounds, the invention creates the illusion that the missing low-frequency sounds do exist. Thus, a listener perceives low frequencies, which are below the frequencies the loudspeaker can actually accurately reproduce. This illusionary effect is accomplished by exploiting, in a unique manner, how the human auditory system processes sound.

One embodiment of the invention exploits how a listener mentally perceives music or other sounds. The process of sound reproduction does not stop at the acoustic energy produced by the loudspeaker, but includes the ears, auditory nerves, brain, and thought processes of the listener. Hearing begins with the action of the ear and the auditory nerve system. The human ear may be regarded as a delicate translating system that receives acoustical vibrations, converts these vibrations into nerve impulses, and ultimately into the "sensation" or perception of sound.

Advantageously, some embodiments of the invention exploit how the human ear processes overtones and harmonics of low-frequency sounds to create the perception that non-existent low-frequency sounds are being emitted from a loudspeaker. In some embodiments the frequencies in higher-frequency bands are selectively processed to create the illusion of lower-frequency signals. In other embodiments, certain higher-frequency bands are modified with a plurality of filter functions.

In addition, some embodiments of the invention are designed to improve the low-frequency enhancement of popular audio program material, such as music. Most music is rich in harmonics. Accordingly, these embodiments can modify a wide variety of music types to exploit how the human ear processes low-frequency sounds. Advantageously, music in existing formats can be processed to produce the desired effects.

This new approach produces a number of significant advantages. Because a listener perceives low-frequency sounds, which do not actually exist, the need for large loudspeakers, greater cone excursions, or added horns is reduced. Thus, in one embodiment, small loudspeakers can appear as if they are emitting the low-frequency sounds of larger loudspeakers. As can be expected, this embodiment produces the perception of low-frequency audio such as bass, in sound environments that are too small for large loudspeakers. Large loudspeakers are benefited as well, by creating the perception that they are producing enhanced low-frequency sounds.

In addition, with one embodiment of the invention, the small loudspeakers in hand-held and portable sound systems can create a more enjoyable perception of low-frequency sounds. Thus, the listener need not sacrifice low-frequency sound quality for portability.

In one embodiment of the invention, lower-cost loudspeakers create the illusion of low-frequency sounds. Many low-cost loudspeakers cannot adequately reproduce low-frequency sounds. Rather than actually reproducing low-frequency sounds with expensive speaker housings, high performance components and large magnets, one embodiment uses higher frequency sounds to create the illusion of low-frequency sounds. As a result, lower-cost loudspeakers can be used to create a more realistic and robust listening experience.

Furthermore, in one embodiment, the illusion of low-frequency sounds creates a heightened listening experience that increases the realism of the sound. Thus, instead of the reproduction of the muddy or wobbly low-frequency sounds existing in many low-cost prior art systems, one embodiment of the invention reproduces sounds that are perceived to be more accurate and clear. Such low-cost audio and audio-visual devices can include, by way of example, radios, mobile audio systems, computer games, loudspeakers, compact disc (CD) players, digital versatile disc (DVD) players, multimedia presentation devices, computer sound cards, and the like.

In one embodiment, creating the illusion of low-frequency sounds requires less energy than actually reproducing the low-frequency sounds. Thus, systems which operate on batteries, low-power environments, small speakers, multimedia speakers, headphones, and the like, can create the illusion of low-frequency sounds without consuming as much valuable energy as systems which simply amplify or boost low-frequency sounds.

Other embodiments of the invention create the illusion of lower-frequency signals with specialized circuitry. These circuits are simpler than prior art low-frequency amplifiers and thus reduce the costs of manufacturing. Advantageously, these cost less than prior art sound enhancement devices that add complex circuitry.

Still other embodiments of the invention rely on a microprocessor, which implements the disclosed low-frequency enhancement techniques. In some cases, existing processing audio components can be reprogrammed to provide the disclosed unique low-frequency signal enhancement techniques of one or more embodiments of the invention. As a result, the costs of adding low-frequency enhancement to existing systems is significantly reduced.

In one embodiment, the sound enhancement apparatus receives one or more input signals, from a host system and in turn, generates one or more enhanced output signals. In particular, the two input signals are processed to provide a pair of spectrally enhanced output signals, that when played on a loudspeaker and heard by a listener, produce the sensation of extended bass. In one embodiment, the low-frequency audio information is modified in a different manner than the high-frequency audio information.

In one embodiment, the sound enhancement apparatus receives one or more input signals and generates one or more enhanced output signals. In particular, the input signals comprise waveforms having a first frequency range and a second frequency range. The input signals are processed to provide the enhanced output signals, that when played on a loudspeaker and heard by a listener, produce the sensation of extended bass. In addition, the embodiment may modify information in the first frequency range in a different manner than information in the second frequency range. In some embodiments, the first frequency range may be bass frequencies too low for the desired loudspeaker to reproduce and the second frequency range may be midbass frequencies that the loudspeaker can reproduce.

One embodiment modifies the audio information that is common to two stereo channels in a manner different from energy that is not common to the two channels. The audio information that is common to both input signals is referred to as the combined signal. In one embodiment, the enhancement system spectrally shapes the amplitude of the phase and frequencies in the combined signal in order to reduce the clipping that may result from high-amplitude input signals without removing the perception that the audio information is in stereo.

As discussed in more detail below, one embodiment of the sound enhancement system spectrally shapes the combined signal with a variety of filters to create an enhanced signal. By enhancing selected frequency bands within the combined signal, the embodiment provides a perceived loudspeaker bandwidth that is wider than the actual loudspeaker bandwidth.

One embodiment of the sound enhancement apparatus includes feedforward signal paths for the two stereo channels and three parallel filters for the combined signal path. Each of the four parallel filters comprises a sixth order bandpass filter consisting of three series connected biquad filters. The transfer functions for these four filters are specially selected to provide phase and/or amplitude shaping of various harmonics of the low-frequency content of an audio signal. The shaping unexpectedly increases the perceived bandwidth of the audio signal when played through loudspeakers. In another embodiment, the sixth order filters are replaced by lower order Chebychev filters.

Because the spectral shaping occurs on the combined signal, which is then combined with the stereo information in the feedforward paths, the frequencies in the combined signal can be altered such that both stereo channels are affected, and some signals in certain frequency ranges are coupled from one stereo channel to the other stereo channel. As a result, various embodiments create enhanced audio sound in an entirely unique, novel, and unexpected manner.

The sound enhancement apparatus may in turn, be connected to one or more subsequent signal processing stages. These subsequent stages may provide improved soundstage or spatial processing. The output signals can also be directed to other audio devices such as recording devices, power amplifiers, loudspeakers, and the like without affecting the operation of the sound enhancement apparatus.

The present invention also provides a unique differential perspective correction system to improve the horizontal aspects of the sound image. The differential perspective correction system enhances sound in an entirely different way than other sound enhancement devices. Advantageously, the perspective correction system embodiment can be used to enhance sound in a wide range of low-cost audio and audio-visual devices which by way of example can include radios, mobile audio systems, computer games, multimedia presentation devices and the like.

Broadly speaking, the differential perspective correction apparatus receives two input signals, from a host system and in turn, generates two enhanced output signals. In particular, the two input signals are processed collectively to provide a pair of spatially corrected output signals. In addition, one embodiment modifies the audio information that is common to both input signals in a different manner than the audio information, which is not common to both input signals.

Audio information that is common to both input signals is referred to as the common-mode information, or the common-mode signal. The common-mode audio information differs from a sum signal in that rather than containing the sum of the input signals, it contains only that audio information which exists in both input signals at any given instant in time.

In contrast, the audio information which is not common to both input signals is referred to as the differential information or the differential signal. Although the differential information is processed in a different manner than the common-mode information, the differential information is not a discrete signal. As discussed in more detail below, the differential perspective correction apparatus spectrally shapes the differential signal with a variety of filters to create an equalized differential signal. By equalizing selected frequency bands within the differential signal, the differential perspective correction apparatus widens a perceived sound image projected from a pair of loudspeakers placed in front of a listener.

Because the cross-over impedance networks equalize the frequency ranges in the differential input, the frequencies in the differential signal can be altered without affecting the frequencies in the common-mode signal. As a result, the audio sound is enhanced in an entirely unique and novel manner.

BRIEF DESCRIPTION OF THE DRAWINGS

The above and other aspects, features, and advantages of the present invention will be more apparent from the following particular description thereof presented in conjunction with the following drawings, wherein.

DETAILED DESCRIPTION

Figure 1:
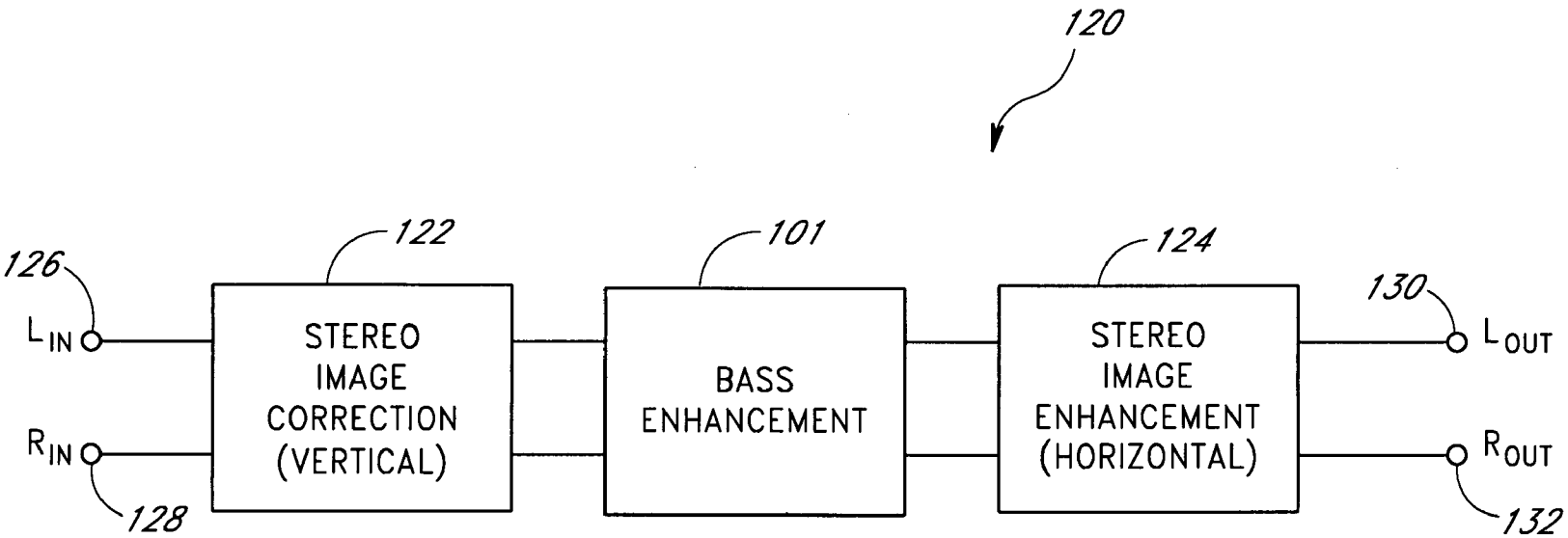
FIG. 1 is a block diagram of a stereo image correction system operatively connected to a stereo enhancement system and a bass enhancement system for creating a realistic stereo image from a pair of input stereo signals.

FIG. 1 is a block diagram of an acoustic correction apparatus 120 comprising, in series, a stereo image correction system 122, a bass enhancement system 101, and a stereo image enhancement system 124. The image correction system 122 provides a left stereo signal and a right stereo signal to the bass enhancement unit 101. The bass enhancement unit outputs left and right stereo signals to respective left and right inputs of the stereo image enhancement device 124. The stereo image enhancement system 124 processes the signals and provides a left output signal 130 and a right output signal 132. The output signals 130 and 132 may in turn be connected to some other form of signal conditioning system, or they may be connected directly to loudspeakers or headphones (not shown).

When connected to loudspeakers, the correction system 120 corrects for deficiencies in the placement of the loudspeakers, the image created by the loudspeakers, and the low frequency response produced by the loudspeakers. The sound correction system 120 enhances spatial and frequency response characteristics of the sound reproduced by the loudspeakers. In the audio correction system 120, the image correction module 122 corrects the listener-perceived vertical image of an apparent sound stage reproduced by the loudspeakers, the bass enhancement module 101 improves the listener-perceived bass response of the sound, and the image enhancement module 124 enhances the listener-perceived horizontal image of the apparent sound stage.

The correction apparatus 120 improves the sound reproduced by loudspeakers by compensating for deficiencies in the sound reproduction environment and deficiencies of the loudspeakers. The apparatus 120 improves reproduction of the original sound stage by compensating for the location of the loudspeakers in the reproduction environment. The sound-stage reproduction is improved in a way that enhances both the horizontal and vertical aspects of the apparent (i.e. reproduced) sound stage over the audible frequency spectrum. The apparatus 120 advantageously modifies the reverberant sounds that are easily perceived in a live sound stage such that the reverberant sounds are also perceived by the listener in the reproduction environment, even though the loudspeakers act as point sources with limited ability. The apparatus 120 also compensates for the fact that microphones often record sound differently from the way the human hearing system perceives sound. The apparatus 120 uses filters and transfer functions that mimic human hearing to correct the sounds produced by the microphone.

The sound system 120 adjusts the apparent azimuth and elevation point of a complex sound by using the characteristics of the human auditory response. The correction is used by the listener's brain to provide indications of the sound's origin. The correction apparatus 120 also corrects for loudspeakers that are placed at less than ideal conditions, such as loudspeakers that are not in the most acoustically-desirable location.

To achieve a more spatially correct response for a given sound system, the acoustic correction apparatus 120 uses certain aspects of the head-related-transfer-functions (HRTFs) in connection with frequency response shaping of the sound information to correct both the placement of the loudspeakers, to correct the apparent width and height of the sound stage, and to correct for inadequacies in the low-frequency response of the loudspeakers.

Thus, the acoustic correction apparatus 120 provides a more natural and realistic sound stage for the listener, even when the loudspeakers are placed at less than ideal locations and when the loudspeakers themselves are inadequate to properly reproduce the desired sounds.

The various sound corrections provided by the correction apparatus are provided in an order such that subsequent correction does not interfere with prior corrections. In one embodiment, the corrections are provided in a desirable order such that prior corrections provided by the apparatus 120 enhance and contribute to the subsequent corrections provided by the apparatus 120.

In one embodiment, the correction apparatus 120 simulates a surround sound system with improved bass response. The correction apparatus 120 creates the illusion that multiple loudspeakers are placed around the listener, and that audio information contained in multiple recording tracks is provided to the multiple speaker arrangement.

The acoustic correction system 120 provides a sophisticated and effective system for improving the vertical, horizontal, and spectral sound image in an imperfect reproduction environment. The image correction system 122 first corrects the vertical image produced by the loudspeakers. Then the bass enhanced system 101 adjusts the low frequency components of the sound signal in a manner that enhances the low frequency output of small loudspeakers that do no provide adequate low frequency reproduction capabilities. Finally, the horizontal sound image is corrected by the image enhancement system 124.

The vertical image enhancement provided by the image correction system 122 typically includes some emphasis of the lower frequency portions of the sound, and thus providing vertical enhancement before the bass enhancement system 101 contributes to the overall effect of the bass enhancement processing. The bass enhancement system 101 provides some mixing of the common portions of the left and right portions of the low frequency information in a stereophonic signal (common-mode). By contrast, the horizontal image enhancement provided by the image enhancement system 124 provides enhancement and shaping of the differences between the left and right portions (differential-mode) of the signal. Thus, in the correction system 120, bass enhancement is advantageously provided before horizontal image enhancement in order to balance the common-mode and differential-mode portions of the stereophonic, signal to produce a pleasing effect for the listener.

As disclosed above, the stereo image correction system 122, the bass enhancement system 101, and the stereo image enhancement system 124 cooperate to overcome acoustic deficiencies of a sound reproduction environment. The sound reproduction environments may be as large as a theater complex or as small as a portable electronic keyboard. The acoustic correction apparatus also provides major benefits for a multimedia computer systems (see e.g., FIG. 3), home audio, televisions, headphones, boom-boxes, automobiles, and the like.

Figure 2:
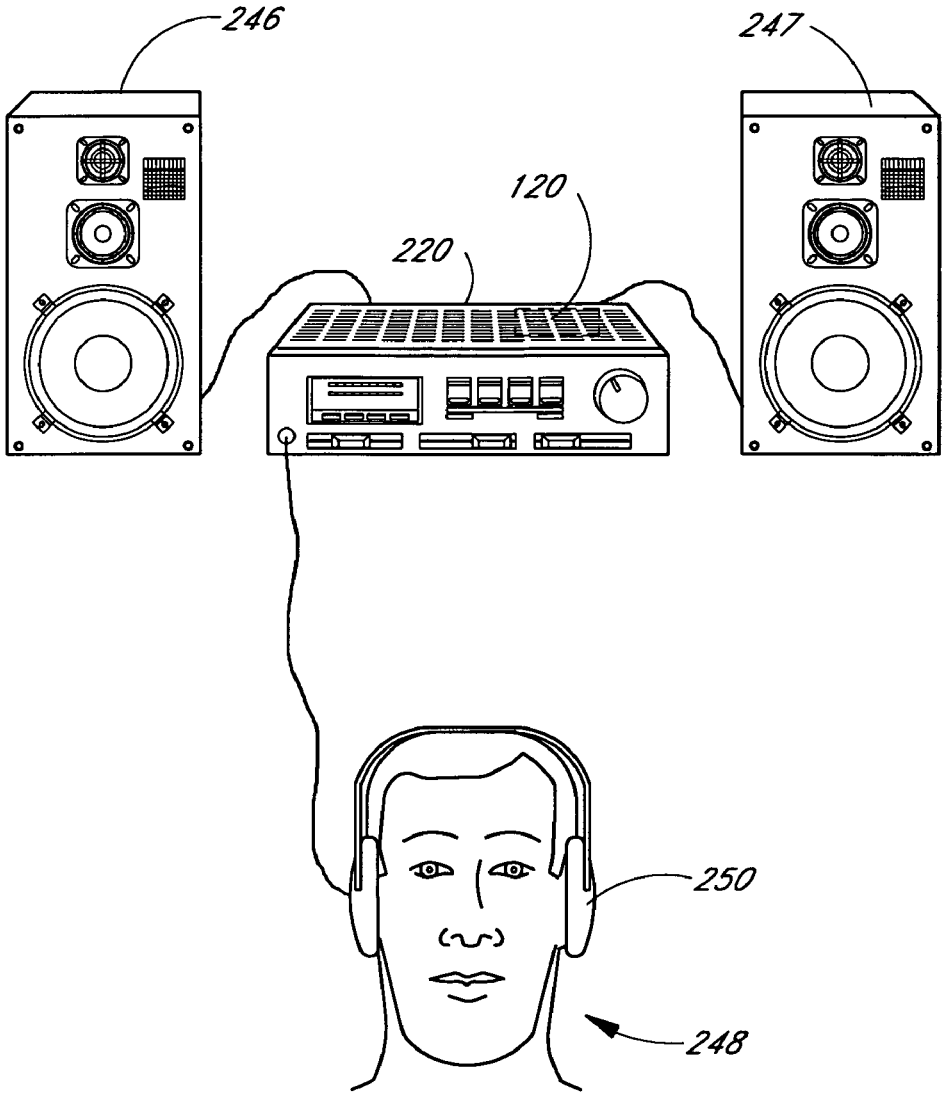
FIG. 2 is a diagram of a stereo system including a stereo receiver and two speakers.

FIG. 2 shows a stereophonic audio system having a receiver 220. The receiver 220 provides a left channel signal to a left speaker 246 and a right channel signal to a right speaker 247. Alternatively, the receiver 220 can be replaced by a television, a portable stereo system (e.g., a "boom box"), a clock-radio, and the like. The receiver 220 also provides the left and right channel signals to headphones 250. A listener (user) 248 can listen to the left and right channel signals using the headphones 250 or the loudspeakers 246, 247. The acoustic correction apparatus 120 can be implemented using analog devices in the receiver 220 or by software running on a Digital Signal Processor (DSP) in the receiver 220.

The loudspeakers 246, 247 are often not optimally positioned to provide the user with the desired stereo image—thus decreasing the listening pleasure of a listener. In a similar manner, headphones, such as the headphones 250, often produce a sound that is not pleasing because the headphones are placed adjacent to the ears rather than in front of the listener. Moreover, many small bookshelf loudspeakers, multimedia loudspeakers, and headphones have poor low frequency response characteristics that further decreasing the listening pleasure of the listener. The acoustic correction device (or software) 120 inside the receiver 220 corrects the left and right signals to produce a more pleasing sound when reproduced by the loudspeakers 246, 247 or the headphones 250. In one embodiment, the receiver 220 includes controls (such as a width control 3846 shown in FIG. 38 and/or a bass control 3827 shown in FIG. 38) to allow the listener 248 to adjust the sound produced in the left and right channels according to whether the listener 248 is listening to the loudspeakers 246, 247 or the headphones 250.

Figure 3:
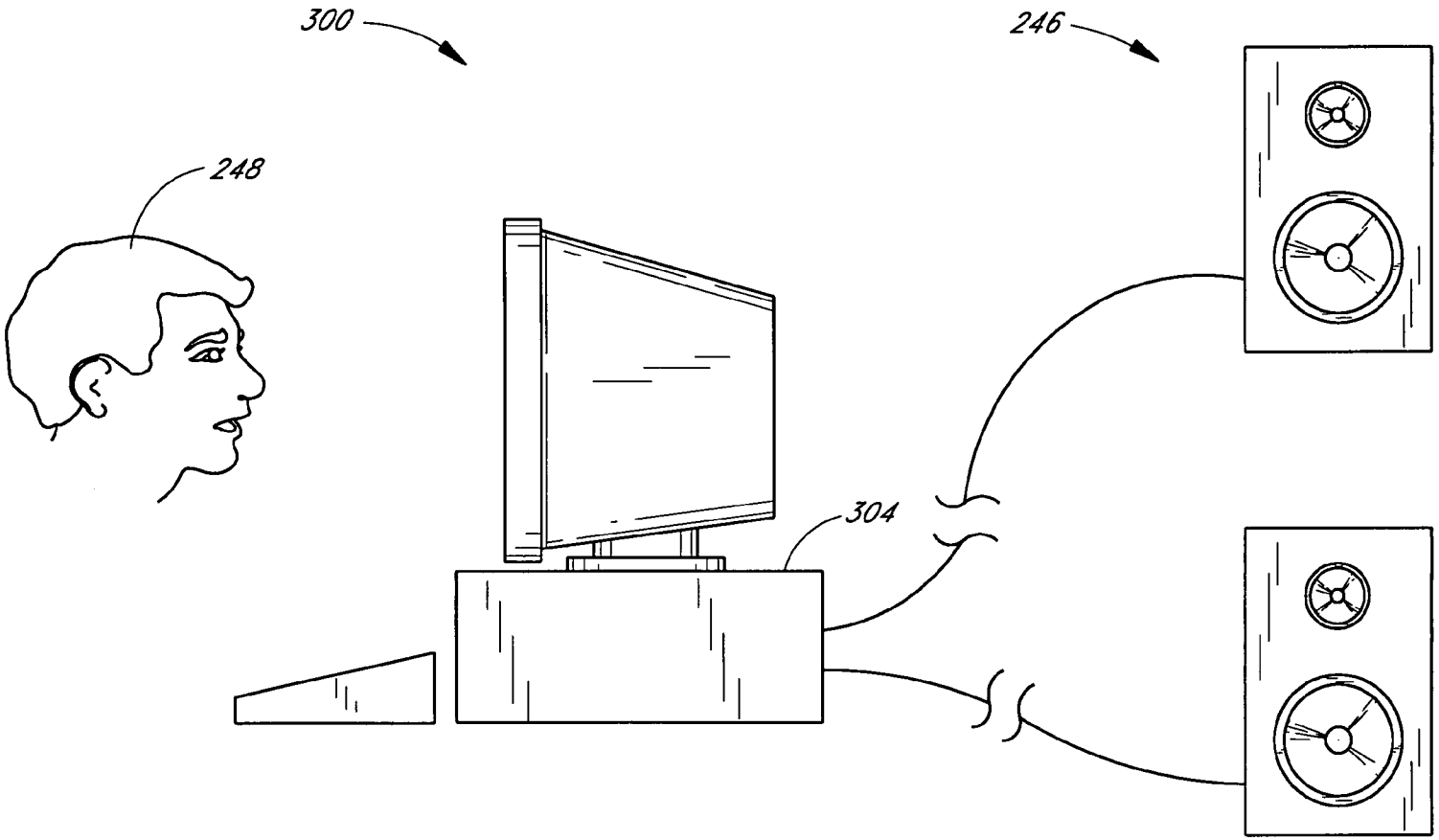
FIG. 3 is a diagram of a typical multimedia computer system.

FIG. 3 illustrates a typical computer audio system 300 which may advantageously use an embodiment of the present invention to improve the audio performance produced by the loudspeakers 246, 247. The loudspeakers 246, 247 are typically connected to a sound card (not shown) inside a computer unit 304. The sound card can be any computer interface card that produces audio output, including a radio card, television tuner card, PCMCIA card, internal modem, plug-in Digital Signal Processor (DSP) card, etc. The computer 304 causes the sound card to generate audio signals that are converted by the loudspeakers 246 into acoustic waves.

Figure 4A:
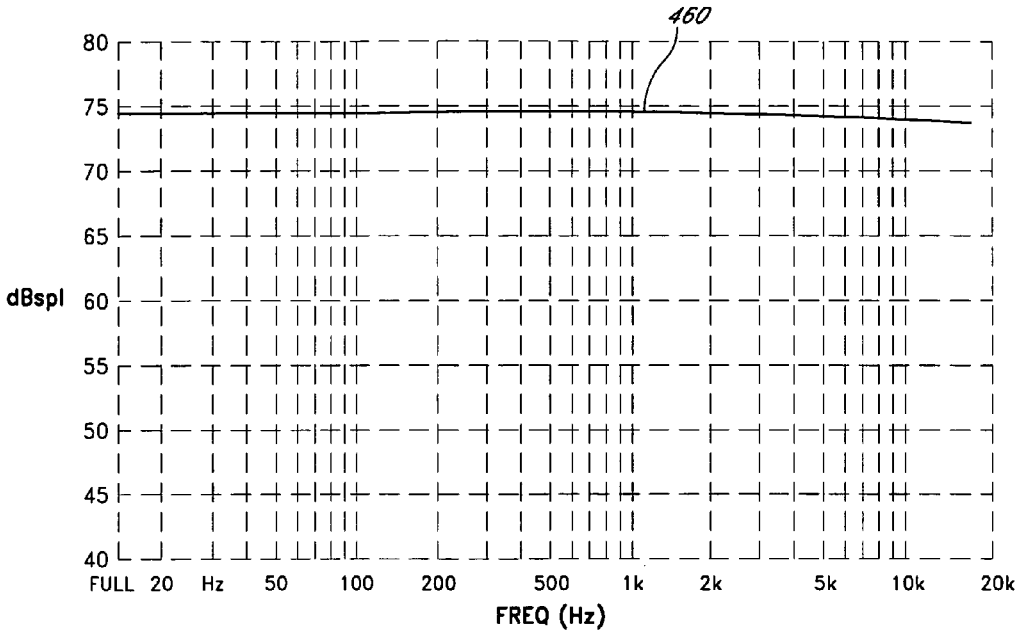
FIG. 4A is a graphical representation of a desired sound-pressure versus frequency characteristic for an audio reproduction system.

FIG. 4A depicts a graphical representation of a desired frequency response characteristic, appearing at the outer ears of a listener, within an audio reproduction environment. The curve 460 is a function of sound pressure level (SPL), measured in decibels, versus frequency. As can be seen in FIG. 4A, the sound pressure level is relatively constant for all audible frequencies. The curve 460 can be achieved from reproduction of pink noise through a pair of ideal loudspeakers placed directly in front of a listener at approximately ear level. Pink noise refers to sound delivered over the audio frequency spectrum having equal energy per octave. In practice, the flat frequency response of the curve 460 may fluctuate in response to inherent acoustic limitations of speaker systems.

The curve 460 represents the sound pressure levels that exist before processing by the ear of a listener. Referring back to FIG. 2, the flat frequency response represented by the curve 460 is consistent with sound emanating towards the listener 248, when the loudspeakers are located spaced apart and generally in front of the listener 248. The human ear processes such sound, as represented by the curve 460, by applying its own auditory response to the sound signals. This human auditory response is dictated by the outer pinna and the interior canal portions of the ear.

Unfortunately, the frequency response characteristics of many home and automotive sound reproduction systems do not provide the desired characteristic shown in FIG. 4A. On the contrary, loudspeakers may be placed in acoustically-undesirable locations to accommodate other ergonomic requirements. Sound emanating from the loudspeakers 246 and 247 may be spectrally distorted by the mere placement of the loudspeakers 246 and 247 with respect to the listener 248. Moreover, objects and surfaces in the listening environment may lead to absorption, or amplitude distortion, of the resulting sound signals. Such absorption is often prevalent among higher frequencies.

Figure 4B:
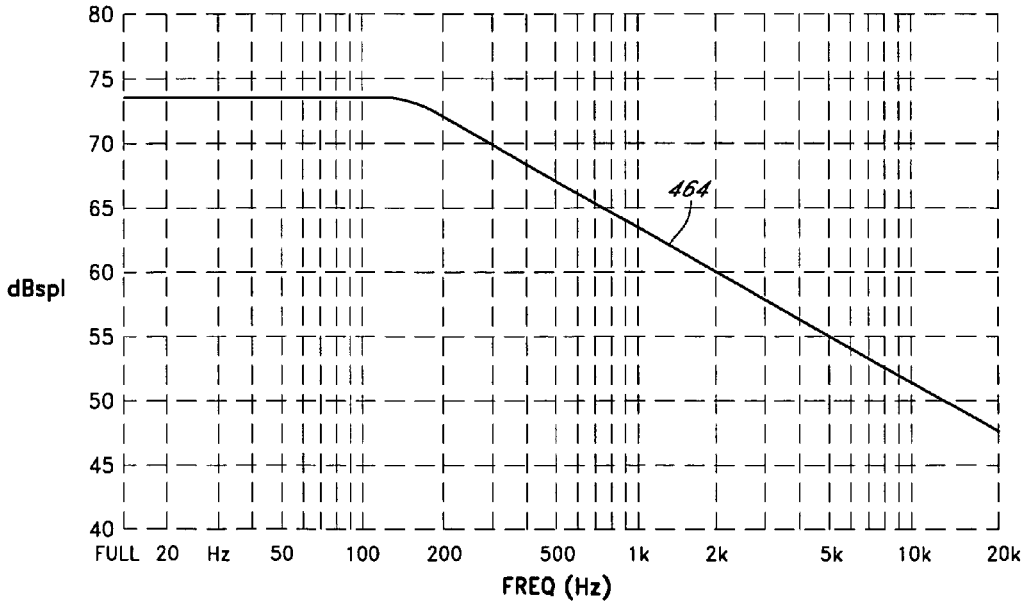
FIG. 4B is a graphical representation of a sound-pressure versus frequency characteristic corresponding to a first audio reproduction environment.
Figure 4C:
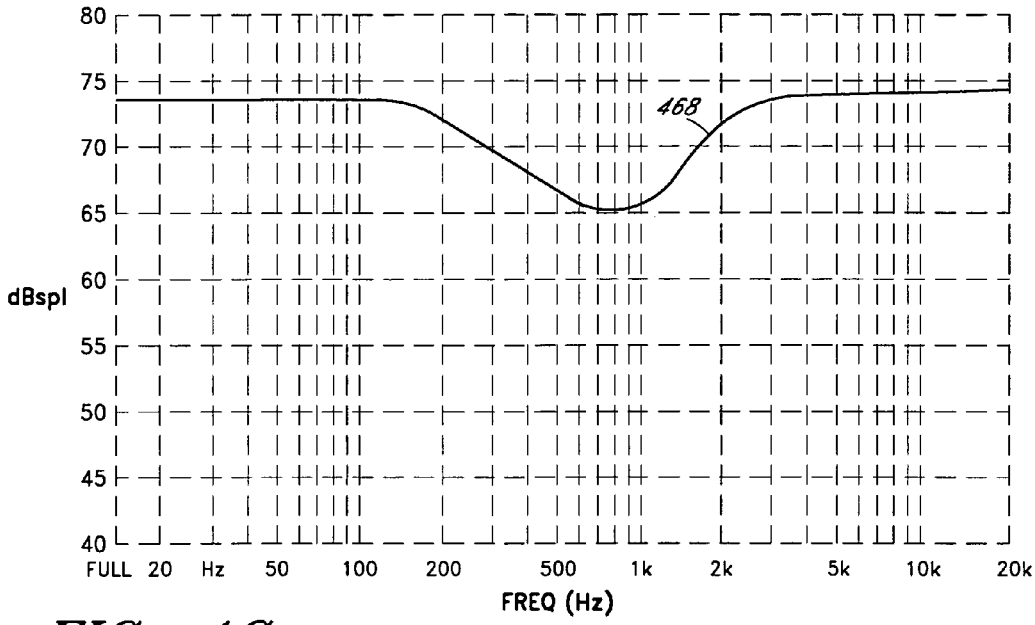
FIG. 4C is a graphical representation of a sound-pressure versus frequency characteristic corresponding to a second audio reproduction environment.
Figure 4D:
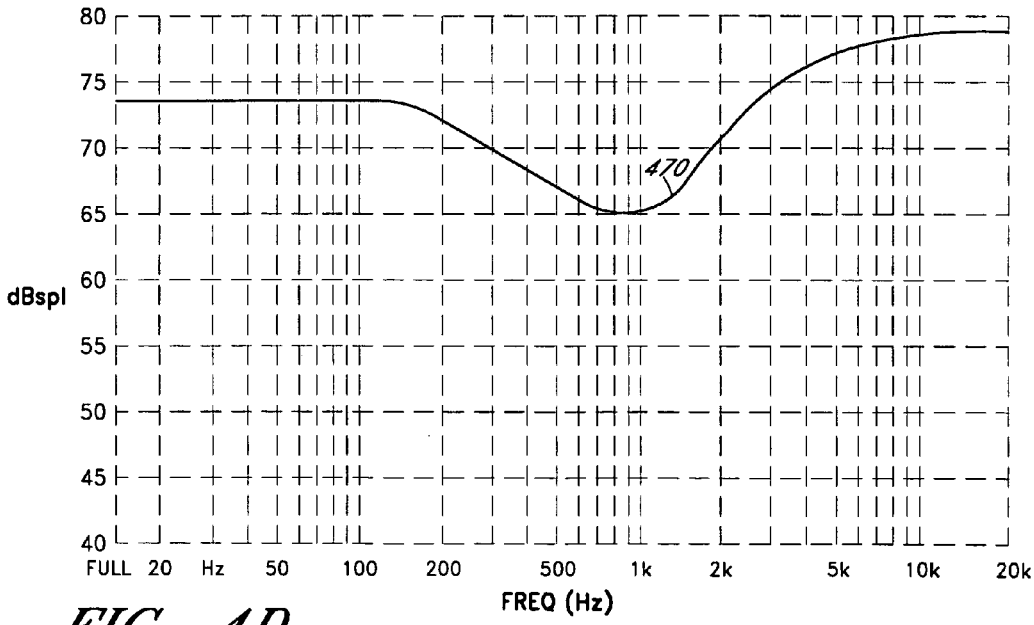
FIG. 4D is a graphical representation of a sound-pressure versus frequency characteristic corresponding to a third audio reproduction environment.

As a result of both spectral and amplitude distortion, a stereo image perceived by the listener 248 is spatially distorted providing an undesirable listening experience. FIGS. 4B–4D graphically depict levels of spatial distortion for various sound reproduction systems and listening environments. The distortion characteristics depicted in FIGS. 4B–4D represent sound pressure levels, measured in decibels, which are present near the ears of a listener.

The frequency response curve 464 of FIG. 4B has a decreasing sound-pressure level at frequencies above approximately 100 Hz. The curve 464 represents a possible sound pressure characteristic generated from loudspeakers, containing both woofers and tweeters, which are mounted below a listener. For example, assuming the loudspeakers 246 of FIG. 2 contain tweeters, an audio signal played through only such loudspeakers 246 might exhibit the response of FIG. 4B.

The particular slope associated with the decreasing curve 464 will vary, and may not be entirely linear, depending on the listening area, the quality of the loudspeakers, and the exact positioning of the loudspeakers within the listening area. For example, a listening environment with relatively hard surfaces will be more reflective of audio signals, particularly at higher frequencies, than a listening environment with relatively soft surfaces (e.g., cloth, carpet, acoustic tile, etc). The level of spectral distortion will vary as loudspeakers are placed further from, and positioned away from, a listener.

FIG. 4C is a graphical representation of a sound-pressure versus frequency characteristic 468 wherein a first frequency range of audio signals are spectrally distorted, but a higher frequency range of the signals are not distorted. The characteristic curve 468 may be achieved from a speaker arrangement having low to mid-frequency loudspeakers placed below a listener and high-frequency loudspeakers positioned near, or at a listener's ear level. The sound image resulting from the characteristic curve 468 will have a low-frequency component positioned below the listener 248 of FIG. 2, and a high-frequency component positioned near the listener's ear level.

FIG. 4D is a graphical representation of a sound-pressure versus frequency characteristic 470 having a reduced sound pressure level among lower frequencies and an increasing sound pressure level among higher frequencies. The characteristic 470 is achieved from a speaker arrangement having mid to low-frequency loudspeakers placed below a listener and high-frequency loudspeakers positioned above a listener. As the curve 470 of FIG. 4D indicates, the sound pressure level at frequencies above 1000 Hz may be significantly higher than lower frequencies, creating an undesirable audio effect for a nearby listener. The sound image resulting from the characteristic curve 470 will have a low-frequency component positioned below the listener 248 of FIG. 2, and a high-frequency component positioned above the listener 248.

The audio characteristics of FIGS. 4B–4D represent various sound pressure levels obtainable in a common listening environment and heard by the listener 248. The audio response curves of FIGS. 4B–4D are but a few examples of how audio signals present at the ears of a listener are distorted by various audio reproduction systems. The exact level of spatial distortion at any given frequency will vary widely depending on the reproduction system and the reproduction environment. The apparent location can be generated for a speaker system defined by apparent elevation and azimuth coordinates, with respect to a fixed listener, which are different from those of actual speaker locations.

Figure 5:
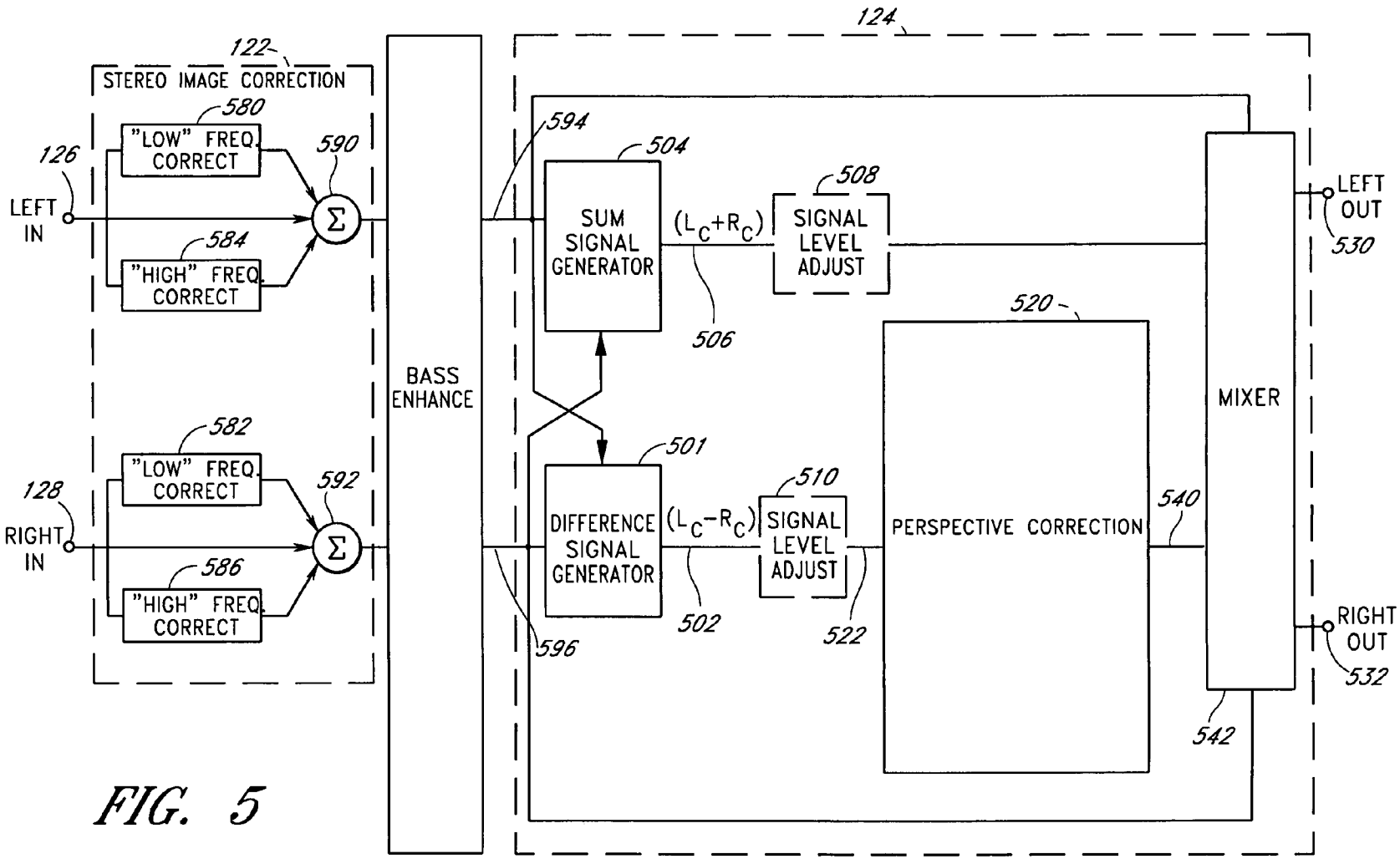
FIG. 5 is a schematic block diagram of an energy-correction system operatively connected to a stereo image enhancement system for creating a realistic stereo image from a pair of input stereo signals.

FIG. 5 is block diagram of a stereo image correction system 122, which inputs the left and right stereo signals 126 and 128. The image-correction system 122 corrects the distorted spectral densities of various sound systems by advantageously dividing the audible frequency spectrum into a first frequency component, containing relatively lower frequencies, and a second frequency component, containing relatively higher frequencies. Each of the left and right signals 126 and 128 is separately processed through corresponding low-frequency correction systems 580, 582, and high-frequency correction systems 584 and 586. It should be pointed out that in one embodiment the correction systems 580 and 582 will operate in a relatively "low" frequency range of approximately 100 to 1000 Hertz, while the correction systems 584 and 586 will operate in a relatively "high" frequency range of approximately 1000 to 10,000 Hertz. This is not to be confused with the general audio terminology wherein low frequencies represent frequencies up to 100 Hertz, mid frequencies represent frequencies between 100 Hz to 4 kHz, and high frequencies represent frequencies above 4 kHz.

By separating the lower and higher frequency components of the input audio signals, corrections in sound pressure level can be made in one frequency range independent of the other. The correction systems 580, 582, 584, and 586 modify the input signals 126 and 128 to correct for spectral and amplitude distortion of the input signals upon reproduction by loudspeakers. The resultant signals, along with the original input signals 126 and 128, are combined at respective summing junctions 590 and 592. The corrected left stereo signal, $L_c$, and the corrected right stereo signal, $R_c$, are provided along outputs to the bass enhancement unit 101.

The corrected stereo signals provided to the bass unit 101 have a flat, i.e., uniform, frequency response appearing at the ears of the listener 248 (shown in FIGS. 2 and 3). This spatially-corrected response creates an apparent source of sound which, when played through the loudspeakers 246 of FIG. 2 or 3, is seemingly positioned directly in front of the listener 248.

Once the sound source is properly positioned through energy correction of the audio signal, the bass enhancement unit 101 corrects for low frequency deficiencies in the loudspeakers 246 and provides bass-corrected left and right channel signals to the stereo enhancement system 124. The stereo enhancement system 124 conditions the stereo signals to broaden (horizontally) the stereo image emanating from the apparent sound source. As will be discussed in conjunction with FIGS. 8A and 8B, the stereo image enhancement system 124 can be adjusted through a stereo orientation device to compensate for the actual location of the sound source.

In one embodiment, the stereo enhancement system 124 equalizes the difference signal information present in the left and right stereo signals.

The left and right signals provided from the bass enhancement unit 101 are inputted by the enhancement system 124 and provided to a difference-signal generator 501 and a sum signal generator 504. A difference signal ($L_c$–$R_c$) representing the stereo content of the corrected left and right input signals, is presented at an output 502 of the difference signal generator 501. A sum signal, ($L_c$+$R_c$) representing the sum of the corrected left and right stereo signals is generated at an output 506 of the sum signal generator 504.

The sum and difference signals at outputs 502 and 506 are provided to optinal level-adjusting devices 508 and 510, respectively. The devices 508 and 510 are typically potentiometers or similar variable-impedance devices. Adjustment of the devices 508 and 510 is typically performed manually to control the base level of sum and difference signal present in the output signals. This allows a user to tailor the level and aspect of stereo enhancement according to the type of sound reproduced, and depending on the user's personal preferences. An increase in the base level of the sum signal emphasizes the audio information at a center stage positioned between a pair of loudspeakers. Conversely, an increase in the base level of difference signal emphasizes the ambient sound information creating the perception of a wider sound image. In some audio arrangements where the music type and system configuration parameters are known, or where manual adjustment is not practical, the adjustment devices 508 and 510 may be eliminated requiring the sum and difference-signal levels to be predetermined and fixed.

Figure 7:
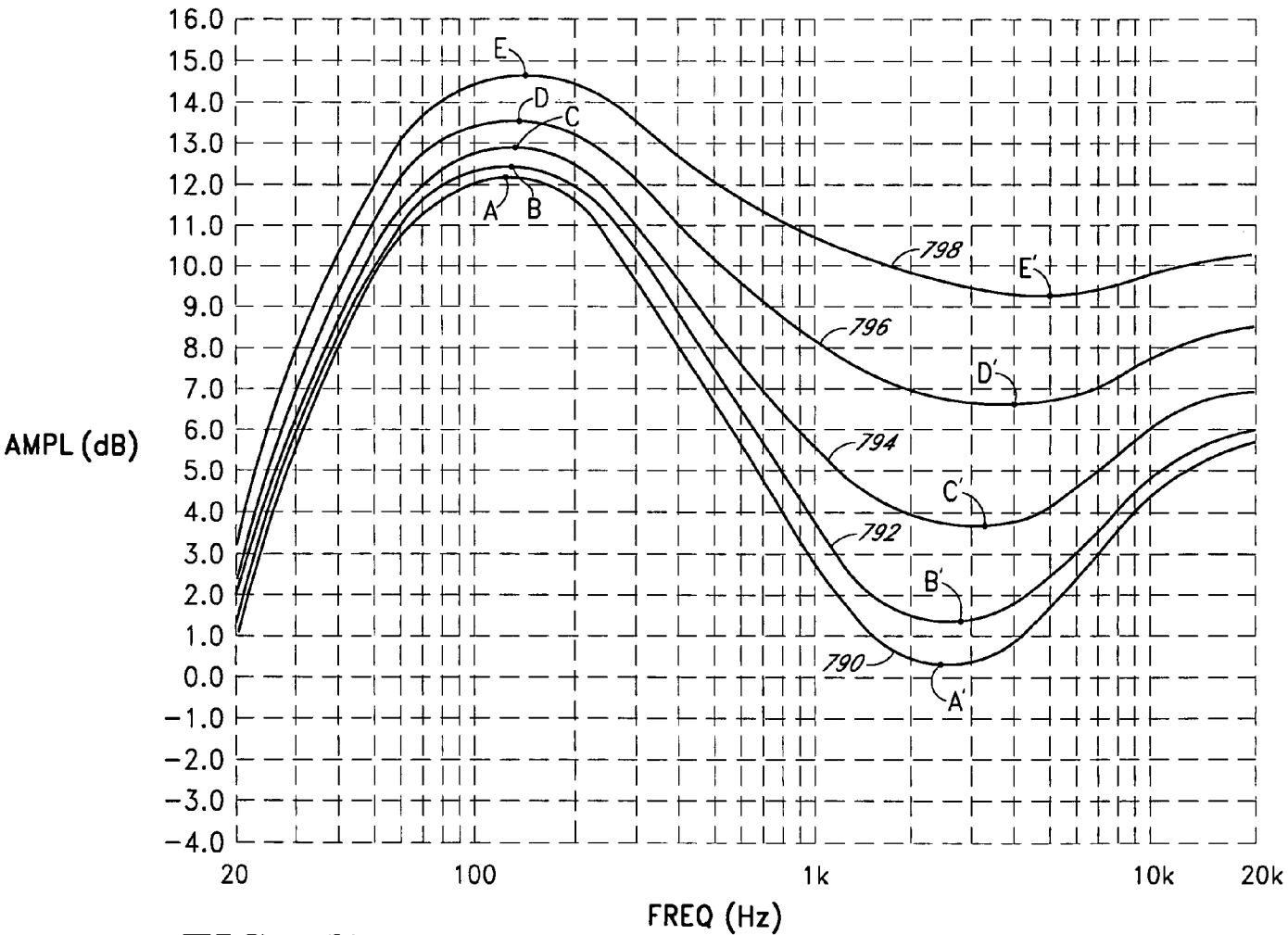
FIG. 7 is a graphical representation of various levels of equalization applied to an audio difference signal to achieve varying amounts of stereo image enhancement.

The output of the device 510 is fed into a stereo enhancement equalizer 520 at an input 522. The equalizer 520 spectrally shapes the difference signal appearing at the input 522 as shown in FIG. 7 below.

The shaped difference signal is provided to a mixer 542, which also receives the sum signal from the device 508. In one embodiment, the stereo signals 594 and 596 are also provided to the mixer 542. All of these signals are combined within the mixer 542 to produce an enhanced and spatially-corrected left output signal 530 and right output signal 532.

Although the input signals 126 and 128 typically represent corrected stereo source signals, they may also be synthetically generated from a monophonic source.

Image Correction Characteristics

Figure 6A:
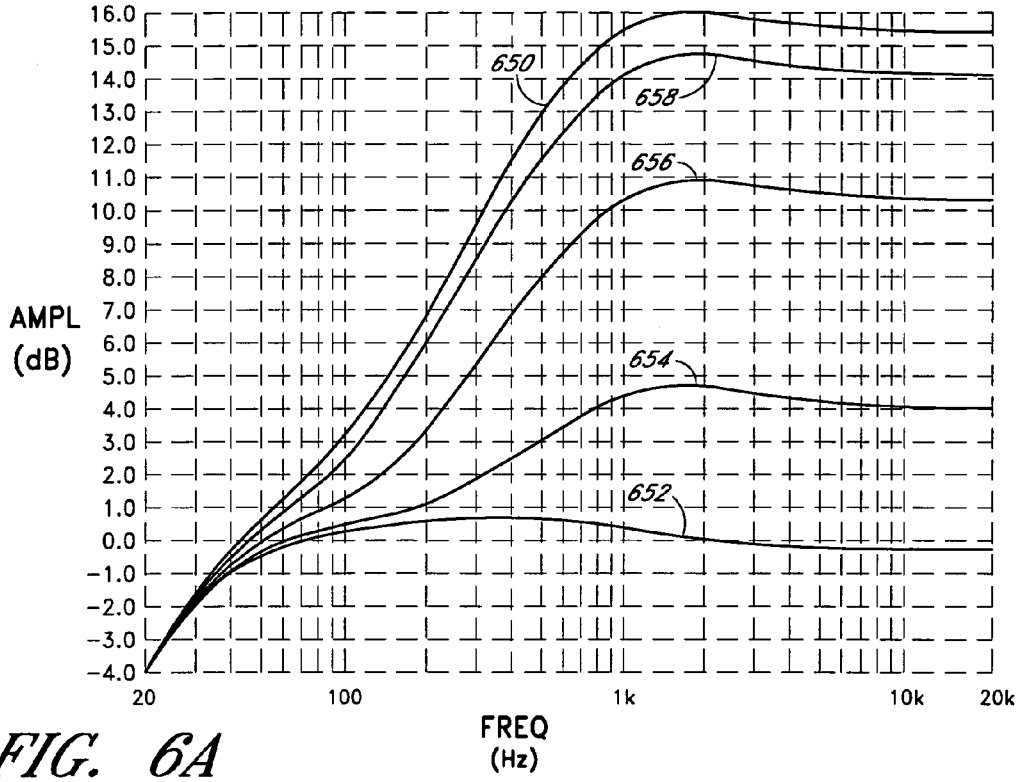
FIG. 6A is a graphical representation of the various levels of signal modification provided by a low-frequency correction system in accordance with one embodiment.
Figure 6B:
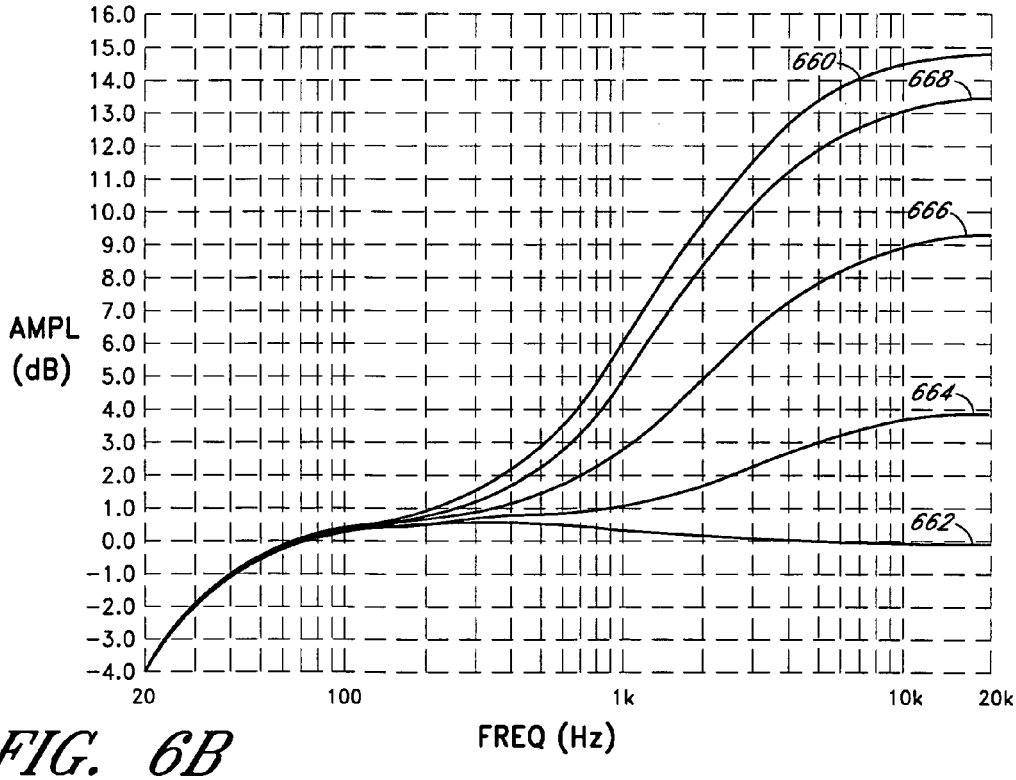
FIG. 6B a graphical representation of the various levels of signal modification provided by a high-frequency correction system for boosting high-frequency components of an audio signal in accordance with one embodiment.
Figure 6C:
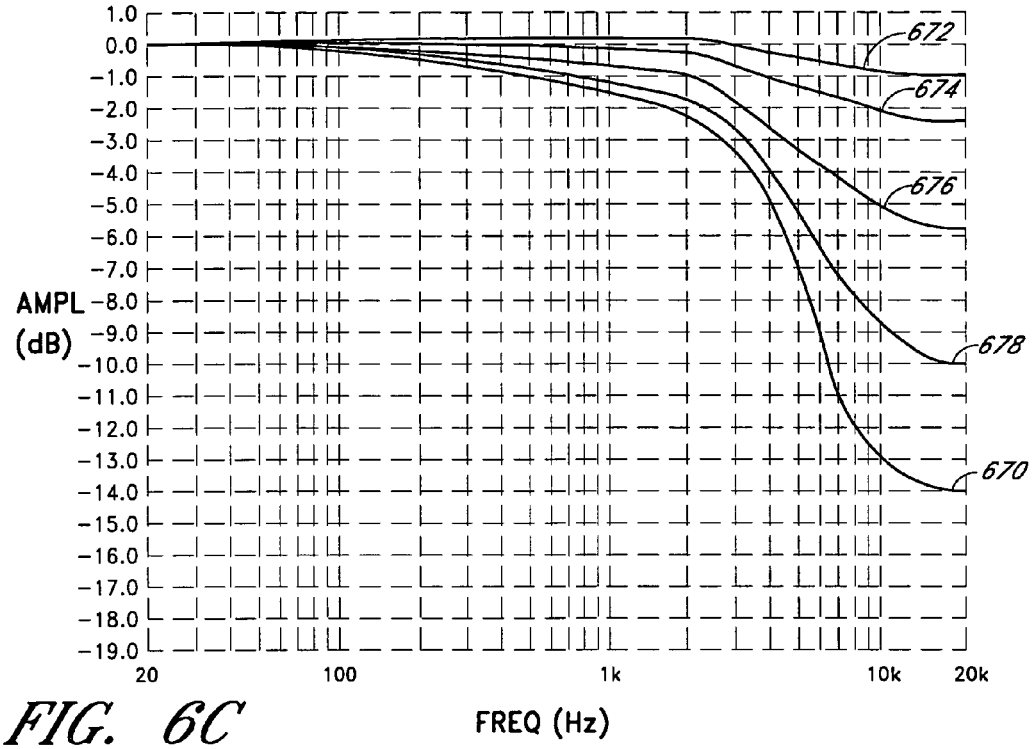
FIG. 6C is a graphical representation of the various levels of signal modification provided by a high-frequency correction system for attenuating high-frequency components of an audio signal in accordance with one embodiment.

FIGS. 6A–6C are graphical representations of the levels of spatial correction provided by "low" and "high"-frequency correction systems 580, 582, 584, 586 in order to obtain a relocated image generated from a pair of stereo signals.

Referring initially to FIG. 6A, possible levels of spatial correction provided by the correction systems 580 and 582 are depicted as curves having different amplitude-versus-frequency characteristics. The maximum level of correction, or boost (measured in dB), provided by the systems 580 and 582 is represented by a correction curve 650. The curve 650 provides an increasing level of boost within a first frequency range of approximately 100 Hz and 1000 Hz. At frequencies above 1000 Hz, the level of boost is maintained at a fairly constant level. A curve 652 represents a near-zero level of correction.

To those skilled in the art, a typical filter is usually characterized by a pass-band and stop-band of frequencies separated by a cutoff frequency. The correction curves, of FIGS. 6A–6C, although representative of typical signal filters, can be characterized by a pass-band, a stop-band, and a transition band. A filter constructed in accordance with the characteristics of FIG. 6A has a pass-band above approximately 1000 Hz, a transition-band between approximately 100 and 1000 Hz, and a stop-band below approximately 100 Hz. Filters according to FIG. 6B have pass-bands above approximately 10 kHz, transition-bands between approximately 1 kHz and 10 kHz, and a stop-band below approximately 1 kHz. Filters according to FIG. 6C have a stop-band approximately 10 kHz, transition-bands between approximately 1 kHz and 10 kHz, and pass-bands below approximately 1 kHz. In one embodiment the filters are first-order filters.

As can be seen in FIGS. 6A–6C, spatial correction of an audio signal by the systems 580, 582, 584, and 586 is substantially uniform within the pass-bands, but is largely frequency-dependent within the transition bands. The amount of acoustic correction applied to an audio signal can be varied as a function of frequency through adjustment of the stereo image correction system 122 which varies the slope of the transition bands of FIGS. 6A–6C. As a result, frequency-dependent correction is applied to a first frequency range between 100 and 1000 hertz, and applied to a second frequency range of 1000 to 10,000 hertz. An infinite number of correction curves are possible through independent adjustment of the correction systems 580, 582, 584 and 586.

In accordance with one embodiment, spatial correction of the higher frequency stereo-signal components occurs between approximately 1000 Hz and 10,000 Hz. Energy correction of these signal components may be positive, i.e., boosted, as depicted in FIG. 6B, or negative, i.e., attenuated, as depicted in FIG. 6C. The range of boost provided by the correction systems 584, 586 is characterized by a maximum-boost curve 660 and a minimum-boost curve 662. Curves 664, 666, and 668 represent still other levels of boost, which may be required to spatially correct sound emanating from different sound reproduction systems. FIG. 6C depicts energy-correction curves that are essentially the inverse of those in FIG. 6B.

Figure 6D:
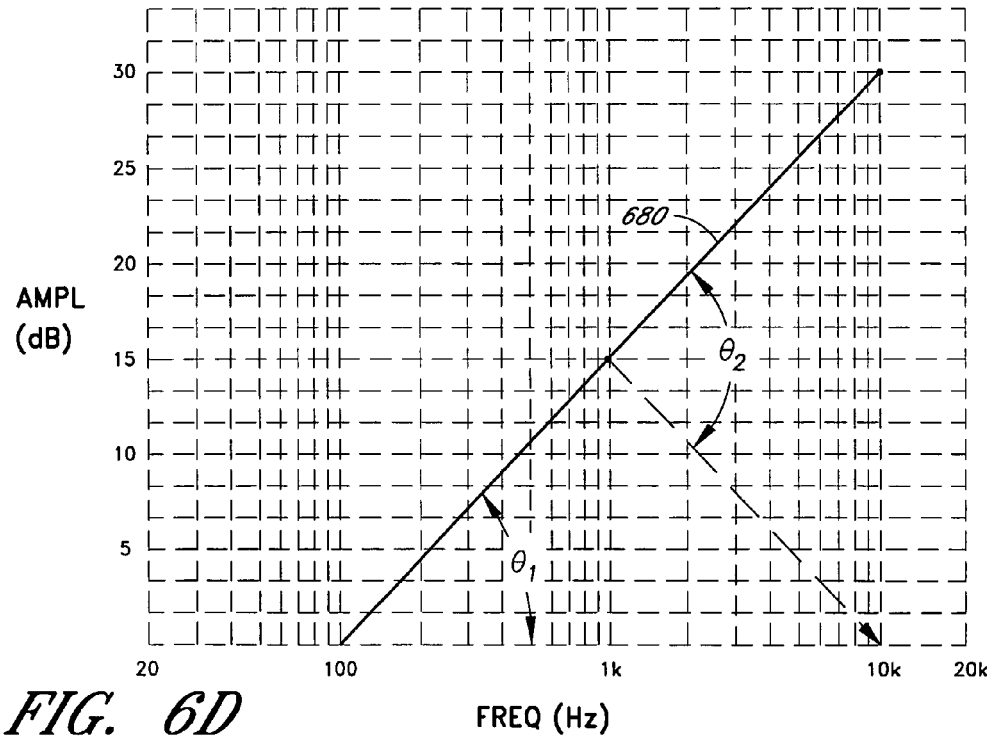
FIG. 6D is a graphical representation of a composite energy-correction curve depicting the possible ranges of sound-pressure correction for relocating a stereo image.

Since the lower frequency and higher frequency correction factors, represented by the curves of FIGS. 6A–6C, are added together, there is a wide range of possible spatial correction curves applicable between the frequencies of 100 to 10,000 Hz. FIG. 6D is a graphical representation depicting a range of composite spatial correction characteristics provided by the stereo image correction system 122. Specifically, the solid line curve 680 represents a maximum level of spatial correction comprised of the curve 650 (shown in FIG. 6A) and the curve 660 (shown in FIG. 6B). Correction of the lower frequencies may vary from the solid curve 680 through the range designated by $\theta_1$. Similarly, correction of the higher frequencies may vary from the solid curve 680 through the range designated by $\theta_2$. Accordingly, the amount of boost applied to the first frequency range of 100 to 1000 Hertz varies between approximately 0 and 15 dB, while the correction applied to the second frequency range of 1000 to 10,000 Hertz may vary from approximately 13 dB to −15 dB.

Image Enhancement Characteristics

Turning now to the stereo image enhancement aspect of the present invention, a series of perspective-enhancement, or normalization curves, is graphically represented in FIG. 7. The signal $(L_c-R_c)_p$ above represents the processed difference signal which has been spectrally shaped according to the frequency-response characteristics of FIG. 7. These frequency-response characteristics are applied by the equalizer 520 depicted in FIG. 5 and are partially based upon HRTF principles.

In general, selective amplification of the difference signal enhances any ambient or reverberant sound effects which may be present in the difference signal but which are masked by more intense direct-field sounds. These ambient sounds are readily perceived in a live sound stage at the appropriate level. In a recorded performance, however, the ambient sounds are attenuated relative to a live performance. By boosting the level of difference signal derived from a pair of stereo left and right signals, a projected sound image can be broadened significantly when the image emanates from a pair of loudspeakers placed in front of a listener.

The perspective curves 790, 792, 794, 796, and 798 of FIG. 7 are displayed as a function of gain against audible frequencies displayed in log format. The different levels of equalization between the curves of FIG. 7 are required to account for various audio reproduction systems. In one embodiment, the level of difference-signal equalization is a function of the actual placement of loudspeakers relative to a listener within an audio reproduction system. The curves 790, 792, 794, 796, and 798 generally display a frequency contouring characteristic wherein lower and higher difference-signal frequencies are boosted relative to a mid-band of frequencies.

According to one embodiment, the range for the perspective curves of FIG. 7 is defined by a maximum gain of approximately 10–15 dB located at approximately 125 to 150 Hz. The maximum gain values denote a turning point for the curves of FIG. 7 whereby the slopes of the curves 790, 792, 794, 796, and 798 change from a positive value to a negative value. Such turning points are labeled as points A, B, C, D, and E in FIG. 7. The gain of the perspective curves decreases below 125 Hz at a rate of approximately 6 dB per octave. Above 125 Hz, the gain of the curves of FIG. 7 also decreases, but at variable rates, towards a minimum-gain turning point of approximately −2 to +10 dB. The minimum-gain turning points vary significantly between the curves 790, 792, 794, 796, and 798. The minimum-gain turning points are labeled as points A', B', C', D', and E', respectively. The frequencies at which the minimum-gain turning points occur varies from approximately 2.1 kHz for curve 790 to approximately 5 kHz for curve 798. The gain of the curves 790, 792, 794, 796, and 798 increases above their respective minimum-gain frequencies up to approximately 10 kHz. Above 10 kHz, the gain applied by the perspective curves begins to level off. An increase in gain will continue to be applied by all of the curves, however, up to approximately 20 kHz, i.e., approximately the highest frequency audible to the human ear.

The preceding gain and frequency figures are merely design objectives and the actual figures will likely vary from system to system. Moreover, adjustment of the signal level devices 508 and 510 will affect the maximum and minimum gain values, as well as the gain separation between the maximum-gain frequency and the minimum-gain frequency.

Equalization of the difference signal in accordance with the curves of FIG. 7 is intended to boost the difference signal components of statistically lower intensity without overemphasizing the higher-intensity difference signal components. The higher-intensity difference signal components of a typical stereo signal are found in a mid-range of frequencies between approximately 1 to 4 kHz. The human ear has a heightened sensitivity to these same mid-range of frequencies. Accordingly, the enhanced left and right output signals 530 and 532 produce a much improved audio effect because ambient sounds are selectively emphasized to fully encompass a listener within a reproduced sound stage.

As can be seen in FIG. 7, difference signal frequencies below 125 Hz receive a decreased amount of boost, if any, through the application of the perspective curve. This decrease is intended to avoid over-amplification of very low, i.e., bass, frequencies. With many audio reproduction systems, amplifying an audio difference signal in this low-frequency range can create an unpleasurable and unrealistic sound image having too much bass response. Examples of such audio reproduction systems include near-field or low-power audio systems, such as multimedia computer systems, as well as home stereo systems. A large draw of power in these systems may cause amplifier "clipping" during periods of high boost, or it may damage components of the audio system including the loudspeakers. Limiting the bass response of the difference signal also helps avoid these problems in most near-field audio enhancement applications.

Figure 8A:
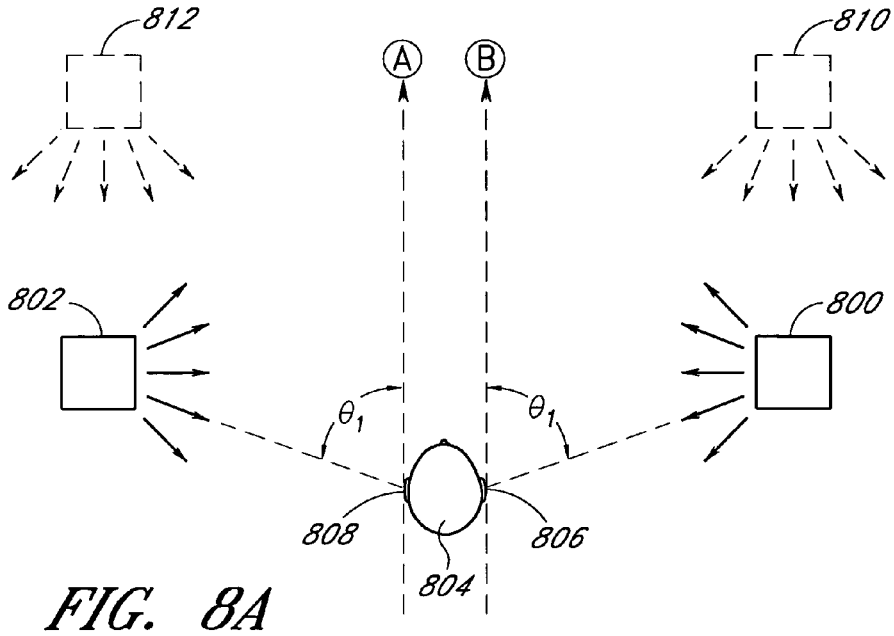
FIG. 8A is a diagram depicting the perceived and actual origins of sounds heard by a listener from loudspeakers placed at a first location.
Figure 8B:
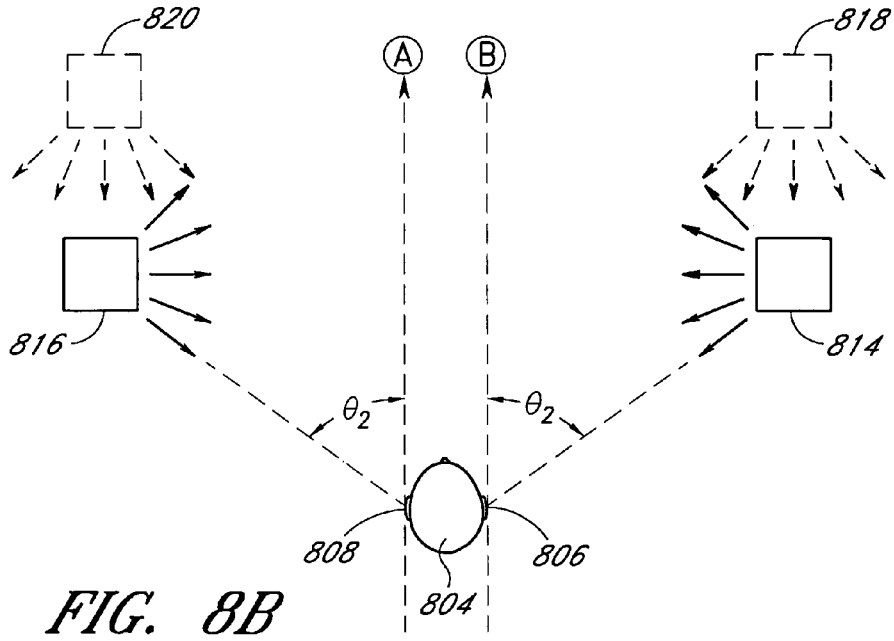
FIG. 8B is a diagram depicting the perceived and actual origins of sounds heard by a listener from loudspeakers placed at a second location.

In accordance with one embodiment, the level of difference signal equalization in an audio environment having a stationary listener is dependent upon the actual speaker types and their locations with respect to the listener. The acoustic principles underlying this determination can best be described in conjunction with FIGS. 8A and 8B. FIGS. 8A and 8B are intended to show such acoustic principles with respect to changes in azimuth of a speaker system.

FIG. 8A depicts a top view of a sound reproduction environment having loudspeakers 800 and 802 placed slightly forward of, and pointed towards, the sides of a listener 804. The loudspeakers 800 and 802 are also placed below the listener 804 at a elevational position similar to that of the loudspeakers 246 shown in FIG. 2. Reference planes A and B are aligned with ears 806, 808 of the listener 804. The planes A and B are parallel to the listener's line-of-sight as shown.

The location of the loudspeakers preferably correspond to the locations of the loudspeakers 810 and 812. In one embodiment, when the loudspeakers cannot be located in a desired position, enhancement of the apparent sound image can be accomplished by selectively equalizing the difference signal, i.e., the gain of the difference signal will vary with frequency. The curve 790 of FIG. 7 represents the desired level of difference-signal equalization with actual speaker locations corresponding to the phantom loudspeakers 810 and 812.

Bass Enhancement

The present invention also provides a method and system for enhancing audio signals. The sound enhancement system improves the realism of sound with a unique sound enhancement process. Generally speaking, the sound enhancement process receives two input signals, a left input signal and a right input signal, and in turn, generates two enhanced output signals, a left output signal and a right output signal.

The left and right input signals are processed collectively to provide a pair of left and right output signals. In particular, the enhanced system embodiment equalizes the differences that exist between the two input signals in a manner which broadens and enhances the perceived bandwidth of the sounds. In addition, many embodiments adjust the level of the sound that is common to both input signals so as to reduce clipping. Advantageously, some embodiments achieve sound enhancement with simplified, low cost, and easy-to-manufacture analog systems that do not require digital signal processing.

Although the embodiments are described herein with reference to one sound enhancement systems, the invention is not so limited, and can be used in a variety of other contexts in which it is desirable to adapt different embodiments of the sound enhancement system to different situations.

Figure 9:
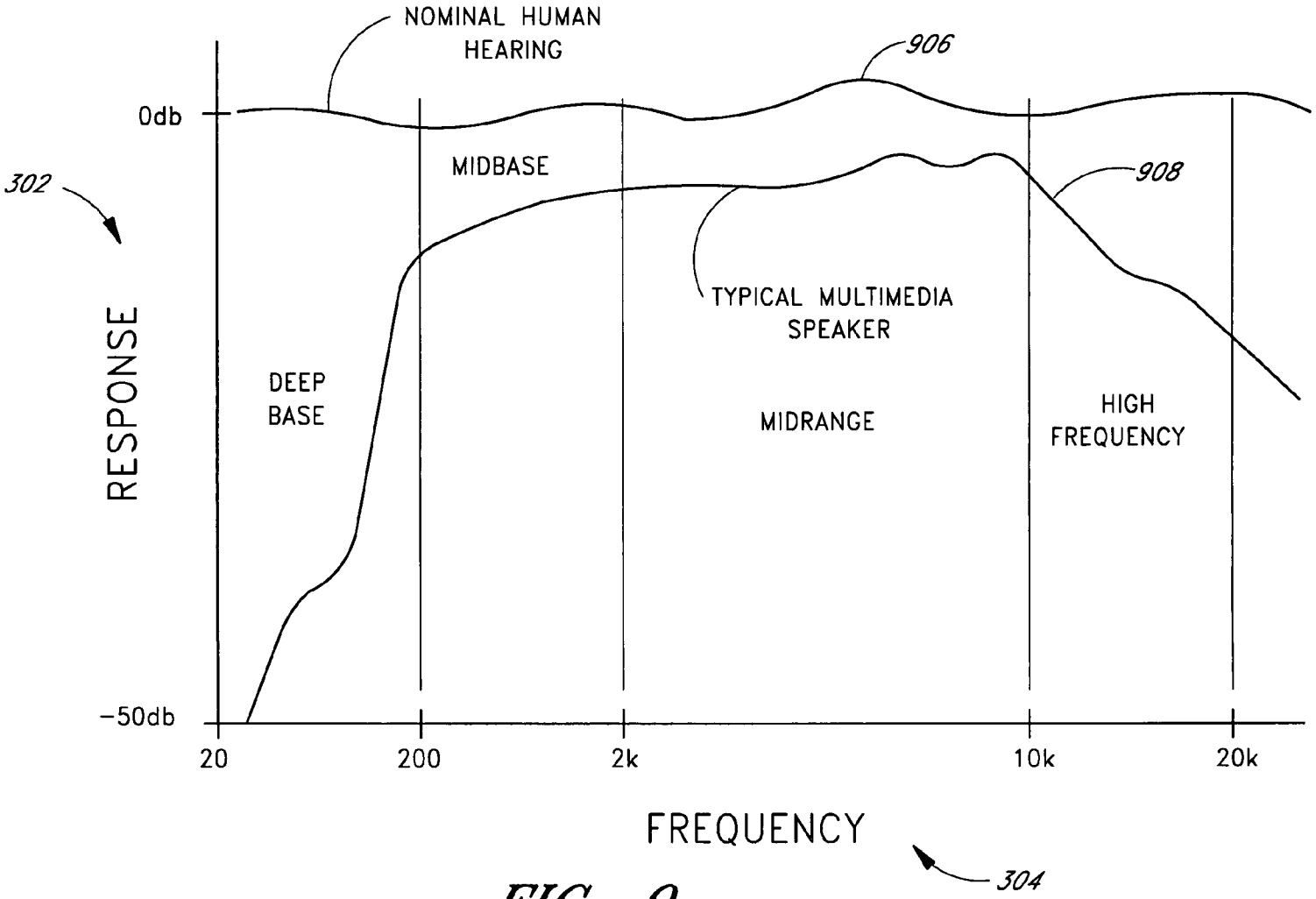
FIG. 9 is a plot of the frequency response of a typical small loudspeaker system.

A typical small loudspeaker system used for multimedia computers, automobiles, small stereophonic systems, portable stereophonic systems, headphones, and the like, will have an acoustic output response that rolls off at about 150 Hz. FIG. 9 shows a curve 906 corresponding approximately to the frequency response of the human ear. FIG. 9 also shows the measured response 908 of a typical small computer loudspeaker system that uses a high-frequency driver (tweeter) to reproduce the high frequencies, and a four inch midrange-bass driver (woofer) to reproduce the midrange and bass frequencies. Such a system employing two drivers is often called a two-way system. Loudspeaker systems employing more than two drivers are known in the art and will work with an embodiment of the present invention. Loudspeaker systems with a single driver are also known and will also work with the present invention. The response 908 is plotted on a rectangular plot with an X-axis showing frequencies from 20 Hz to 20 kHz. This frequency band corresponds to the range of normal human hearing. The Y-axis in FIG. 9 shows normalized amplitude response from 0 dB to −50 dB. The curve 908 is relatively flat in a midrange frequency band from approximately 2 kHz to 10 kHz, showing some rolloff above 10 kHz. In the low frequency ranges, the curve 908 exhibits a low-frequency rolloff that begins in a midbass band between approximately 150 Hz and 2 kHz such that below 150 Hz, the loudspeaker system produces very little acoustic output.

The location of the frequency bands shown in FIG. 9 are used by way of example and not by way of limitation. The actual frequency ranges of the deep bass band, midbass band, and midrange band vary according to the loudspeaker and the application for which the loudspeaker is used. The term deep bass is used, generally, to refer to frequencies in a band where the loudspeaker produces an output that is less accurate as compared to the loudspeaker output at higher frequencies, such as, for example, in the midbass band. The term midbass band is used, generally, to refer to frequencies above the deep bass band. The term midrange is used, generally, to refer to frequencies above the midbass band.

Many cone-type drivers are very inefficient when producing acoustic energy at low frequencies where the diameter of the cone is less than the wavelength of the acoustic sound wave. When the cone diameter is smaller than the wavelength, maintaining a uniform sound pressure level of acoustic output from the cone requires that the cone excursion be increased by a factor of four for each octave (factor of 2) that the frequency drops. The maximum allowable cone excursion of the driver is quickly reached if one attempts to improve low-frequency response by simply boosting the electrical power supplied to the driver.

Thus, the low-frequency output of a driver cannot be increased beyond a certain limit, and this explains the poor low-frequency sound quality of most small loudspeaker systems. The curve 908 is typical of most small loudspeaker systems that employ a low-frequency driver of approximately four inches in diameter. Loudspeaker systems with larger drivers will tend to produce appreciable acoustic output down to frequencies somewhat lower than those shown in the curve 908, and systems with smaller low-frequency drivers will typically not produce output as low as that shown in the curve 908.

As discussed above, to date, a system designer has had little choice when designing loudspeaker systems with extended low-frequency response. Previously known solutions were expensive and produced loudspeakers that were too large for the desktop. One popular solution to the low-frequency problem is the use of a sub-woofer, which is usually placed on the floor near the computer system. Sub-woofers can provide adequate low-frequency output, but they are expensive, and thus relatively uncommon as compared to inexpensive desktop loudspeakers.

Rather than use drivers with large diameter cones, or a sub-woofer, an embodiment of the present invention overcomes the low-frequency limitations of small systems by using characteristics of the human hearing system to produce the perception of low-frequency acoustic energy, even when such energy is not produced by the loudspeaker system.

The human auditory system is known to be non-linear. A non-linear system is, simply put, a system where an increase in the input is not followed by a proportional increase in the output. Thus, for example, in the ear, a doubling of the acoustic sound pressure level does not produce a perception that the volume of the sound source has been doubled. In fact, the human ear is, to a first approximation, a square-law device that is responsive to power rather than intensity of the acoustic energy. This non-linearity of the hearing mechanism produces intermodulation frequencies that are heard as overtones or harmonics of the actual frequencies in the acoustic wave.

Figure 10:
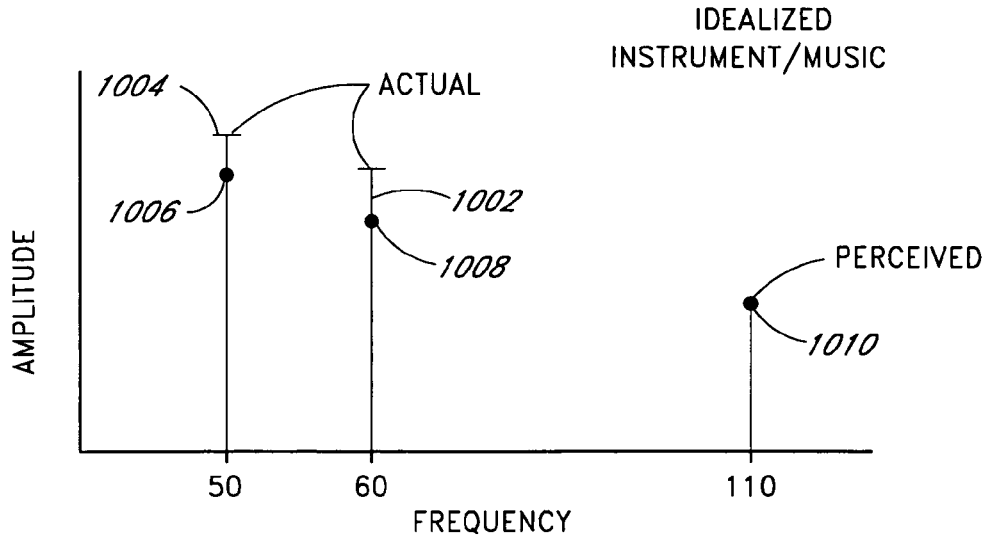
FIG. 10 illustrates the actual and perceived spectrum of a signal represented by two discrete frequencies.

The intermodulation effect of the non-linearities in the human ear is shown in FIG. 10, which illustrates an idealized amplitude spectrum of two pure tones. The spectral diagram in FIG. 10 shows a first spectral line 1004 which corresponds to acoustic energy produced by a loudspeaker driver (e.g., a sub-woofer) at 50 Hz. A second spectral line 1002 is shown at 60 Hz. The lines 1004 and 1002 are actual spectral lines corresponding to real acoustic energy produced by the driver, and no other acoustic energy is assumed to exist. Nevertheless, the human ear, because of its inherent non-linearities, will produce intermodulation products corresponding to the sum of the two actual spectral frequencies and the difference between the two spectral frequencies.

For example, a person listening to the acoustic energy represented by the spectral lines 1004 and 1002 will perceive acoustic energy at 50 Hz, as shown by the spectral line 1006, at 60 Hz, as shown by the spectral line 1008, and at 110 Hz, as shown by the spectra line 1010. The spectral line 1010 does not correspond to real acoustic energy produced by the loudspeaker, but rather corresponds to a spectral line created inside the ear by the non-linearities of the ear. The line 1010 occurs at a frequency of 110 Hz which is the sum of the two actual spectral lines (110 Hz=50 Hz+60 Hz). Note that the non-linearities of the ear will also create a spectral line at the difference frequency of 10 Hz (10 Hz=60 Hz−50 Hz), but that line is not perceived because it is below the range of human hearing.

Figure 11:
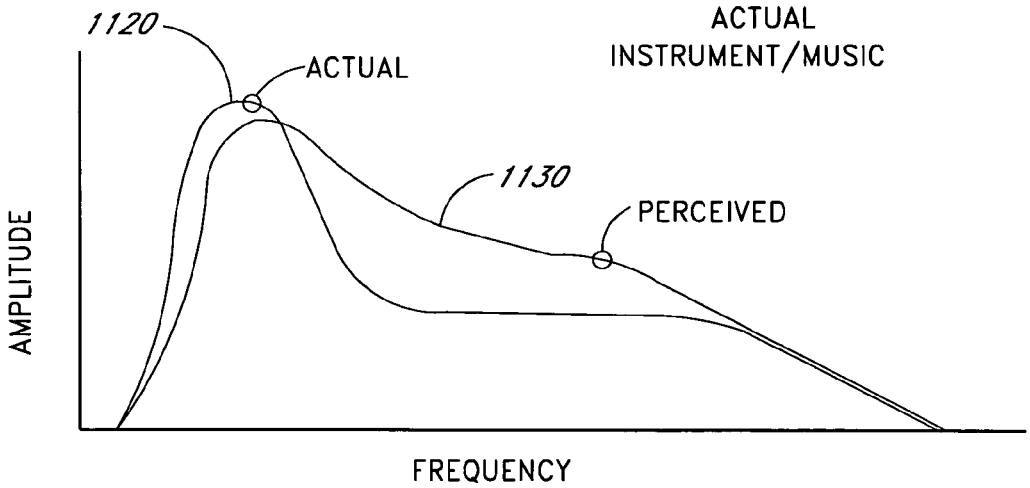
FIG. 11 illustrates the actual and perceived spectrum of a signal represented by a continuous spectrum of frequencies.

FIG. 10 illustrates the process of intermodulation inside the human ear, but it is somewhat simplified when compared to real program material, such as music. Typical program material such as music is rich in harmonics, so much so that most music exhibits an almost continuous spectrum, as shown in FIG. 11. FIG. 11 shows the same type of comparison between actual and perceived acoustic energy, as shown in FIG. 10, except that the curves in FIG. 11 are shown for continuous spectra. FIG. 11 shows an actual acoustic energy curve 1120 and the corresponding perceived spectrum 1130.

As with most non-linear systems, the non-linearity of the ear is more pronounced when the system is making large excursions (e.g., large signal levels) than for small excursions. Thus, for the human ear, the non-linearities are more pronounced at low frequencies, where the eardrum and other elements of the ear make relatively large mechanical excursions, even at lower volume levels. Thus, FIG. 11 shows that the difference between actual acoustic energy 1120, and the perceived acoustic energy 1130 tends to be greatest in the lower-frequency range and becomes relatively smaller at the higher-frequency range.

As shown in FIGS. 10 and 11, low-frequency acoustic energy comprising multiple tones or frequencies will produce, in the listener, the perception that the acoustic energy in the midbass range contains more spectral content than actually exists. The human brain, when faced with a situation where information is thought to be missing, will attempt to "fill in" missing information on a subconscious level. This filling in phenomenon is the basis for many optical illusions. In an embodiment of the present invention, the brain can be tricked into filling in low-frequency information that is not really present by providing the brain with the midbass effects of such low-frequency information.

In other words, if the brain is presented with the harmonics that would be produced by the ear if the low-frequency acoustic energy was present (e.g., the spectral line 1010) then under the right conditions, the brain will subconsciously fill in the low-frequency spectral lines 1006 and 1008 which it thinks "must" be present. This filling in process is augmented by another effect of the non-linearity of the human ear known as the detector effect.

Figure 12B:
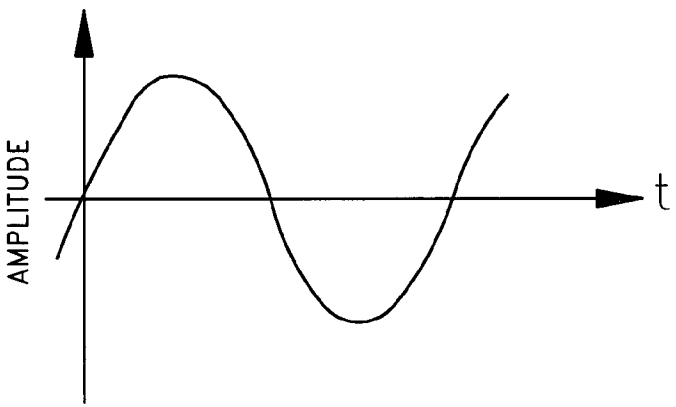
FIG. 12B illustrates the time waveform of FIG. 12A after detection by a detector.
Figure 12A:
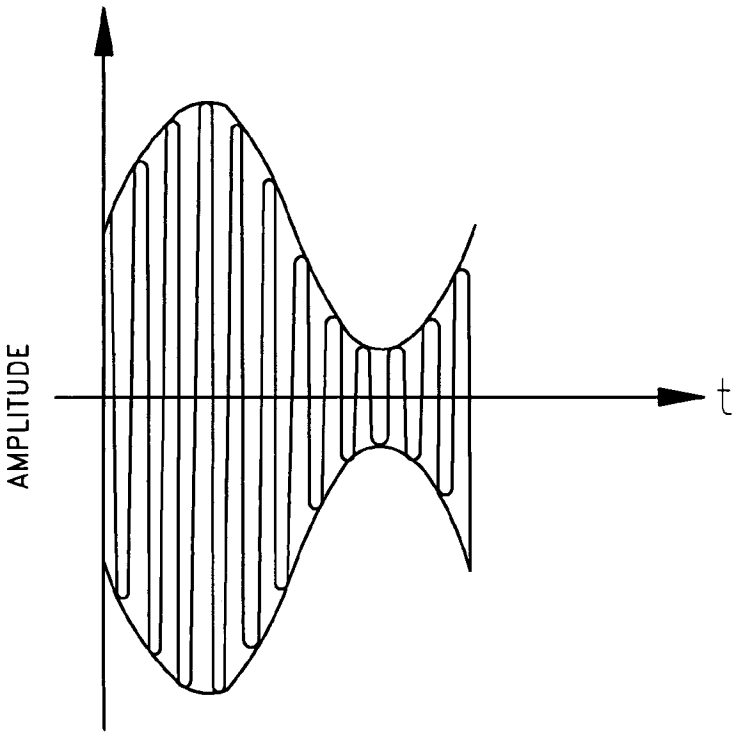
FIG. 12A illustrates a time waveform of a modulated carrier.

The non-linearity of the human ear also causes the ear to act like a detector, similar to a diode detector in an Amplitude Modulation (AM) receiver. If a midbass harmonic tone is AM modulated by a deep bass tone, the ear will demodulate the modulated midbass carrier to reproduce the deep bass envelope. FIGS. 12A and 12B graphically illustrate the modulated and demodulated signal. FIG. 12A shows, on a time axis, a modulated signal comprising a higher-frequency carrier signal (e.g. the midbass carrier) modulated by a deep bass signal.

The amplitude of the higher-frequency signal is modulated by a lower frequency tone, and thus, the amplitude of the higher-frequency signal varies according to the frequency of the lower frequency tone. The non-linearity of the ear will partially demodulate the signal such that the ear will detect the low-frequency envelope of the higher-frequency signal, and thus produce the perception of the low-frequency tone, even though no actual acoustic energy was produced at the lower frequency. As with the intermodulation effect discussed above, the detector effect can be enhanced by proper signal processing of the signals in the midbass frequency range. By using the proper signal processing, it is possible to design a sound enhancement system that produces the perception of low-frequency acoustic energy, even when using loudspeakers that are incapable of, or inefficient at, producing such energy.

The perception of the actual frequencies present in the acoustic energy produced by the loudspeaker may be deemed a first order effect. The perception of additional harmonics not present in the actual acoustic frequencies, whether such harmonics are produced by intermodulation distortion or detection, may be deemed a second order effect.

Bass Enhancement Expander

Figure 13A:
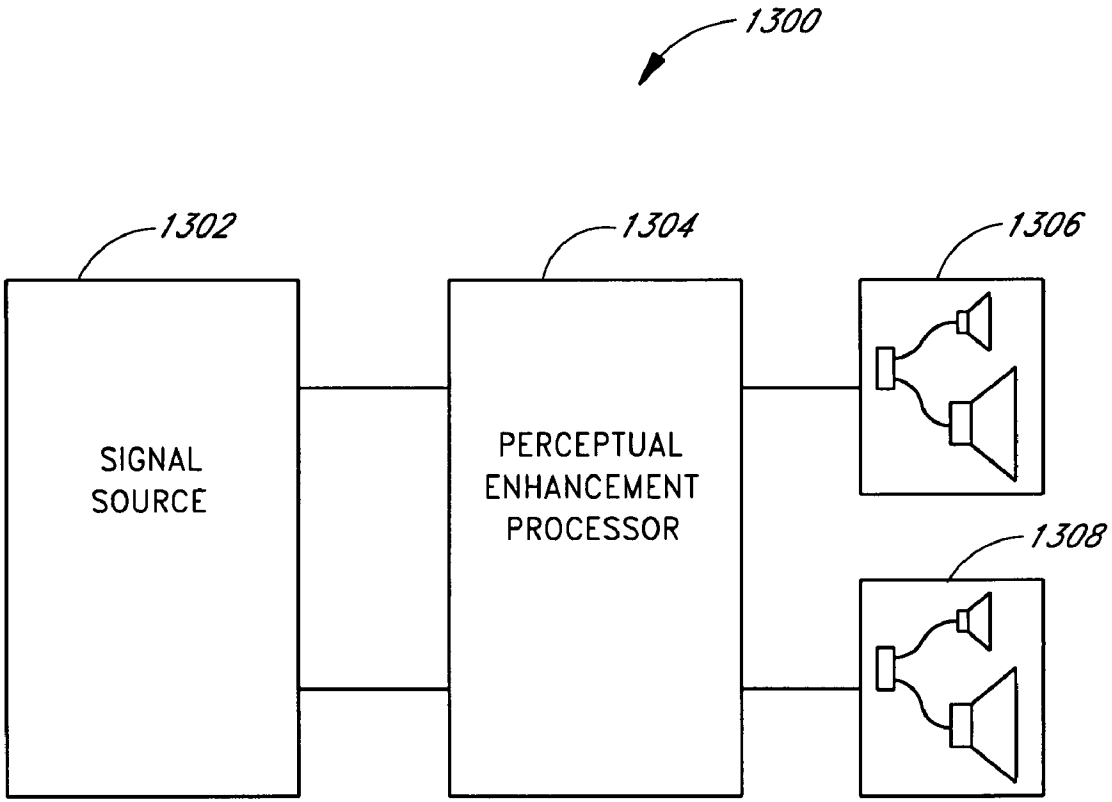
FIG. 13A is a block diagram of a sound system with bass enhancement processing.

FIG. 13A is a block diagram of a sound system wherein the sound enhancement function is provided by a bass enhancement unit 1304. The bass enhancement unit 1304 receives audio signals from a signal source 1302. The signal source 1302 may be any signal source, including the signal processing block 122 shown in FIG. 1. The bass enhancement unit 1304 performs signal processing to modify the received audio signals to produce audio output signals. The audio output signals may be provided to loudspeakers, amplifiers, or other signal processing devices.

Figure 13B:
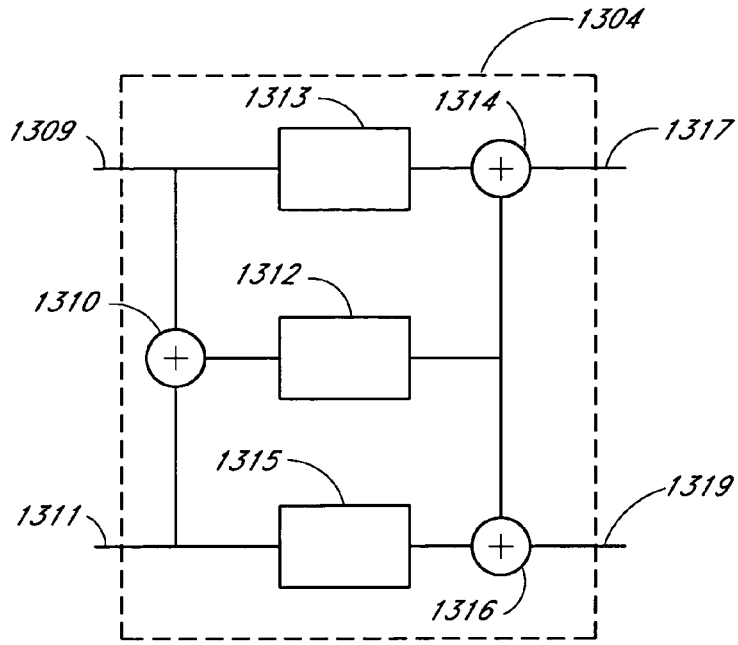
FIG. 13B is a block diagram of a bass enhancement processor that combines multiple channels into a single bass channel.

FIG. 13B is a block diagram of a topology for a two-channel bass enhancement unit 1304 having a first input 1309, a second input 1311, a first output 1317 and a second output 1319. The first input 1309 and first output 1317 correspond to a first channel. The second input 1311 and second output 1319 correspond to a second channel. The first input 1309 is provided to a first input of a combiner 1310 and to an input of a signal processing block 1313. An output of the signal processing block 1313 is provided to a first input of a combiner 1314. The second input 1311 is provided to a second input of the combiner 1310 and to an input of a signal processing block 1315. An output of the signal processing block 1315 is provided to a first input of a combiner 1316. An output of the combiner 1310 is provided to an input of a signal processing block 1312. An output of the signal processing block 1312 is provided to a second input of the combiner 1314 and to a second input of the combiner 1316. An output of the combiner 1314 is provided to the first output 1317. An output of the second combiner 1316 is provided to the second output 1319.

Signals from the first and second inputs 1309 and 1311 are combined and processed by the signal processing block 1312. The output of the signal processing block 1312 is a signal, that when combined with the outputs of the signal processing blocks 1313 and 1315, respectively, produces the bass enhanced outputs 1317 and 1319.

Figure 13C:
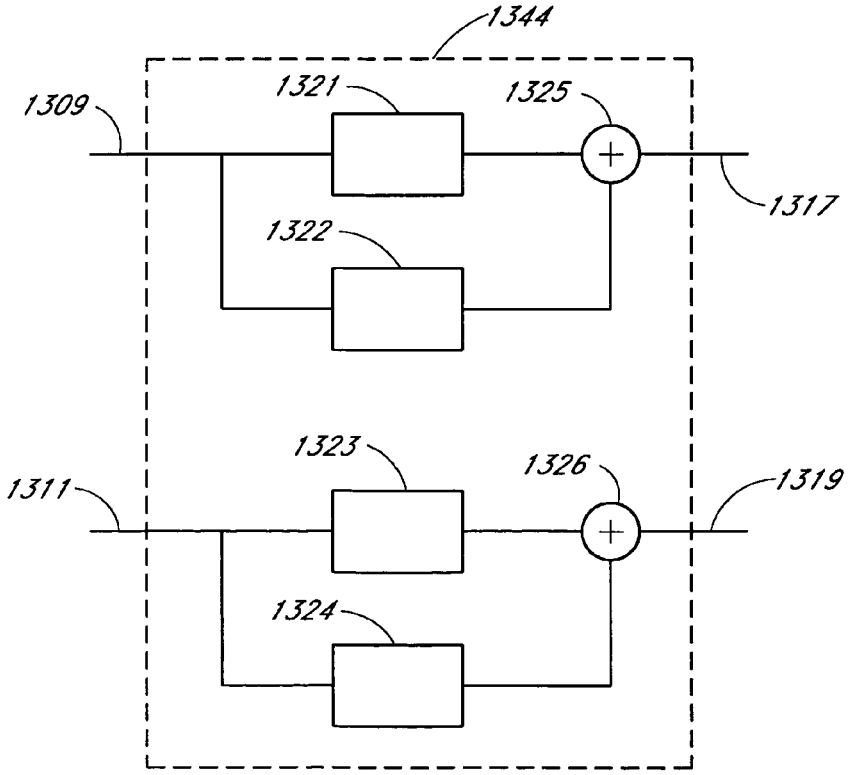
FIG. 13C is a block diagram of a bass enhancement processor that processes multiple channels separately.

FIG. 13C is a block diagram of another topology for a two-channel bass enhancement unit 1344. In FIG. 13C, the first input 1309 is provided to an input of a signal processing block 1321 and to an input of a signal processing block 1322. An output of the signal processing block 1321 is provided to a first input of a combiner 1325 and an output of the signal processing block 1322 is provided to a second input of the combiner 1325. The second input 1311 is provided to an input of a signal processing block 1323 and to an input of a signal processing block 1324. An output of the signal processing block 1323 is provided to a first input of a combiner 1326 and an output of the signal processing block 1324 is provided to a second input of the combiner 1326. An output of the combiner 1325 is provided to the first output 1317 and an output of the second combiner 1326 is provided to the second output 1319.

Unlike the topology shown in FIG. 13B, the topology shown in FIG. 13C does not combine the two input signals 1309 and 1311, but, rather, the two channels are kept separate, and the bass enhancement processing is performed on each channel.

Figure 14:
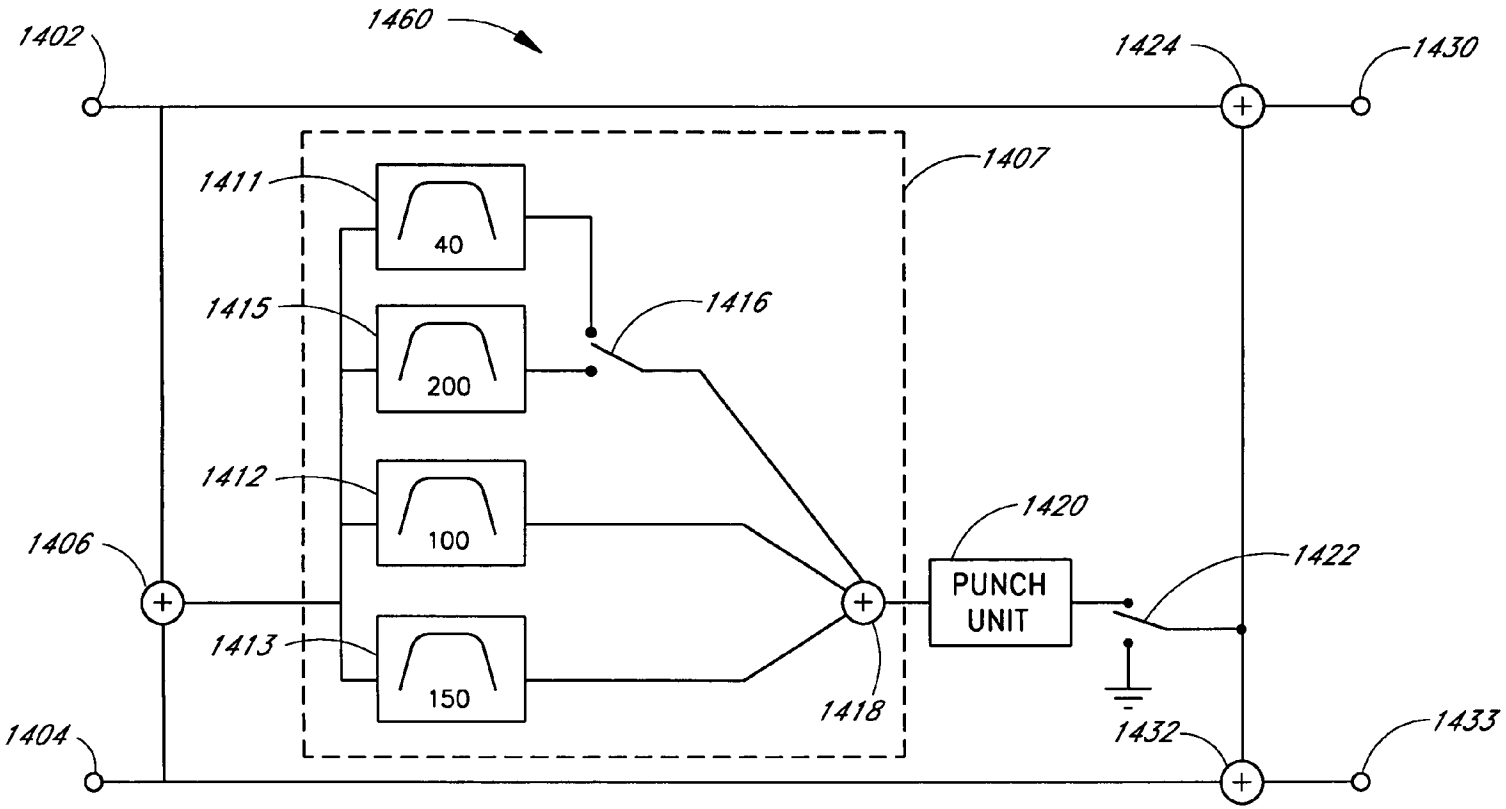
FIG. 14 is a signal processing block diagram of a system that provides bass enhancement with selectable frequency response.

FIG. 14 is a block diagram 1400 of one embodiment of the bass enhancement system 1304 shown in FIG. 13A. The bass enhancement system 1400 uses a bass punch unit 1420 to generate a time-dependent enhancement factor. FIG. 14 may also be used as a flowchart to describe a program running on a DSP or other processor which implements the signal processing operations of an embodiment of the present invention. FIG. 14 shows two inputs, a left-channel input 1402 and a right-channel input 1404. As with previous embodiments, left and right are used as a convenience, not as a limitation. The inputs 1402 and 1404 are both provided to an adder 1406 that produces an output that is a combination of the two inputs.

The output of the adder 1406 is provided to first bandpass filter 1412, a second bandpass filter 1413, a third bandpass filter 1415, and a fourth bandpass filter 1411. The output of the bandpass filter 1413 is provided to an input of an adder 1418.

The output of the bandpass filter 1415 is provided to a first throw of a single pole double throw (SPDT) switch 1416. The output of the bandpass filter 1411 is provided to a second throw of the SPDT switch 1416. The pole of the switch 1416 is provided to an input of the adder 1418.

The output of the bandpass filter 1412 is provided to an input of the adder 1418.

An output of the adder 1418 is provided to an input of the bass punch unit 1420. An output of the bass punch unit 1420 is provided to a first throw of a (SPDT) switch 1422. A second throw of the SPDT switch 1422 is provided to ground. The A pole of the SPDT switch 1422 is provided to a first input of a left-channel adder 1424 and to a first input of a right-channel adder 1432. The left-channel input 1402 is provided to a second input of the left-channel adder 1424 and the right-channel input 1404 is provided to a second input of the right-channel adder 1432. The outputs of the left-channel adder 1424 and the right-channel adder 1432 are, respectively, a left-channel output 1430 and a right-channel output 1433 of the signal processing block 1400. The switches 1422 and 1416 are optional and may be replaced by fixed connections.

The switches 1416 allow the filters 1411–1415 to be configured for two different frequency ranges, namely 150 Hz, and 100–200 Hz.

The filtering operations provided by the filters 1411–1413 and the combiner 1418 may be combined into a composite filter 1407 as shown in FIG. 14. For example, in an alternative embodiment, the filters 1411–1413, 1415 are combined into a single bandpass filter having a passband that extends from approximately 40 Hz to 250 Hz. For processing bass frequencies, the passband of the composite filter 1407 preferably extends from approximately 20 to 100 Hz at the low-end, and from approximately 150 to 350 Hz at the high-end. The composite filter 1407 may have other filter transfer functions as well, including, for example, a highpass filter, a shelving filter, etc. The composite filter may also be configured to operate in a manner similar to a graphic equalizer and attenuate some frequencies within its passband relative to other frequencies within its passband.

As shown, FIG. 14 corresponds approximately to the topology shown in FIG. 13B, where the signal processing blocks 1313 and 1315 have a transfer function of unity and the signal processing block 1312 comprises the composite filter 1407 and the bass punch unit 1420. However, the signal processing shown in FIG. 14 is not limited to the topology shown in FIG. 13B. The elements of FIG. 14 may also be used in the topology shown in FIG. 13C, where the signal processing blocks 1321 and 1323 have a transfer function of unity and the signal processing blocks 1322 and 1324 comprise the composite filter 1407 and the bass punch unit 1420. Although not shown in FIG. 14, the signal processing blocks 1313, 1315, 1321, and 1323 may provide additional signal processing, such as, for example, high pass filtering to remove low bass frequencies, high pass filtering to remove frequencies processed by the bass punch unit 1420, high frequency emphasis to enhance the high frequency sounds, additional mid bass processing to supplement the bass punch system, etc. Other combinations are contemplated as well.

Figure 15:
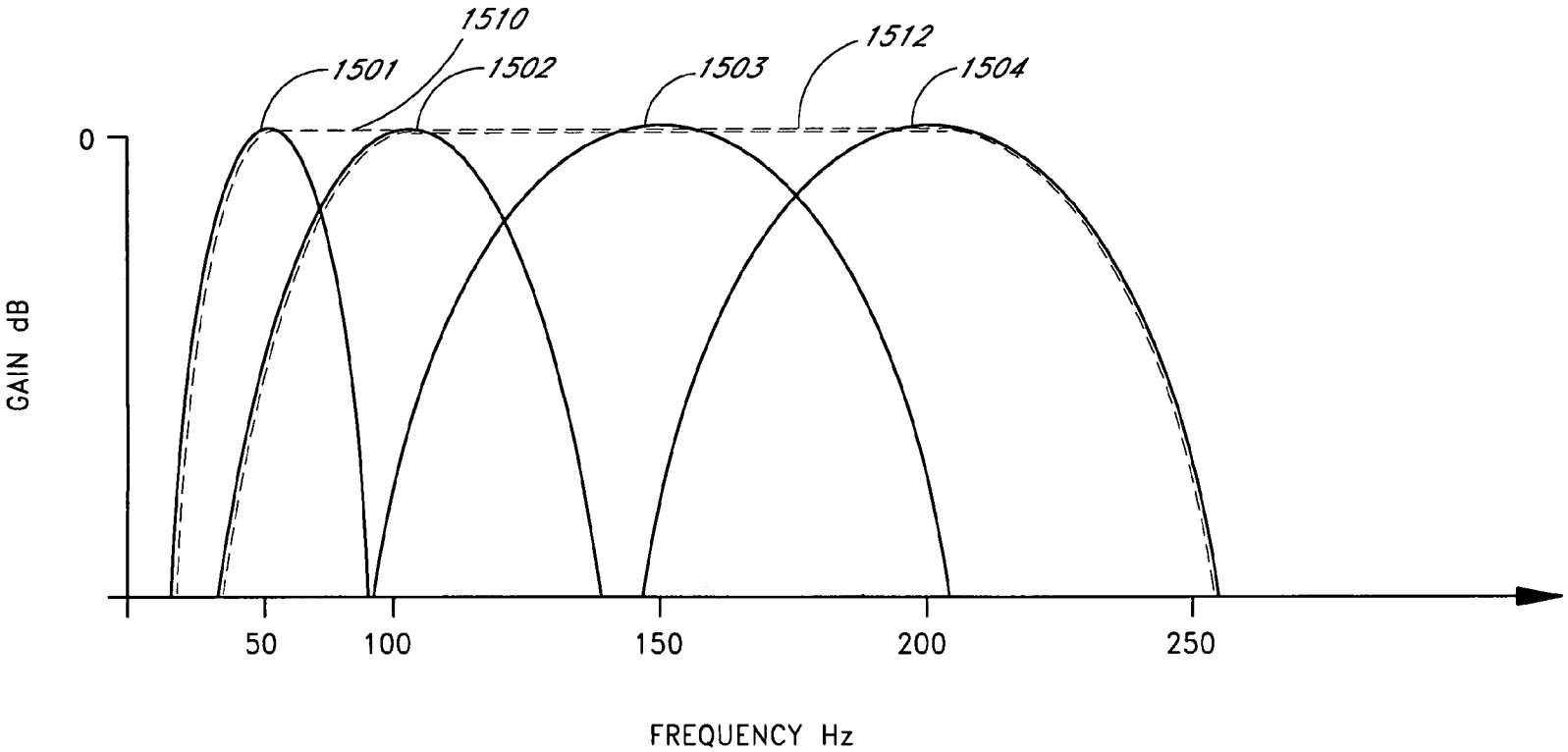
FIG. 15 is a plot of the transfer functions of the bandpass filters used in the signal processing diagram shown in FIG. 14.

FIG. 15 is a frequency-domain plot that shows the general shape of the transfer functions of the bandpass filters 1411–1413, 1415. FIG. 15 shows the bandpass transfer functions 1505–1504, corresponding to the bandpass filters 1411–1413, 1415 respectively. The transfer functions 1501–1504 are shown as bandpass functions centered at 40, 100, 150, and 200 Hz respectively.

In one embodiment, the bandpass filter 1411 is tuned to a frequency below 100 Hz, such as 40 Hz. When the switch 1416 is in a first position, corresponding to the first throw, it selects the bandpass filter 1411 and deselects the bandpass filter 1415, thereby providing bandpass filters at 40, 100, and 150 Hz. When the switch 1416 is in a second position, corresponding to the second throw, it deselects the bandpass filter 1411 and selects the bandpass filter 1415, thus providing bandpass filters at 100, 150, and 200 Hz.

Thus, the switch 1416 desirably allows a user to select the frequency range to be enhanced. A user with a loudspeaker system that provides small woofers, such as woofer of three to four inches in diameter, will typically select the upper frequency range provided by the bandpass filters 1412–1413, 1415 which are tuned to 100, 150, and 200 Hz respectively. A user with a loudspeaker system that provides somewhat larger woofers, such as woofers of approximately five inches in diameter or larger, will typically select the lower frequency range provided by the bandpass filters 1411–1413, which are tuned to 40, 100, and 150 Hz respectively. One skilled in the art will recognize that more switches could be provided to allow selection of more bandpass filters and more frequency ranges. Selecting different bandpass filters to provide different frequency ranges is a desirable technique because the bandpass filters are inexpensive and because different bandpass filters can be selected with a single-throw switch.

In one embodiment, the bass punch unit 1420 uses an Automatic Gain Control (AGC) comprising a linear amplifier with an internal servo feedback loop. The servo automatically adjusts the average amplitude of the output signal to match the average amplitude of a signal on the control input. The average amplitude of the control input is typically obtained by detecting the envelope of the control signal. The control signal may also be obtained by other methods, including, for example, lowpass filtering, bandpass filtering, peak detection, RMS averaging, mean value averaging, etc.

Figure 16:
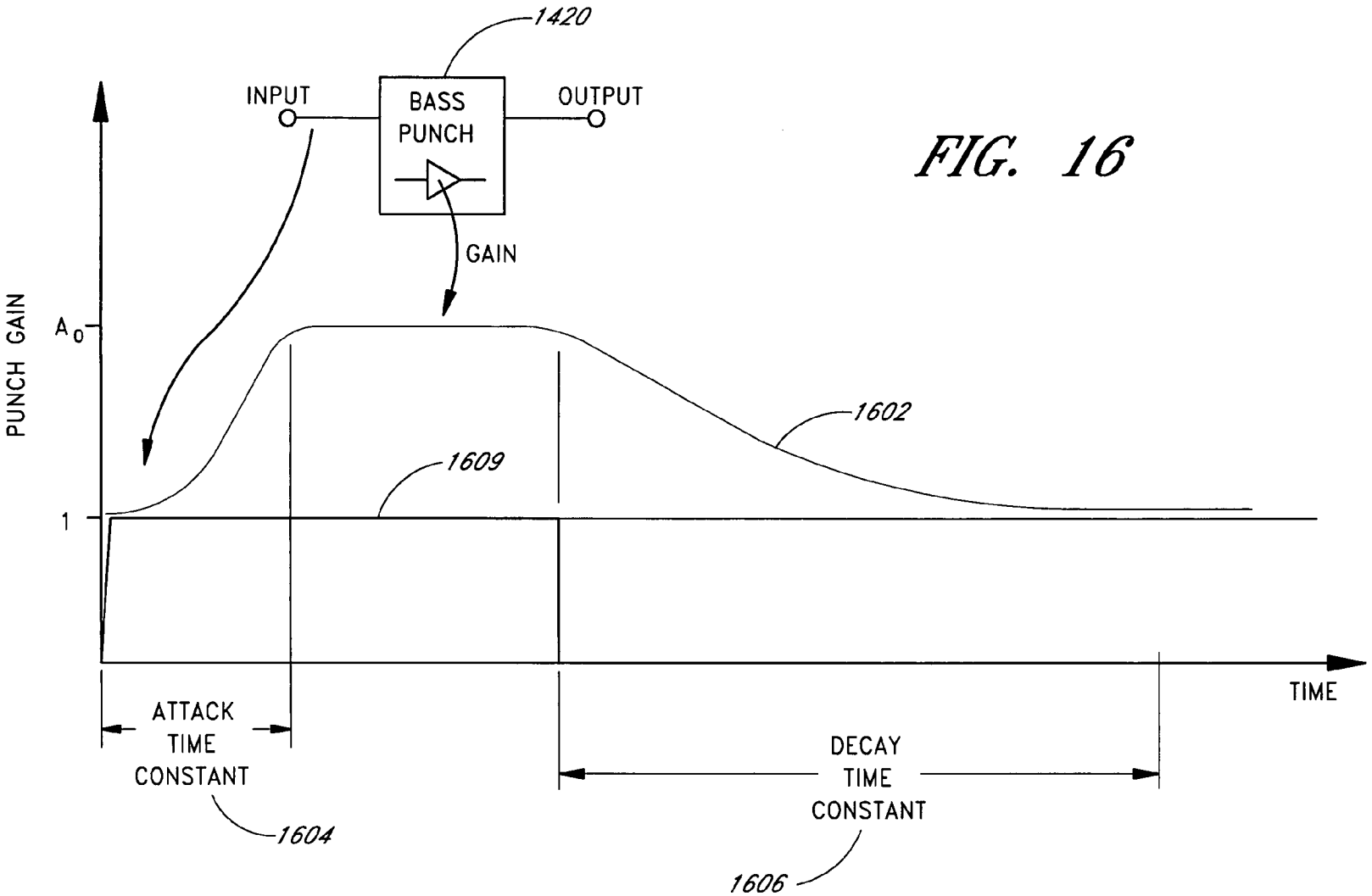
FIG. 16 is a time-domain plot showing the time-amplitude response of the punch system.

In response to an increase in the amplitude of the envelope of the signal provided to the input of the bass punch unit 1420, the servo loop increases the forward gain of the bass punch unit 1420. Conversely, in response to a decrease in the amplitude of the envelope of the signal provided to the input of the bass punch unit 1420, the servo loop decreases the forward gain of the bass punch unit 1420. In one embodiment, the gain of the bass punch unit 1420 increases more rapidly that the gain decreases. FIG. 16 is a time domain plot that illustrates the gain of the bass punch unit 1420 in response to a unit step input. One skilled in the art will recognize that FIG. 16 is a plot of gain as a function of time, rather than an output signal as a function of time. Most amplifiers have a gain that is fixed, so gain is rarely plotted. However, the Automatic Gain Control (AGC) in the bass punch unit 1420 varies the gain of the bass punch unit 1420 in response to the envelope of the input signal.

The unit step input is plotted as a curve 1609 and the gain is plotted as a curve 1602. In response to the leading edge of the input pulse 1609, the gain rises during a period 1604 corresponding to an attack time constant. At the end of the time period 1604, the gain 1602 reaches a steady-state gain of $A_0$. In response to the trailing edge of the input pulse 1609 the gain falls back to zero during a period corresponding to a decay time constant 1606.

Figure 17:
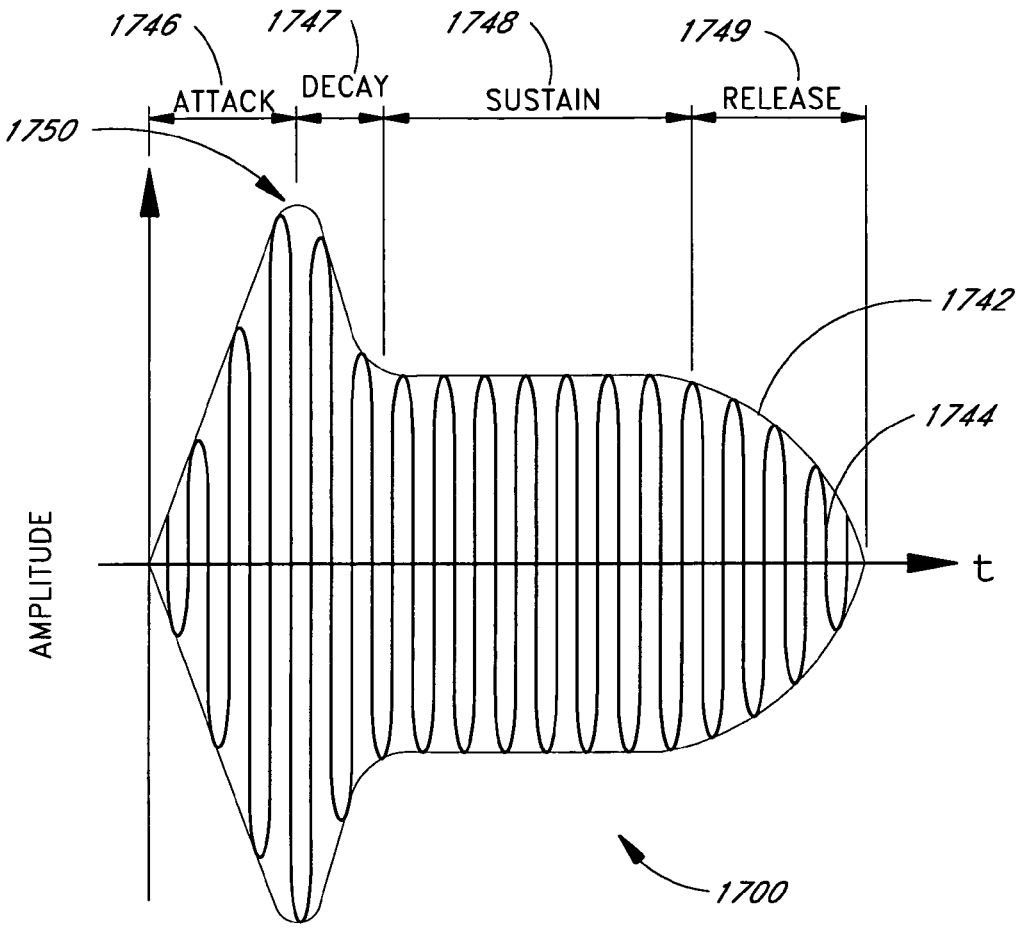
FIG. 17 is a time-domain plot showing the signal and envelope portions of a typical bass note played by an instrument, wherein the envelope shows attack, decay, sustain and release portions.

The attack time constant 1604 and the decay time constant 1606 are desirably selected to provide enhancement of the bass frequencies without overdriving other components of the system such as the amplifier and loudspeakers. FIG. 17 is a time-domain plot 1700 of a typical bass note played by a musical instrument such as a bass guitar, bass drum, synthesizer, etc. The plot 1700 shows a higher-frequency portion 1744 that is amplitude modulated by a lower-frequency portion having a modulation envelope 1742. The envelope 1742 has an attack portion 1746, followed by a decay portion 1747, followed by a sustain portion 1748, and finally, followed by a release portion 1749. The largest amplitude of the plot 1700 is at a peak 1750, which occurs at the point in time between the attack portion 1746 and the decay portion 1747.

As stated, the waveform 1744 is typical of many, if not most, musical instruments. For example, a guitar string, when pulled and released, will initially make a few large amplitude vibrations, and then settle down into a more or less steady state vibration that slowly decays over a long period. The initial large excursion vibrations of the guitar string correspond to the attack portion 1746 and the decay portion 1747. The slowly decaying vibrations correspond to the sustain portion 1748 and the release portions 1749. Piano strings operate in a similar fashion when struck by a hammer attached to a piano key.

Piano strings may have a more pronounced transition from the sustain portion 1748 to the release portion 1749, because the hammer does not return to rest on the string until the piano key is released. While the piano key is held down, during the sustain period 1748, the string vibrates freely with relatively little attenuation. When the key is released, the felt covered hammer comes to rest on the key and rapidly damps out the vibration of the string during the release period 1749.

Similarly, a drumhead, when struck, will produce an initial set of large excursion vibrations corresponding to the attack portion 1746 and the decay portion 1747. After the large excursion vibrations have died down (corresponding to the end of the decay portion 1747) the drumhead will continue to vibrate for a period of time corresponding to the sustain portion 1748 and release portion 1749. Many musical instrument sounds can be created merely by controlling the length of the periods 1746–1749.

As described in connection with FIG. 12A, the amplitude of the higher-frequency signal is modulated by a lower-frequency tone (the envelope), and thus, the amplitude of the higher-frequency signal varies according to the frequency of the lower frequency tone. The non-linearity of the ear will partially demodulate the signal such that the ear will detect the low-frequency envelope of the higher-frequency signal, and thus produce the perception of the low-frequency tone, even though no actual acoustic energy was produced at the lower frequency. The detector effect can be enhanced by proper signal processing of the signals in the midbass frequency range, typically between 50–150 Hz on the low end of the range and 200–500 Hz on the high end of the range. By using the proper signal processing, it is possible to design a sound enhancement system that produces the perception of low-frequency acoustic energy, even when using loudspeakers that are incapable of producing such energy.

The perception of the actual frequencies present in the acoustic energy produced by the loudspeaker may be deemed a first order effect. The perception of additional harmonics not present in the actual acoustic frequencies, whether such harmonics are produced by intermodulation distortion or detection may be deemed a second order effect.

However, if the amplitude of the peak 1750 is too high, the loudspeakers (and possibly the power amplifier) will be overdriven. Overdriving the loudspeakers will cause a considerable distortion and may damage the loudspeakers.

The bass punch unit 1420 desirably provides enhanced bass in the midbass region while reducing the overdrive effects of the peak 1750. The attack time constant 1604 provided by the bass punch unit 1420 limits the rise time of the gain through the bass punch unit 1420. The attack time constant of the bass punch unit 1420 has relatively less effect on a waveform with a long attack period 1746 (slow envelope risetime) and relatively more effect on a waveform with a short attack period 1746 (fast envelope risetime).

Bass Punch with Peak Compression

An attack portion of a note played by a bass instrument (e.g., a bass guitar) will often begin with an initial pulse of relatively high amplitude. This peak may, in some cases, overdrive the amplifier or loudspeaker causing distorted sound and possibly damaging the loudspeaker or amplifier. The bass enhancement processor provides a flattening of the peaks in the bass signal while increasing the energy in the bass signal, thereby increasing the overall perception of bass.

The energy in a signal is a function of the amplitude of the signal and the duration of the signal. Stated differently, the energy is proportional to the area under the envelope of the signal. Although the initial pulse of a bass note may have a relatively large amplitude, the pulse often contains little energy because it is of short duration. Thus, the initial pulse, having little energy, often does not contribute significantly to the perception of bass. Accordingly, the initial pulse can usually be reduced in amplitude without significantly affecting the perception of bass.

Figure 18:
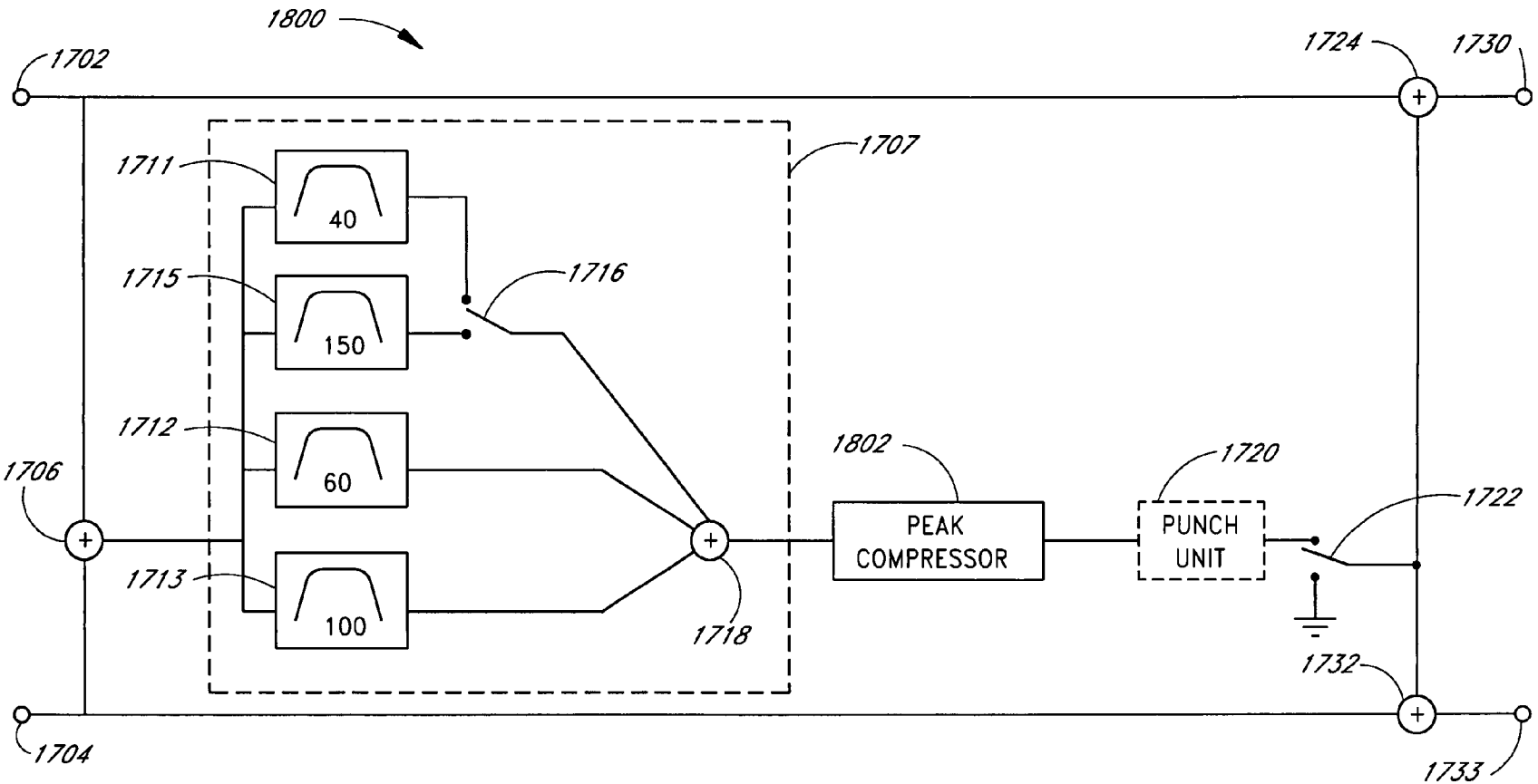
FIG. 18 is a signal processing block diagram of a system that provides bass enhancement using a peak compressor and a bass punch system.

FIG. 18 is a signal processing block diagram of a bass enhancement system 1800 that provides bass enhancement using a peak compressor to control the amplitude of pulses, such as the initial pulse, bass notes. In the system 1800, a peak compressor 1802 is interposed between the combiner 1718 and the punch unit 1720. The output of the combiner 1718 is provided to an input of the peak compressor 1802, and an output of the peak compressor 1802 is provided to the input of the bass punch unit 1720.

The comments above relating FIG. 14 to FIGS. 13B and 13C apply to the topology shown in FIG. 18 as well. For example, as shown, FIG. 18 corresponds approximately to the topology shown in FIG. 13B, where the signal processing blocks 1313 and 1315 have a transfer function of unity and the signal processing block 1312 comprises the composite filter 1707, the peak compressor 1802, and the bass punch unit 1720. However, the signal processing shown in FIG. 18 is not limited to the topology shown in FIG. 13B. The elements of FIG. 18 may also be used in the topology shown in FIG. 13C. Although not shown in FIG. 18, the signal processing blocks 1313, 1315, 1321, and 1323 may provide additional signal processing, such as, for example, high pass filtering to remove low bass frequencies, high pass filtering to remove frequencies processed by the bass punch unit 1720 and the compressor 1802, high frequency emphasis to enhance the high frequency sounds, additional mid bass processing to supplement the bass punch system 1720 and peak compressor 1802, etc. Other combinations are contemplated as well.

The peak compression unit 1802 "flattens" the envelope of the signal provided at its input. For input signals with a large amplitude, the apparent gain of the compression unit 1802 is reduced. For input signals with a small amplitude, the apparent gain of the compression unit 1802 is increased. Thus the compression unit reduces the peaks of the envelope of the input signal (and fills in the troughs in the envelope of the input signal). Regardless of the signal provided at the input of the compression unit 1802, the envelope (e.g., the average amplitude) of the output signal from the compression unit 1802 has a relatively uniform amplitude.

Figure 19:
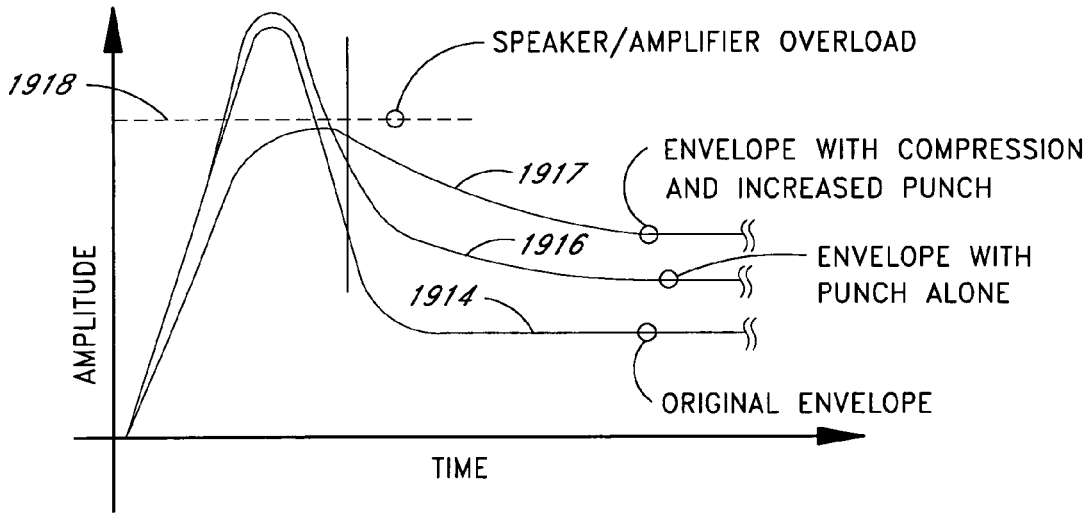
FIG. 19 is a time-domain plot showing the effect of the peak compressor on an envelope with a fast attack.

FIG. 19 is a time-domain plot showing the effect of the peak compressor on an envelope with an initial pulse of relatively high amplitude. FIG. 19 shows a time-domain plot of an input envelope 1914 having an initial large amplitude pulse followed by a longer period of lower amplitude signal. An output envelope 1916 shows the effect of the bass punch unit 1720 on the input envelope 1914 (without the peak compressor 1802). An output envelope 1917 shows the effect of passing the input signal 1914 through both the peak compressor 1802 and the punch unit 1720.

As shown in FIG. 19, assuming the amplitude of the input signal 1914 is sufficient to overdrive the amplifier or loudspeaker, the bass punch unit does not limit the maximum amplitude of the input signal 1914 and thus the output signal 1916 is also sufficient to overdrive the amplifier or loudspeaker.

The pulse compression unit 1802 used in connection with the signal 1917, however, compresses (reduces the amplitude of) large amplitude pulses. The compression unit 1802 detects the large amplitude excursion of the input signal 1914 and compresses (reduces) the maximum amplitude so that the output signal 1917 is less likely to overdrive the amplifier or loudspeaker.

Since the compression unit 1802 reduces the maximum amplitude of the signal, it is possible to increase the gain provided by the punch unit 1420 without significantly reducing the probability that the output signal 1917 will overdrive the amplifier or loudspeaker. The signal 1917 corresponds to an embodiment where the gain of the bass punch unit 1420 has been increased. Thus, during the long decay portion, the signal 1917 has a larger amplitude than the curve 1916.

As described above, the energy in the signals 1914, 1916, and 1917 is proportional to the area under the curve representing each signal. The signal 1917 has more energy because, even though it has a smaller maximum amplitude, there is more area under the curve representing the signal 1917 than either of the signals 1914 or 1916. Since the signal 1917 contains more energy, a listener will perceive more bass in the signal 1917.

Thus, the use of the peak compressor in combination with the bass punch unit 1420 allows the bass enhancement system to provide more energy in the bass signal, while reducing the likelihood that the enhanced bass signal will overdrive the amplifier or loudspeaker.

Stereo Image Enhancement

The present invention also provides a method and system that improves the realism of sound (especially the horizontal aspects of the sound stage) with a unique differential perspective correction system. Generally speaking, the differential perspective correction apparatus receives two input signals, a left input signal and a right input signal, and in turn, generates two enhanced output signals, a left output signal and a right output signal as shown in connection with FIG. 5.

The left and right input signals are processed collectively to provide a pair of spatially corrected left and right output signals. In particular, one embodiment equalizes the differences which exist between the two input signals in a manner which broadens and enhances the sound perceived by the listener. In addition, one embodiment adjusts the level of the sound which is common to both input signals so as to reduce clipping. Advantageously, one embodiment achieves sound enhancement with a simplified, low-cost, and easy-to-manufacture circuit which does not require separate circuits to process the common and differential signals as shown in FIG. 5.

Figure 20:
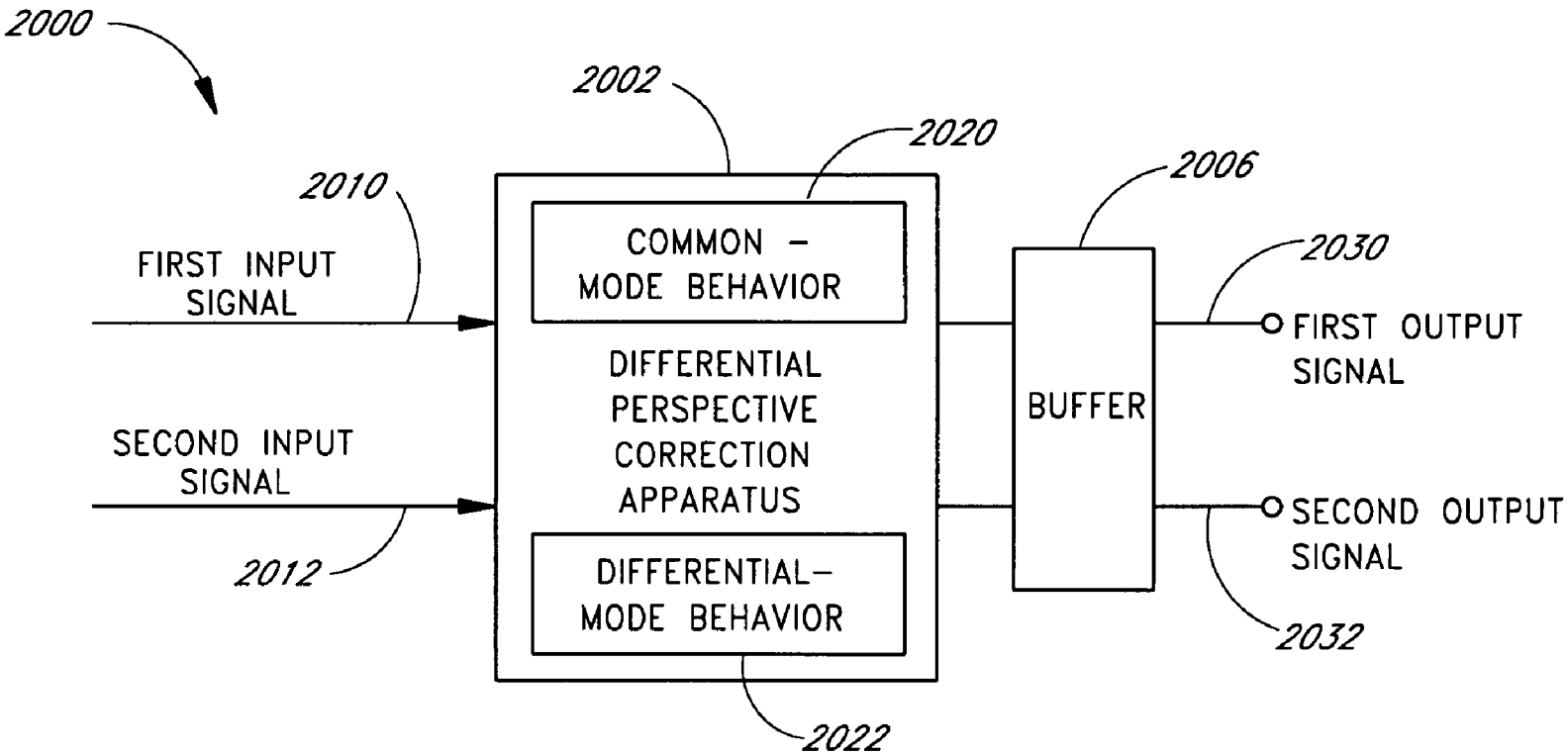
FIG. 20 is a conceptual block diagram of a stereo image (differential perspective) correction system.

Although some embodiments are described herein with reference to various sound enhancement system, the invention is not so limited, and can be used in a variety of other contexts in which it is desirable to adapt different embodiments of the sound enhancement system to different situations. To facilitate a complete understanding of the invention, the remainder of the detailed description is organized into the following sections and subsections:

FIG. 20 is a block diagram of a differential perspective correction apparatus 2002 from a first input signal 2010 and a second input signal 2012. In one embodiment the first and second input signals 2010 and 2012 are stereo signals; however, the first and second input signals 2010 and 2012 need not be stereo signals 3 and can include a wide range of audio signals. As explained in more detail below, the differential perspective correction apparatus 2002 modifies the audio sound information which is common to both the first and second input signals 2010 and 2012 in a different manner than the audio sound information which is not common to both the first and second input signals 2010 and 2012.

The audio information which is common to both the first and second input signals 2010 and 2012 is referred to as the common-mode information, or the common-mode signal (not shown). In one embodiment, the common-mode signal does not exist as a discrete signal. Accordingly, the term common-mode signal is used throughout this detailed description to conceptually refer the audio information which exist in both the first and second input signals 2010 and 2012 at any instant in time. For example, if a one-volt signal is applied to both the first and second input signals 2010 and 2012, the common-mode signal consists of one volt.

The adjustment of the common-mode signal is shown conceptually in the common-mode behavior block 2020. The common-mode behavior block 2020 represents the alteration of the common-mode signal. One embodiment reduces the amplitude of the frequencies in the common-mode signal in order to reduce the clipping, which may result from high-amplitude input signals.

In contrast, the audio information which is not common to both the first and second input signals 2010 and 2012 is referred to as the differential information or the differential signal (not shown). In one embodiment, the differential signal is not a discrete signal, rather throughout this detailed description, the differential signal refers to the audio information which represents the difference between the first and second input signals 2010 and 2012. For example, if the first input signal 2010 is zero volts and the second input signal 2012 is two volts, the differential signal is two volts (the difference between the two input signals 2010 and 2012).

The modification of the differential signal is shown conceptually in the differential-mode behavior block 2022. As discussed in more detail below, the differential perspective correction apparatus 2002 equalizes selected frequency bands in the differential signal. That is, one embodiment equalizes the audio information in the differential signal in a different manner than the audio information in the common-mode signal.

The differential perspective correction apparatus 2002 spectrally shapes the differential signal in the differential-mode behavior block 2022 with a variety of filters to create an equalized differential signal. By equalizing selected frequency bands within the differential signal, the differential perspective correction apparatus 2002 widens a perceived sound image projected from a pair of loudspeakers placed in front of a listener.

Furthermore, while the common-mode behavior block 2020 and the differential-mode behavior block 2022 are represented conceptually as separate blocks, one embodiment performs these functions with a single, uniquely adapted system. Thus, one embodiment processes both the common-mode and differential audio information simultaneously. Advantageously, one embodiment does not require the complicated circuitry to separate the audio input signals into discrete common-mode and differential signals. In addition, one embodiment does not require a mixer which then recombines the processed common-mode signals and the processed differential signals to generate a set of enhanced output signals.

The differential perspective correction apparatus 2002 is in turn, connected to one or more output buffers 2006. The output buffers 2006 output the enhanced first output signal 2030 and second output signal 2032. As discussed in more detail below, the output buffers 2006 isolate the differential perspective correction apparatus 2002 from other components connected to the first and second output signals 2030 and 2032. For example, the first and second output signals 2030 and 2032 can be directed to other audio devices such as a recording device, a power amplifier, a pair of loudspeakers and the like without altering the operation of the differential perspective correction apparatus 2002.

Figure 21:
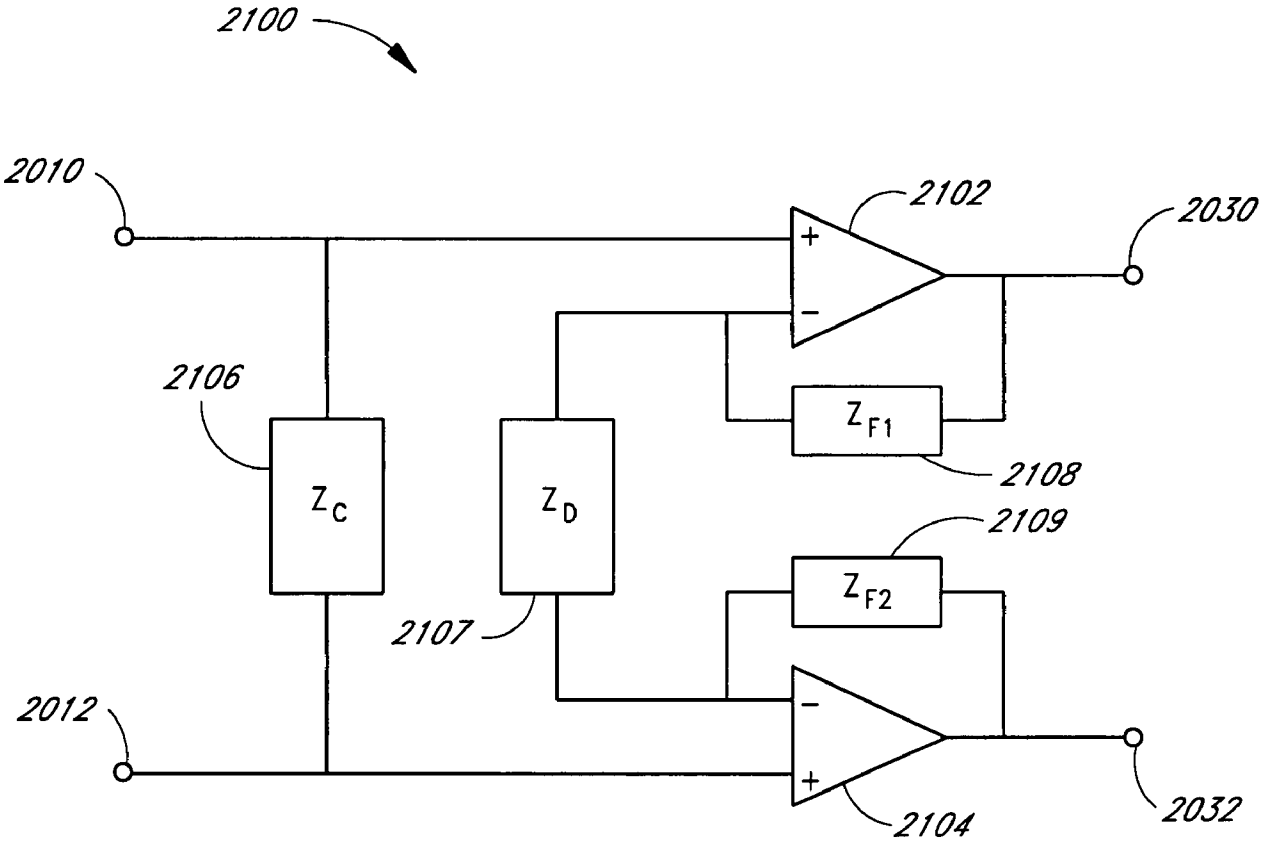
FIG. 21 is a block diagram of a stereo image (differential perspective) correction system that does not develop explicit sum and difference signals.

FIG. 21 is a block diagram of a system that uses differential amplifiers to provide the differential perspective correction shown in FIG. 20. In FIG. 21, the first input 2010 is provided to a non-inverting input of a first differential amplifier 2102 and to a first input of a cross-over impedance block 2106. The second input 2012 is provided to a non-inverting input of a second differential amplifier 2104 and to a second terminal of the cross-over impedance block 2106. An inverting input of the first differential amplifier 2102 is provided to a first terminal of a cross-over impedance block 2107 and to a first terminal of a first feedback impedance 2108. An output of the first differential amplifier 2102 is provided to the first output 2030 and to a second terminal of the first feedback impedance 2108. An inverting input of the second differential amplifier 2104 is provided to a second terminal of the cross-over impedance block 2107 and to a first terminal of a second feedback impedance 2109. An output of the second differential amplifier 2104 is provided to the second output 2032 and to a second terminal of the second feedback impedance 2109.

The impedances of the blocks 2106, 2107, 2108 and 2109 are typically frequency dependent and may be constructed as filters using, for example, resistors, capacitors and/or inductors. In one embodiment, the impedances 2108 and 2109 are not frequency dependent.

Figure 22:
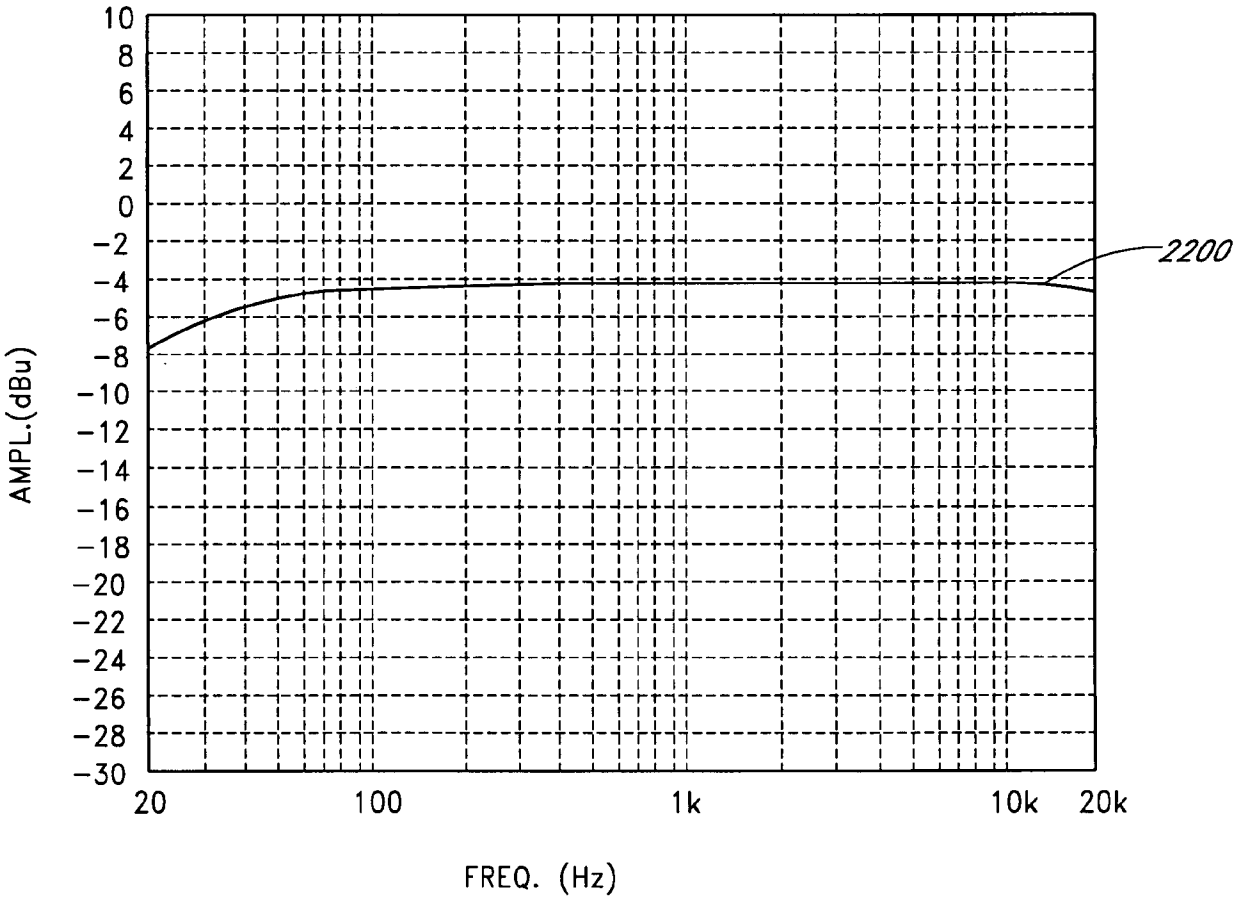
FIG. 22 illustrates a graphical representation of the common-mode gain of the differential perspective correction system.

FIG. 22 is an amplitude-versus-frequency chart, which illustrates the common-mode gain at both the left and right output terminals 2030 and 2032. The common-mode gain is represented with a first common-mode gain curve 2200. As shown in the common-mode gain curve 2200, the frequencies below approximately 130 hertz (Hz) are de-emphasized more than the frequencies above approximately 130 Hz. For frequencies above approximately 130 Hz, the frequencies are uniformly reduced by approximately 6 decibels.

Figure 23:
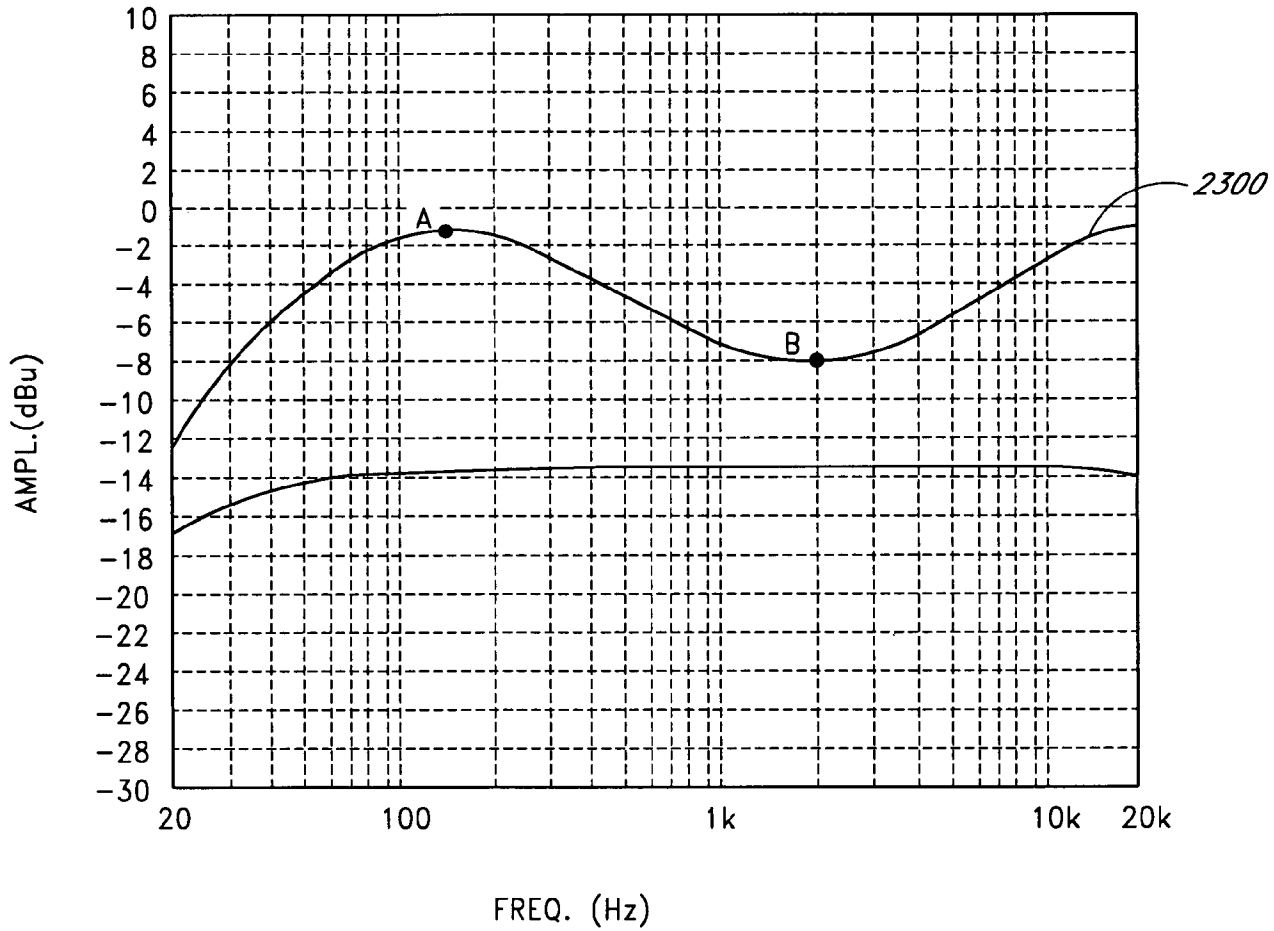
FIG. 23 is a graphical representation of the overall differential signal equalization curve of the differential perspective correction system.

FIG. 23 illustrates the overall correction curve 2300 generated by the combination of the first and second cross-over networks 2106, and 2107. The approximate relative gain values of the various frequencies within the overall correction curve 2300 can be measured against a zero (0) dB reference.

With such a reference, the overall correction curve 2300 is defined by two turning points labeled as point A and point B. At point A, which in one embodiment is approximately 125 Hz, the slope of the correction curve changes from a positive value to a negative value. At point B, which in one embodiment is approximately 2 kHz, the slope of the correction curve changes from a negative value to a positive value.

Thus, the frequencies below approximately 125 Hz are de-emphasized relative to the frequencies near 125 Hz. In particular, below 125 Hz, the gain of the overall correction curve 2300 decreases at a rate of approximately 6 dB per octave. This de-emphasis of signal frequencies below 125 Hz prevents the over-emphasis of very low, (i.e. bass) frequencies. With many audio reproduction systems, over emphasizing audio signals in this low-frequency range relative to the higher frequencies can create an unpleasurable and unrealistic sound image having too much bass response. Furthermore, over emphasizing these frequencies may damage a variety of audio components including the loudspeakers.

Between point A and point B, the slope of one overall correction curve is negative. That is, the frequencies between approximately 125 Hz and approximately 2 kHz are de-emphasized relative to the frequencies near 125 Hz.

Thus, the gain associated with the frequencies between point A and point B decrease at variable rates towards the maximum-equalization point of −8 dB at approximately 2 kHz.

Above 2 kHz the gain increases, at variable rates, up to approximately 20 kHz, i.e., approximately the highest frequency audible to the human ear. That is, the frequencies above approximately 2 kHz are emphasized relative to the frequencies near 2 kHz. Thus, the gain associated with the frequencies above point B increases at variable rates towards 20 kHz.

These relative gain and frequency values are merely design objectives and the actual figures will likely vary from system to system. Furthermore, the gain and frequency values may be varied based on the type of sound or upon user preferences without departing from the spirit of the invention. For example, varying the number of the cross-over networks and varying the resister and capacitor values within each cross-over network allows the overall perspective correction curve 2300 be tailored to the type of sound reproduced.

The selective equalization of the differential signal enhances ambient or reverberant sound effects present in the differential signal. As discussed above, the frequencies in the differential signal are readily perceived in a live sound stage at the appropriate level. Unfortunately, in the playback of a recorded performance the sound image does not provide the same 360 degree effect of a live performance. However, by equalizing the frequencies of the differential signal with the differential perspective correction apparatus 2002, a projected sound image can be broadened significantly so as to reproduce the live performance experience with a pair of loudspeakers placed in front of the listener.

Equalization of the differential signal in accordance with the overall correction curve 2300 is intended to de-emphasize the signal components of statistically lower intensity relative to the higher-intensity signal components. The higher-intensity differential signal components of a typical audio signal are found in a mid-range of frequencies between approximately 2 to 4 kHz. In this range of frequencies, the human ear has a heightened sensitivity. Accordingly, the enhanced left and right output signals produce a much improved audio effect.

The number of cross-over networks and the components within the cross-over networks can be varied in other embodiments to simulate what are called head related transfer functions (HRTF). Head related transfer functions describe different signal equalizing techniques for adjusting the sound produced by a pair of loudspeakers so as to account for the time it takes for the sound to be perceived by the left and right ears. Advantageously, an immersive sound effect can be positioned by applying HRTF-based transfer functions to the differential signal so as to create a fully immersive positional sound field.

Examples of HRTF transfer functions which can be used to achieve a certain perceived azimuth are described in the article by E. A. B. Shaw entitled "Transformation of Sound Pressure Level From the Free Field to the Eardrum in the Horizontal Plane", J. Acoust. Soc. Am., Vol. 106, No. 6, December 1974, and in the article by S. Mehrgardt and V. Mellert entitled "Transformation Characteristics of the External Human Ear", J. Acoust. Soc. Am., Vol. 61, No. 6, June 1977.

Single Chip Implementation

Figure 24:
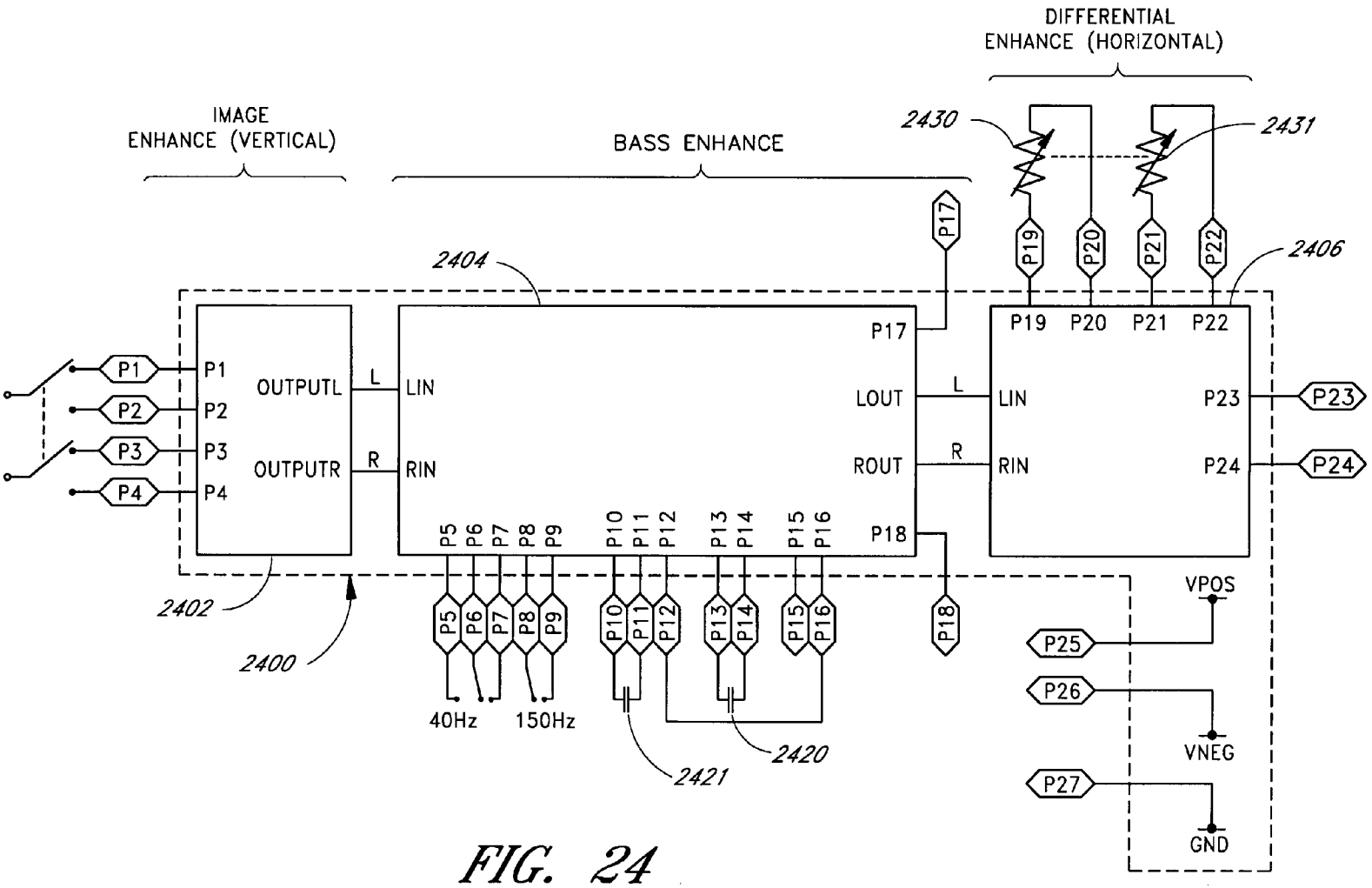
FIG. 24 is a block diagram of one embodiment of a sound enhancement system that can be implemented on a single chip.

FIG. 24 is a block diagram of one embodiment of a sound enhancement system 2400 that can be implemented on a single chip. As described in connection with FIGS. 1–23 above, the system 2400 includes a vertical image enhancement block 2402, a bass enhancement block 2404 and a horizontal image enhancement block 2406. External connections to the system 2400 are provided through connector pins P1–P27. A positive supply voltage is provided to the pin P25, a negative supply voltage is provided to the pin P26, and a ground is provided to the pin P27. A first terminal of a compression coupling capacitor 2421 is provided to the pin P10 and a second terminal of the compression coupling capacitor 2421 is provided to the pin P11. A first terminal of a compression delay capacitor 2420 is provided to the pin P13 and a second terminal of the compression delay capacitor 2420 is provided to the pin P14. A first terminal of a width-control resistor 2430 is provided to the pin P19 and a second terminal of the width-control resistor 2430 is provided to the pin P20. A first terminal of a width-control resistor 2431 is provided to the pin P21 and a second terminal of the width-control resistor 2431 is provided to the pin P22. In one embodiment, the width-control resistors 2430 and 2431 are variable resistors.

Figure 25A:
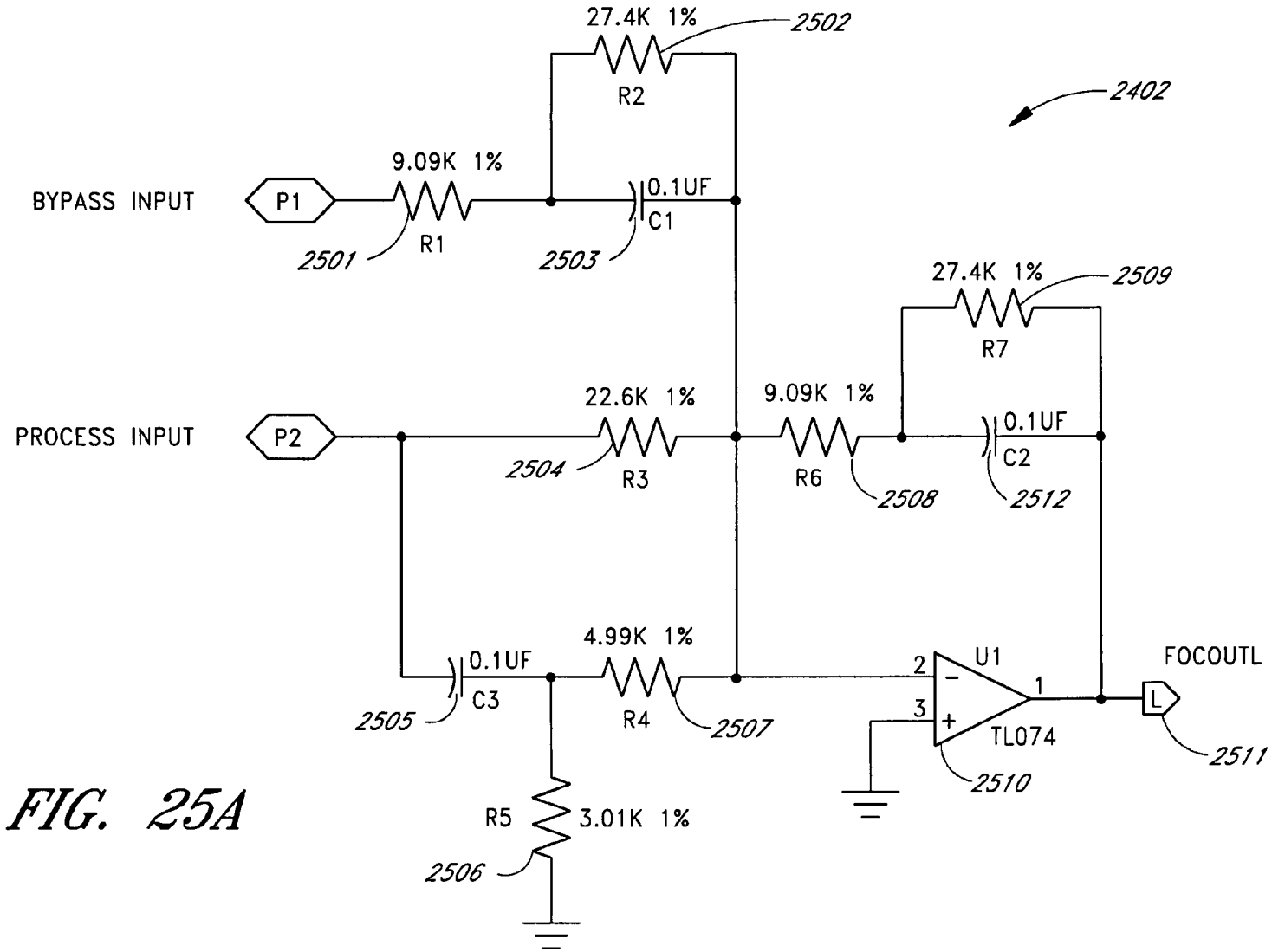
FIG. 25A is a schematic diagram of a left channel of a vertical image enhancement block suitable for use in the system shown in FIG. 24.
Figure 25B:
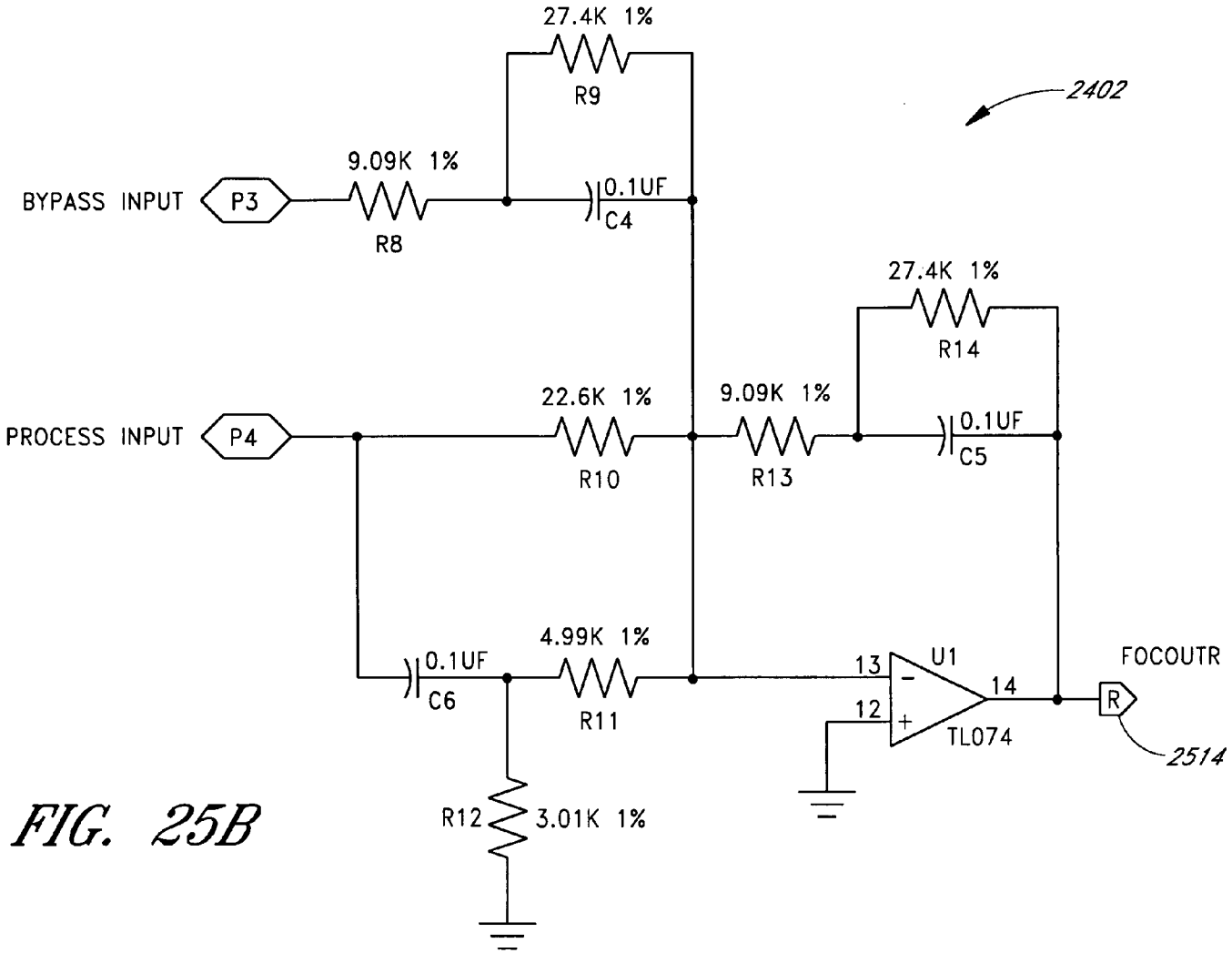
FIG. 25B is a schematic diagram of a right channel of a vertical image enhancement block suitable for use in the system shown in FIG. 24.

FIG. 25A is a schematic diagram of a left-channel of the vertical image enhancement block 2402. FIG. 25B is a schematic diagram of a right-channel of the vertical image enhancement block 2402. In FIG. 25A, a left channel input is provided to the pin P2 and left channel bypass input is provided to the pin P1. The pin P1 is provided to a first terminal of a resistor 2501. A second terminal of the resistor 2501 is provided to a first terminal of a resistor 2502 and to a first terminal of a capacitor 2503. The pin P2 is provided to a first terminal of a resistor 2504 and to a first terminal of a capacitor 2505. A second terminal of the capacitor 2505 is provided to a first terminal of a resistor 2506 and to a first terminal of a resistor 2507. A second terminal of the resistor 2506 is provided to ground.

A second terminal of the resistor 2502 is provided to a second terminal of the capacitor 2503, to a second terminal of the resistor 2504, to a second terminal of the resistor 2507 to a first terminal of a resistor 2508, and to an inverting input of an operational amplifier (opamp) 2510. A non-inverting input of the opamp 2510 is provided to ground. A second terminal of the resistor 2508 is provided to a first terminal of a resistor 2509 and to a first terminal of a capacitor 2512. A second terminal of the resistor 2509 is provided to a second terminal of the capacitor 2512, to an output of the opamp 2510, and to a left-channel output 2511.

In one embodiment, the resistor 2501 is 9.09 k ohms, the resistor 2502 is 27.4 k ohms, the capacitor 2503 is 0.1 uf, the resistor 2504 is 22.6 k ohms, the capacitor 2505 is 0.1 uf, the resistor 2506 is 3.01 k ohms, the resistor 2507 is 4.99 k ohms, the resistor 2508 is 9.09 k ohms, the resistor 2509 is 27.4 k ohms, the capacitor 2512 is 0.1 uf and the opamp 2510 is a TL074 type or equivalent.

The right-channel shown in FIG. 25B is similar to the left channel shown in FIG. 25A, having a bypass input from the pin P3, a right-channel input from the pin P4 and a right-channel output 2514.

Figures 26, 26A:
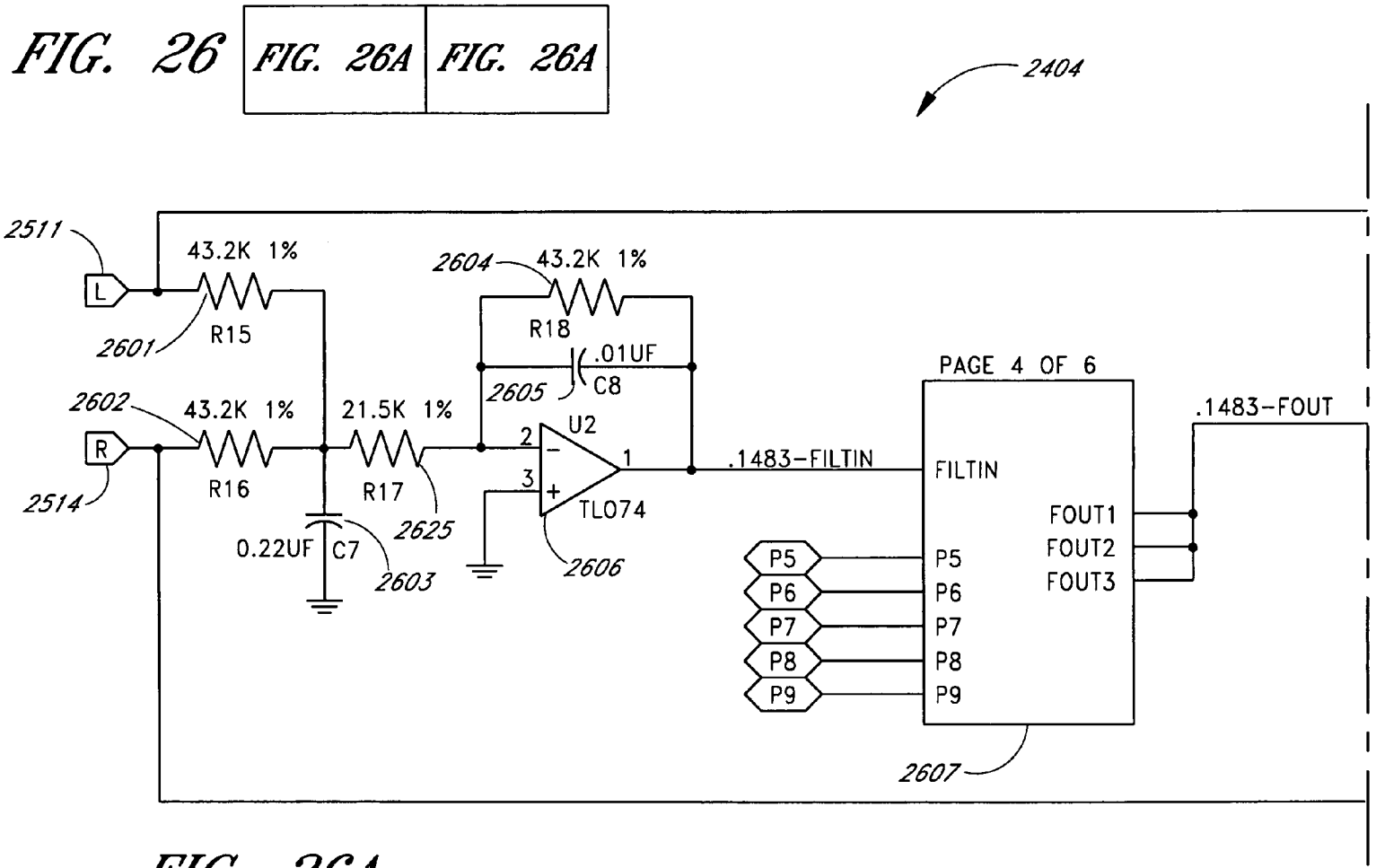
FIG. 26 is a schematic diagram of a bass enhancement block suitable for use in the system shown in FIG. 24.

FIG. 26 is a schematic diagram of the bass enhancement block 2404. The left-channel output 2511 from FIG. 25A is provided to a first terminal of a resistor 2601 and to a first terminal of a resistor 2611. The right-channel output 2514 from FIG. 25B is provided to a first terminal of a resistor 2602 and to a first terminal of a resistor 2614.

A second terminal of the resistor 2601 is provided to a second terminal of the resistor 2602, to a first terminal of a resistor 2625, and to a first terminal of a capacitor 2603. A second terminal of the capacitor 2603 is provided to ground. A second terminal of the resistor 2625 is provided to an inverting input of an opamp 2606, to a first terminal of a capacitor 2605 and to a first terminal of a resistor 2604. A non-inverting input of the opamp 2606 is provided to ground. An output of the opamp 2606 is provided to a second terminal of the resistor 2604, to a second terminal of the capacitor 2605, and to an input of a filter block 2607 (shown in more detail in FIG. 27). First, second, and third outputs of the filter block 2607 are provided to an inverting input of an opamp 2608 and to a first terminal of a resistor 2609. A non-inverting input of the opamp 2608 is provided to ground. An output of the opamp 2608 is provided to a second terminal of the resistor 2609 and to the pin P10.

Figure 28:
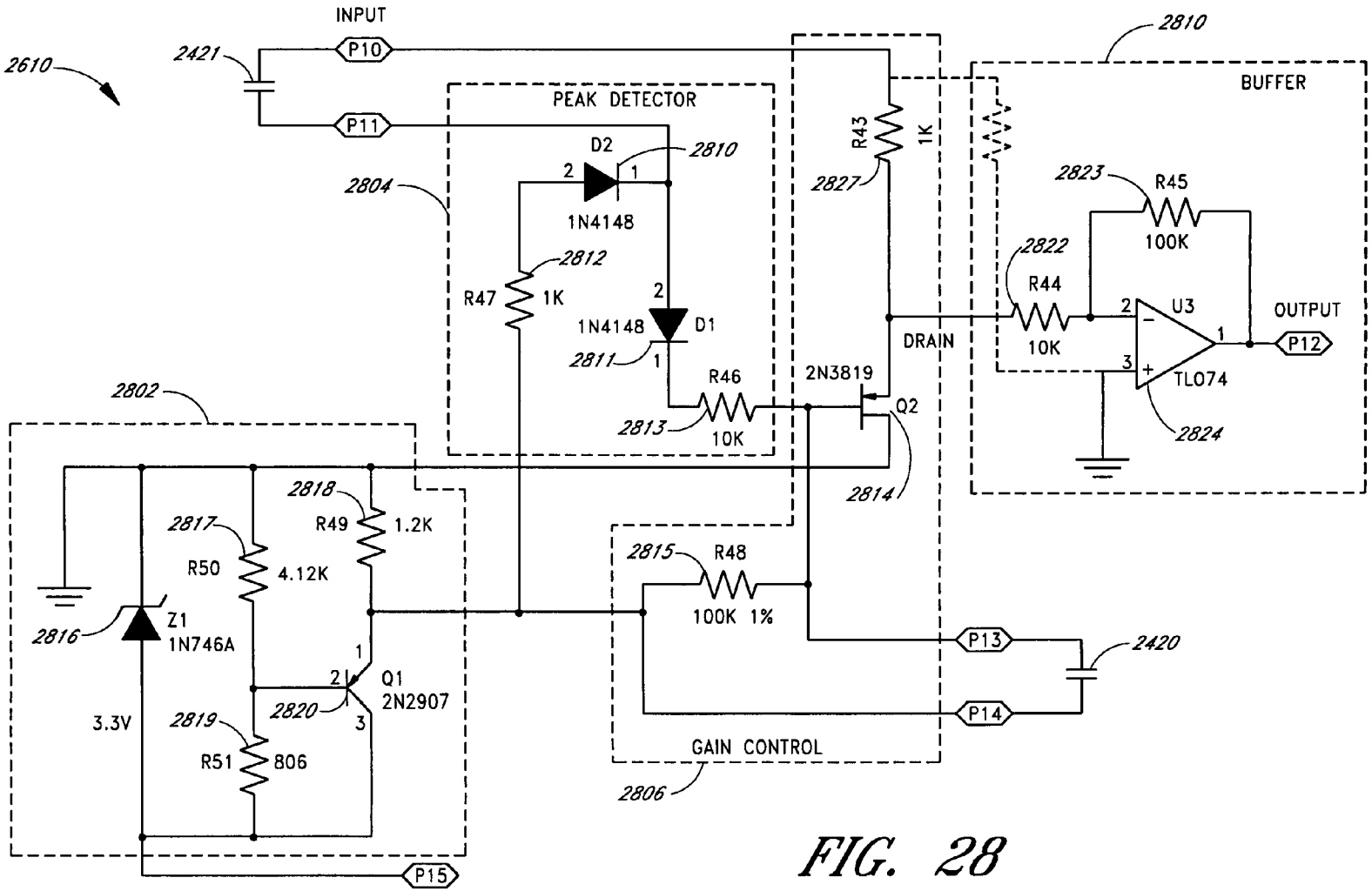
FIG. 28 is a schematic diagram of a compressor system suitable for use in the bass enhancement system shown in FIG. 26.

The pin P10 is also provided to an input of a compressor 2610 (shown in more detail in FIG. 28). An output of the compressor 2610 is provided to the pin P12. The pin P12 is provided to the pin P16. The pin P16 is provided to a first terminal of a resistor 2612 and to a first terminal of a resistor 2613.

A second terminal of the resistor 2612 is provided to a second terminal of the resistor 2611, to an inverting input of an opamp 2620 and to a first terminal of a resistor 2619. A non-inverting input of the opamp 2620 is provided to ground. An output of the opamp 2620 is provided to a second terminal of the resistor 2619 and to a first terminal of the resistor 2621. A second terminal of the resistor 2621 is provided to the pin P17. An output of the opamp 2620 is also provided as a left-channel output 2630.

A second terminal of the resistor 2613 is provided to a second terminal of the resistor 2614, to an inverting input of an opamp 2615 and to a first terminal of a resistor 2617. A non-inverting input of the opamp 2615 is provided to ground. An output of the opamp 2615 is provided to a second terminal of the resistor 2617 and to a first terminal of the resistor 2618. A second terminal of the resistor 2618 is provided to the pin P18. An output of the opamp 2615 is also provided as a right-channel output 2631.

In one embodiment, the resistors 2601, 2602, and 2604 are 43.2 k ohms, the capacitor 2603 is 0.022 uf, the resistor 2625 is 21.5 k ohms, and the capacitor 2605 is 0.01 uf. In one embodiment, the resistor 2609 is 100 k ohms, the resistors 2611, 2612, 2613, 2614, 2617 and 2619 are 10 k ohms, and the resistors 2618 and 2621 are 200 ohms. In one embodiment, the opamps 2606, 2608, 2615, and 2620 are TL074 types or equivalents thereof.

Figure 27:
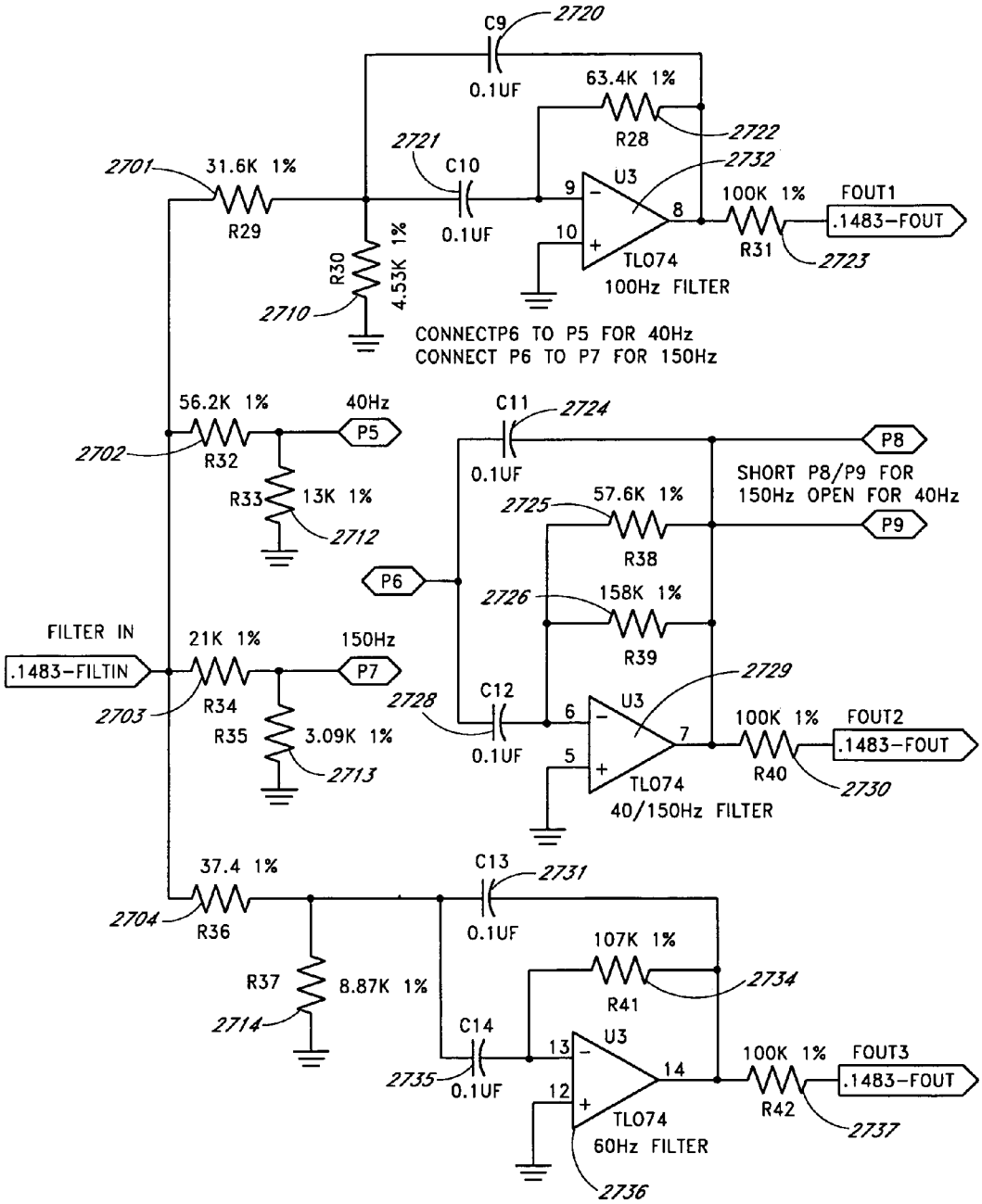
FIG. 27 is a schematic diagram of a filter system suitable for use in the bass enhancement system shown in FIG. 26.

FIG. 27 is a schematic diagram of the filter system 2607. In FIG. 27, the input is provided to a first terminal of resistors 2701–2704. A second terminal of resistor 2701 is provided to a first terminal of a resistor 2710, to a first terminal of a capacitor 2721 and to a first terminal of a capacitor 2720. A second terminal of the capacitor 2721 is provided to a first terminal of a resistor 2722 and to an inverting input of an opamp 2732. A non-inverting input of the opamp 2732 is provided to ground. An output of the opamp 2732 is provided to a second terminal of the capacitor 2720, to a second terminal of the resistor 2722, and to a first terminal of a resistor 2723. A second terminal of the resistor 2723 is provided to the first filter output.

A second terminal of the resistor 2702 is provided to a first terminal of a resistor 2712 and to the pin P5. A second terminal of the resistor 2712 is provided to ground.

A second terminal of the resistor 2703 is provided to a first terminal of a resistor 2713 and to the pin P7. A second terminal of the resistor 2713 is provided to ground.

The pin P6 is provided to a first terminal of a capacitor 2724 and to a first terminal of a capacitor 2728. A second terminal of the capacitor 2728 is provided to a first terminal of a resistors 2725, to a first terminal of a resistor 2726, and to an inverting input of an opamp 2729. A non-inverting input of the opamp 2729 is provided to ground. An output of the opamp 2729 is provided to a second terminal of the capacitor 2724, to a second terminal of the resistor 2725, to a second terminal of the resistors 2726, and to a first terminal of a resistor 2730. The second terminal of the capacitor 2724 is provided to the pin P8. A second terminal of the resistor 2725 is provided to the pin P9. A second terminal of the resistor 2730 is provided to the second filter output.

The second filter output is a low-frequency output (e.g., 40 Hz) when pin P5 is shorted to pin P6 and pins P8 and P9 are open. The second filter output is a high-frequency output (e.g., 150 Hz) when Pin P7 is shorted to pin P6 and pin P8 is shorted to pin P9.

A second terminal of the resistor 2704 is provided to a first terminal of a resistor 2714, to a first terminal of a capacitor 2731 and to a first terminal of a capacitor 2735. A second terminal of the capacitor 2735 is provided to a first terminal of a resistor 2734 and to an inverting input of an opamp 2736. A non-inverting input of the opamp 2736 is provided to ground. An output of the opamp 2736 is provided to a second terminal of the capacitor 2731, to a second terminal of the resistor 2734 and to a first terminal of a resistor 2737. A second terminal of the resistor 2737 is provided to the third filter output.

In one embodiment, the first filter output is a bandpass filter centered at 100 Hz, the third filter output is a bandpass filter centered at 60 Hz, and the second filter output is a bandpass filter centered at either 40 Hz or 150 Hz (as described above).

In one embodiment, the resistor 2701 is 31.6 k ohms, the resistor 2702 is 56.2 k ohms, the resistor 2703 is 21 k ohms, the resistor 2704 is 37.4 k ohms, the resistor 2710 is 4.53 k ohms, the resistor 2712 is 13 k ohms, the resistor 2713 is 3.09 k ohms, the resistor 2714 is 8.87 k ohms, the resistor 2722 is 63.4 k ohms, the resistor 2723 is 100 k ohms, the resistor 2725 is 57.6 k ohms, the resistor 2726 is 158 k ohms, the resistor 2730 is 100 k ohms, the resistor 2734 is 107 k ohms, and the resistor 2737 is 100 k ohms. In one embodiment, the capacitors 2720, 2721, 2724, 2728, 2731, and 2735 are 0.1 uf. In one embodiment, the opamps 2732, 2729 and 2736 are TL074 types or equivalents thereof.

FIG. 28 is a schematic diagram of the compressor 2610. The compressor 2610 includes a peak detector 2804, a bias circuit 2802, a gain control block 2806, and an output buffer 2810. The peak detector is built around a diode 2810 and a diode 2811. The bias circuit is built around a transistor 2820 and a zener diode 2816. The gain control circuit is built around a FET 2814. The output buffer is built around an opamp 2824.

The input to the compressor 2610 is provided at the pin P10. The pin P10 is provided to a first terminal of a resistor 2827. A second terminal of the resistor 2827 is provided to a drain of the FET 2814 and to a first terminal of a resistor 2822. A second terminal of the resistor 2822 is provided to an inverting input of the opamp 2824 and to a first terminal of a resistor 2823. A non-inverting input of the opamp 2824 is provided to ground. An output of the opamp 2824 is provided to a second terminal of the resistor 2823 and to the pin P12. The pin P12 is the output of the compressor 2616.

The source of the FET 2814 is provided to ground. The gate of the FET 2814 is provided to a first terminal of a resistor 2813, to a first terminal of a resistor 2815, and to the pin P13. The pin P14 is provided to a second terminal of the resistor 2815.

The second terminal of the resistor 2813 is provided to the cathode of the diode 2811. The anode of the diode 2811 is provided to the cathode of the diode 2810 and to the pin P11. The anode of the diode 2810 is provided to a first terminal of a resistor 2812. A second terminal of the resistor 2812 is provided to the pin P114.

The pin P14 is also provided to a first terminal of a resistor 2818 and to the emitter of a PNP transistor 2820. A second terminal of the resistor 2818 is provided to ground. The base of the PNP transistor 2820 is provided to a first terminal of a resistor 2817 and to a first terminal of a resistor 2819. The second terminal of the resistor 2817 is provided to ground. The collector of the PNP transistor 2820 is provided to a second terminal of the resistor 2819, to the anode of the zener diode 2816, and to the pin P15. The cathode of the zener diode 2816 is provided to ground. The pin P15 is provided to allow a current limiting bias resistor to be connected between the zener diode and the negative power supply voltage.

The capacitor 2421 connected between pin P10 and P11 AC coupling of the input to the peak detector circuit. The capacitor 2420 connected between pins P13 and P14 provides a delay time constant for the onset of compression.

In one embodiment, the diodes 2810 and 2811 are 1N4148 types or equivalent. In one embodiment, the FET 2814 is a 2N3819 or equivalent, the PNP transistor 2820 is a 2N2907 or equivalent, and the zener diode 2816 is a 3.3 volt zener (1N746A or equivalent). In one embodiment, the opamp 2824 is a TL074 type or equivalent. The capacitor 2420 is a DC block, and the capacitor 2421 sets the compression delay. In one embodiment, the resistor 2812 is 1 k ohms, the resistor 2813 is 10 k ohms, the resistor 2815 is 100 k ohms, the resistor 2817 is 4.12 k ohms, the resistor 2818 is 1.2 k ohms, the resistor 2819 is 806 ohms, the resistor 2822 is 10 k ohms, the resistor 2827 is 1 k ohms and the resistor 2823 is 100 k ohms.

The gain control block 2806 operates as a voltage controlled voltage divider. The voltage divider is formed by the resistor 2827 and the drain-to-source resistance of the FET 2814. The drain-to-source resistance of the FET 2814 is controlled by the voltage applied to the gate of the FET 2814. The output buffer 2810 amplifies the voltage produced by the voltage controlled voltage divider (that is, the voltage at the drain of the FET 2814) and provides an output voltage at the pin P12. The bias circuit 2802 biases the FET 2814 into a linear operating region. The peak detect circuit 2804 detects the peak magnitude of the signal provided at the pin P10 and reduces the "gain" of the gain control 2806 (by changing the drain-to-source resistance of the FET 2814) in response to an increase in the peak magnitude.

Figure 29:
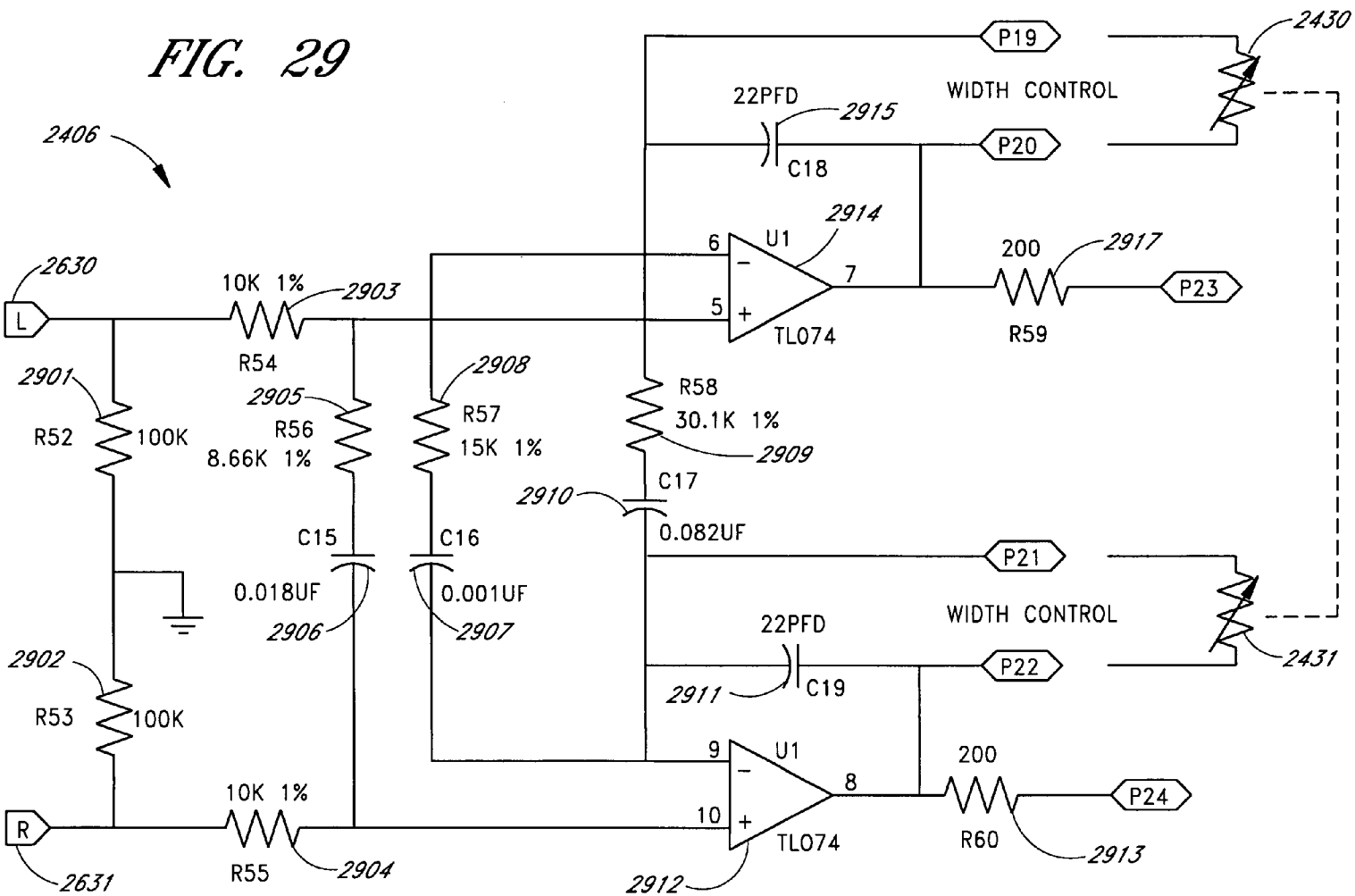
FIG. 29 is a schematic diagram of a horizontal image enhancement block suitable for use in the system shown in FIG. 24.

FIG. 29 is a schematic diagram of the horizontal image enhancement block 2406. In the block 2406, the left-channel signal 2630 from the bass module 2404 is provided to a first terminal of a resistor 2903 and to a first terminal of a resistor 2901. A second terminal of the resistor 2901 is provided to ground. The right-channel signal 2631 from the bass module 2404 is provided to a first terminal of a resistor 2904 and to a first terminal of a resistor 2902. A second terminal of the resistor 2902 is provided to ground.

A second terminal of the resistor 2903 is provided to a first terminal of a resistor 2905 and to a non-inverting input of an opamp 2914. A second terminal of the resistor 2904 is provided to a first terminal of a capacitor 2906 and to a non-inverting input of an opamp 2912. A second terminal of the capacitor 2906 is provided to a second terminal of the resistor 2905.

An inverting input of the opamp 2912 is provided to a first terminal of a capacitor 2911, to a first terminal of a capacitor 2907, to a first terminal of a capacitor 2910, and to the pin P21. An output of the opamp 2912 is provided to a first terminal of a resistor 2913, to the pin P22, and to a second terminal of the capacitor 2911.

An inverting input of the opamp 2914 is provided to a first terminal of a capacitor 2915, to the pin P19, to a first terminal of a resistor 2908, and to a first terminal of a resistor 2909. A second terminal of the resistor 2909 is provided to a second terminal of the capacitor 2910. A second terminal of the resistor 2908 is provided to a second terminal of the capacitor 2907. An output of the opamp 2914 is provided to a first terminal of a resistor 2917, to the pin P20, and to a second terminal of the capacitor 2915.

A second terminal of the resistor 2913 is provided to the pin P24 as a right-channel output. A second terminal of the resistor 2917 is provided to the pin P23 as a left-channel output. A variable resistor 2430 connected between the pins P19 and P20 controls the apparent spatial image width of the left channel. A variable resistor 2431 connected between the pins P21 and P22 controls the apparent spatial image width of the right channel. In one embodiment, the variable resistors 2930 and 2931 are mechanically connected such that varying one resistance also varies the other.

In one embodiment, the resistors 2901 and 2902 are 100 k ohms, the resistors 2903 and 2904 are 10 k ohms, the resistor 2905 is 8.66 k ohms, the resistor 2908 is 15 k ohms, the resistor 2909 is 30.1 k ohms, and the resistors 2917 and 2913 are 200 ohms. In one embodiment, the capacitor 2906 is 0.018 uf, the capacitor 2907 is 0.001 uf, the capacitor 2910 is 0.082 uf and the capacitors 2915 and 2911 are 22 pf. In one embodiment, the variable resistors 2430 and 2431 have a maximum resistance of 100 k ohms. In one embodiment, the opamps are TL074 types or equivalent.

Figure 30:
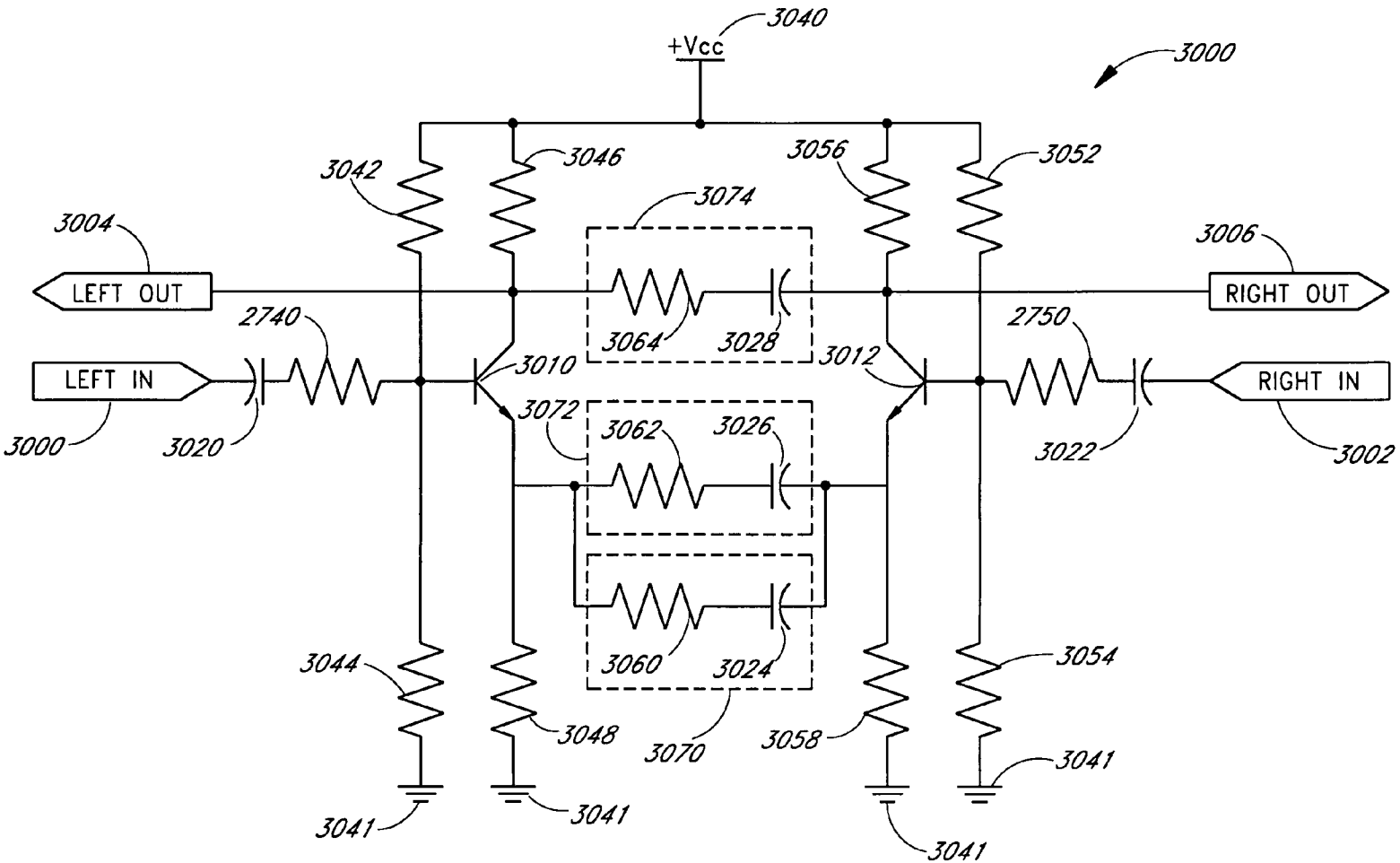
FIG. 30 is a schematic diagram of a differential perspective correction system that can be used as the stereo image enhancement system.

FIG. 30 is a schematic diagram of a correction system 3000, which can be used as the stereo image enhancement system 124. The system 3000 includes a differential amplifier, which provides a common-mode behavior 3020 and a differential-mode behavior 3022.

The system 3000 includes two transistors 3010 and 3012; multiple capacitors 3020, 3022, 3024, 3026 and 3028; and multiple resistors 3040, 3042, 3044, 3046, 3048, 3050, 3052, 3054, 3056, 3058, 3060, 3062 and 3064. Located between the transistors 3010 and 3012 are three crossover networks 3070, 3072 and 3074. The first crossover network 3070 includes the resistor 3060 and the capacitor 3024. The second crossover network 3072 includes the resistor 3062 and the capacitor 3026, and the third crossover network 3074 includes the resistor 3064 and the capacitor 3028.

A left input terminal 3000 (LEFT IN) provides a left input signal to the base of transistor 3010 through the capacitor 3020 and the resistor 3040. A power supply $V_{CC}$ 3040 is connected to the base of transistor 3010 through the resistor 3046. The power supply $V_{CC}$ 3040 is also connected to the collector of transistor 3010 through the resistor 3046. The base of the transistor 3010 is also connected to a ground 3041 through the resistor 3044 while the emitter of transistor 3010 is connected to the ground 3041 through the resistor 3048.

The capacitor 3020 is a decoupling capacitor that provides direct current (DC) isolation of the input signal at the left input terminal 3000. The resistors 3042, 3044, 3046 and 3048, on the other hand, create a bias circuit that provides stable operation of the transistor 3010. In particular, the resistors 3042 and 3044 set the base voltage of transistor 3010. The resistor 3046 in combination with the third crossover network 3074 together set the DC value of the collector-to-emitter voltage of the transistor 3010. The resistor 3048 in combination with the first and second crossover networks 3070 and 3072 together set the DC current of the emitter of the transistor 3010.

In one embodiment, the transistor 3010 is an NPN 2N2222A transistor which is commonly available from a wide variety of transistor manufacturers. The capacitor 3020 is 0.22 microfarads. The resistors 3040 is 22 kilohms (kohm), the resistor 3042 is 41.2 kohm, the resistor 3046 is 10 kohm, and the resistor 3048 is 6.8 kohm. One of ordinary skill in the art will recognize, however, that a variety of transistors, capacitors and resistors with different values can be used.

The right input terminal 3002 provides a right input signal to the base of the transistor 3012 through the capacitor 3022 and the resistor 3050. The power supply $V_{CC}$ 3040 is connected to the base of transistor 3012 through the resistor 3052. The power supply $V_{CC}$ 3040 is also connected to the collector of transistor 3012 through the resistor 3056. The base of the transistor 3012 is also connected to the ground 3041 through the resistor 3054 while the emitter of the transistor 3012 is connected to the ground 3041 through the resistor 3058.

The capacitor 3022 is a decoupling capacitor that provides direct current (DC) isolation of the input signal at the right input terminal 3002. The resistors 3052, 3054, 3056 and 3058, on the other hand, create a bias circuit that provides stable operation of the transistor 3012. In particular, the resistors 3052 and 3054 set the base voltage of transistor 3012. The resistor 3056 in combination with the third crossover network 3074 together set the DC value of the collector-to-emitter voltage of the transistor 3012. The resistor 3058 in combination with the first and second crossover networks 3070 and 3072 together set the DC current of the emitter of the transistor 3012.

In one embodiment, the transistor 3012 is an NPN 2N2222A transistor which is commonly available from a wide variety of transistor manufacturers. The capacitor 3022 is 0.22 microfarads. The resistors 3050 is 22 kilohms (kohm), the resistor 3052 is 41.2 kohm, the resistor 3056 is 10 kohm, and the resistor 3058 is 6.8 kohm. One of ordinary skill in the art will recognize however, that a variety of transistors, capacitors and resistors with different values can be used.

The system 3000 creates two types of voltage gains, a common-mode voltage gain and a differential voltage gain. The common-mode voltage gain is a change in the voltage that is common to both the left and right input terminals 3000 and 3002. The differential gain is a change in the output voltage due to the difference between the voltages applied to the left and right input terminals 3000 and 3002.

In the system 3000, the common-mode gain is designed to reduce clipping that may result from high-amplitude input signals. In one embodiment, the common-mode gain at the left output terminal 3004 is primarily defined by the resistors 3040, 3042, 3044, 3046 and 3048. In one embodiment, the common-mode gain is approximately six decibels.

The frequencies below approximately 30 hertz (Hz) are de-emphasized more than the frequencies above approximately 30 Hz. For frequencies above approximately 30 Hz, the frequencies are uniformly reduced by approximately 6 decibels.

The common-mode gain, however, may vary for or a given implementation by varying the values of the resistors 3040, 3042, 3044, 3050, 3052 and 3054. The differential gain between the left and right output terminals 3004 and 3006 is defined primarily by the ratio of the resistors 3046 and 3048, the ratio of the resistors 3056 and 3058, and the three crossover networks 3070, 3072 and 3074. As discussed in more detail below, one embodiment equalizes certain frequency ranges in the differential input. Thus, the differential gain varies based on the frequency of the left and right input signals.

Because the crossover networks 3070, 3072 and 3074 equalize the frequency ranges in the differential input, the frequencies in the differential signal can be altered without affecting the frequencies in the common-mode signal. As a result, one embodiment can create enhanced audio sound in an entirely unique and novel manner. Furthermore, the differential perspective correction apparatus 102 is much simpler and cost-effective to implement than many other audio enhancement systems.

Focusing now on the three crossover networks 3070, 3072 and 3074, the crossover networks 3070, 3072 and 3074 act as filters which spectrally shape the differential signal. A filter is usually characterized as having a cut-off frequency, which separates a passband of frequencies from a stopband of frequencies. The cut-off frequency is the frequency, which marks the edge of the passband and the beginning of the transition to the stopband. Typically, the cut-off frequency is the frequency, which is de-emphasized by three decibels relative to other frequencies in the passband. The passband of frequencies are those frequencies which pass through a filter with essentially no equalization or attenuation. The stopband of frequencies, on the other hand, are those frequencies, which the filter equalizes or attenuates.

Figure 31:
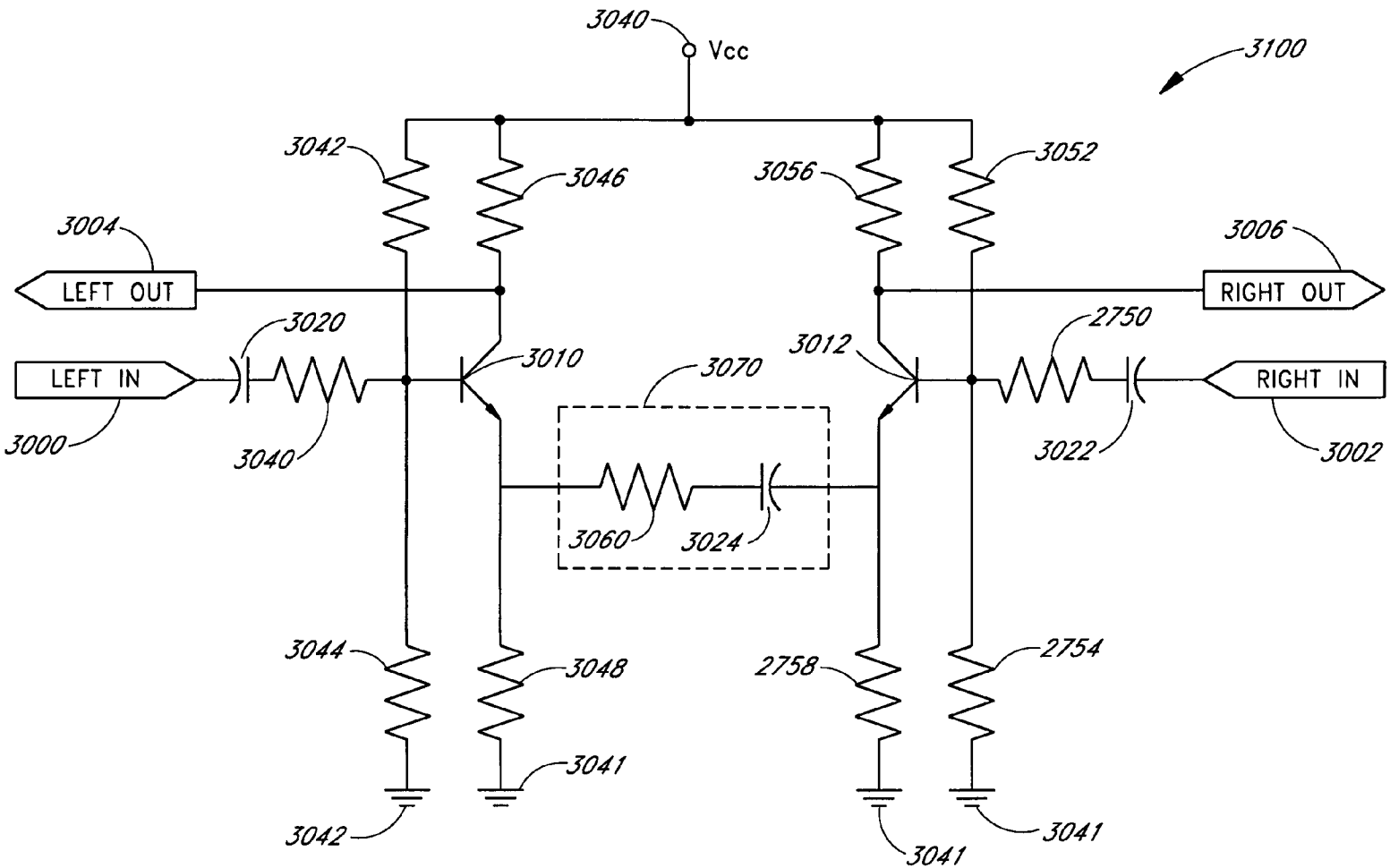
FIG. 31 shows a differential perspective correction system using one crossover network.

FIG. 31 shows one embodiment of the present invention with just the first crossover network 3070. The first crossover network 3070 comprises the resistor 3060 and the capacitor 3024, which interconnect the emitters of transistors 3010 and 3012. Because the first crossover network 3070 equalizes frequencies in the lower portion of the frequency spectrum, it is thus called a high-pass filter. In one embodiment, the value of the resistor 3060 is approximately 27.01 kohm and the value of the capacitor 3024 is approximately 0.68 microfarads.

The values of the resistor 3060 and the capacitor 3024 are selected to define a cut-off frequency in a low range of frequencies. In one embodiment, the cut-off frequency is approximately 78 Hz, a stopband below approximately 78 Hz and a passband above approximately 78 Hz. Frequencies below approximately 78 Hz are de-emphasized relative to frequencies above approximately 78 Hz. However, because the first crossover network 3070 is only a first-order filter, frequencies defining the cut-off frequency are design goals. The exact characteristic frequencies may vary for a given implementation. Furthermore, other values for the resistor 3060 and the capacitor 3024 can be chosen to vary the cut-off frequency in order to de-emphasize other desired frequencies.

Figure 32:
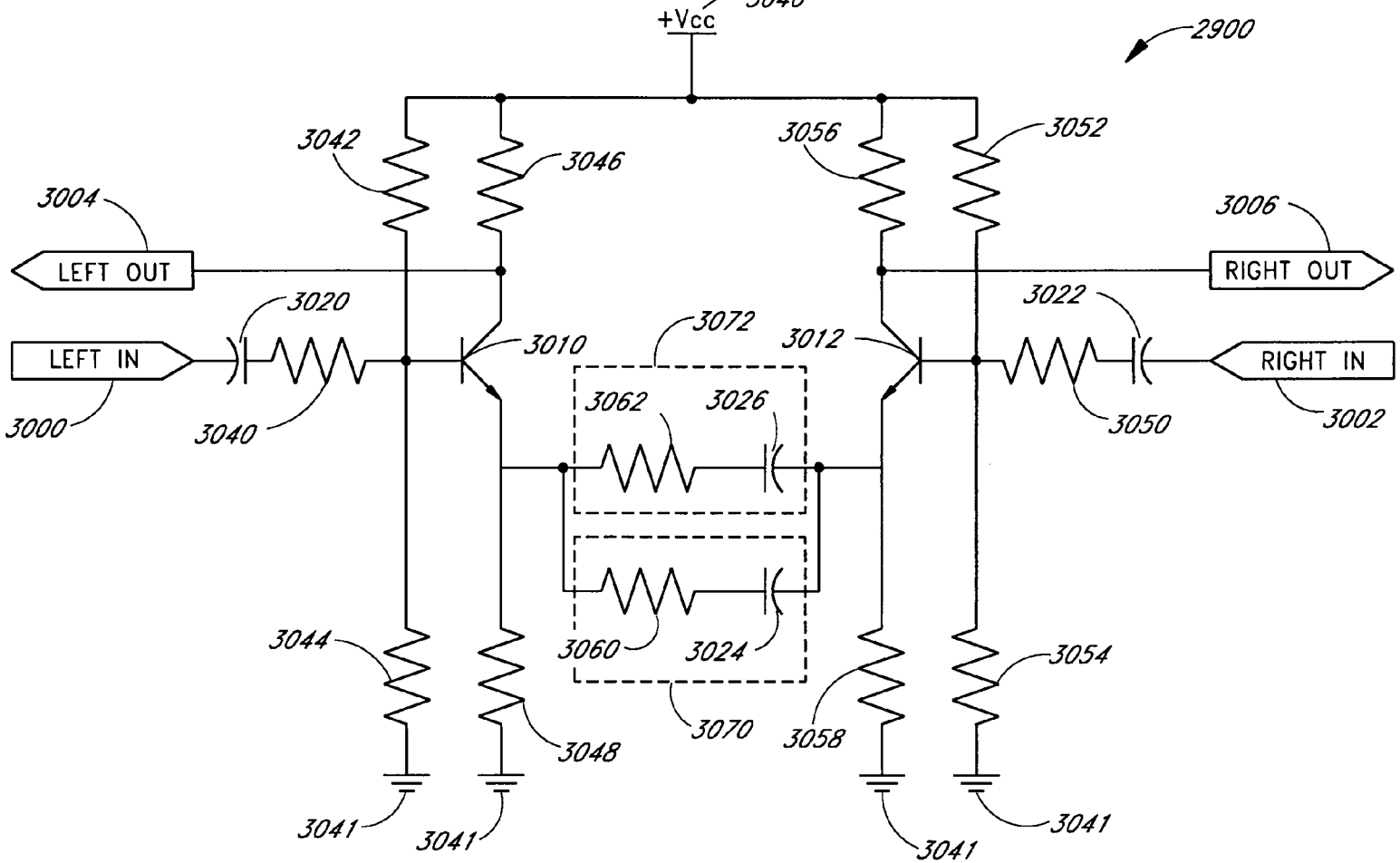
FIG. 32 is a schematic diagram of a differential perspective correction apparatus using two crossover networks.

FIG. 32 is a schematic diagram of a differential perspective correction apparatus 3200 with both the second and third crossover networks 3070 and 3072. Like the first crossover network 3070, the second crossover network 3072 is also preferably a filter, which equalizes certain frequencies in the differential signal. Unlike the first crossover network 3070, however, the second crossover network 3072 is a high-pass filter which also de-emphasizes lower frequencies in the differential signal relative to the higher frequencies in the differential signal.

As shown in FIG. 32, the second crossover network 3072 interconnects the emitters of transistors 3010 and 3012. In addition, the second crossover network 3072 comprises the resistor 3062 and the capacitor 3026. Preferably, the value of the resistor 3062 is approximately 1 kohm and the value of the capacitor 3026 is approximately 0.01 microfarads.

These values are selected to define a cut-off frequency in a high range of frequencies. In one embodiment, the cut-off frequency is approximately 15.9 kilohertz (kHz). Frequencies in the stopband below approximately 15.9 kHz are de-emphasized relative to frequencies in the passband above 15.9 kHz.

However, because the second crossover network 3072, like the first crossover network 3070, is a first-order filter, frequencies defining the passband are design goals. The exact characteristic frequencies may vary for a given implementation. Furthermore, other values for the resistor 3062 and capacitor 3026 can be chosen to vary the cut-off frequency so as to de-emphasize other desired frequencies.

Figure 33:
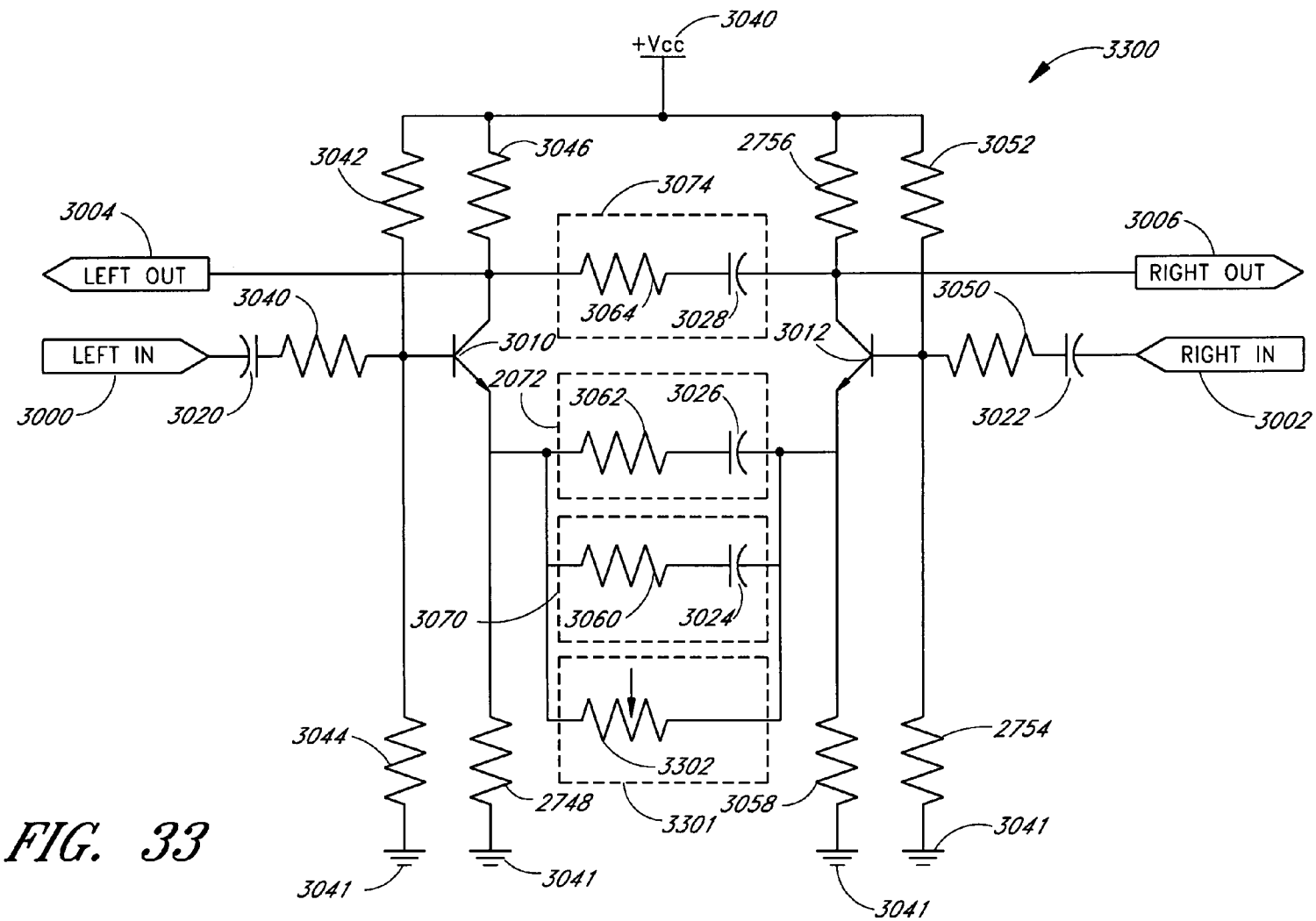
FIG. 33 shows a differential perspective correction apparatus that allows a user to vary the amount of overall differential gain.

Referring now to FIG. 33, the third crossover network 3074 interconnects the collectors of transistors 3010 and 3012. The third crossover network 3074 includes the resistor 3064 and the capacitor 3028 which are selected to create a low-pass filter which de-emphasizes frequencies above a mid-range of frequencies. In one embodiment, the cut-off frequency of the low-pass filter is approximately 795 Hz. Preferably, the value of resistor 3064 is approximately 9.09 kohm and the value of the capacitor 3028 is approximately 0.022 microfarads.

In the correction generated by the third crossover network 3074 frequencies in the stopband above approximately 795 Hz are de-emphasized relative to frequencies in the passband below approximately 795 Hz. As discussed above, because the third crossover network 3074 is only a first-order filter, frequencies defining the low-pass filter in the third crossover network 3074 are design goals. The frequencies may vary for or given implementation. Furthermore, other values for resistor 3064 and capacitor 3028 can be chosen to vary the cut-off frequency so as to de-emphasize other desired frequencies.

In operation, the first, second and third crossover networks 3070, 3072 and 3074 work in combination to spectrally shape the differential signal.

The overall correction curve 2300 (shown in FIG. 23) is defined by two turning points labeled as point A and point B. At point A, which in one embodiment is approximately 125 Hz, the slope of the correction curve changes from a positive value to a negative value. At point B, which in one embodiment is approximately 1.8 kHz, the slope of the correction curve changes from a negative value to a positive value.

Thus, the frequencies below approximately 125 Hz are de-emphasized relative to the frequencies near 125 Hz. In particular, below 125 Hz, the gain of the overall correction curve 2300 decreases at a rate of approximately 6 dB per octave. This de-emphasis of signal frequencies below 125 Hz prevents the over-emphasis of very low, (i.e., bass) frequencies. With many audio reproduction systems, over emphasizing audio signals in this low-frequency range relative to the higher frequencies can create an unpleasurable and unrealistic sound image having too much bass response. Furthermore, over emphasizing these frequencies may damage a variety of audio components, including the loudspeakers.

Between point A and point B, the slope of one overall correction curve is negative. That is, the frequencies between approximately 125 Hz and approximately 1.8 kHz are de-emphasized relative to the frequencies near 125 Hz. Thus, the gain associated with the frequencies between point A and point B decrease at variable rates towards the maximum-equalization point of −8 dB at approximately 1.8 kHz.

Above 1.8 kHz the gain increases, at variable rates, up to approximately 20 kHz, i.e., approximately the highest frequency audible to the human ear. That is, the frequencies above approximately 1.8 kHz are emphasized relative to the frequencies near 1.8 kHz. Thus, the gain associated with the frequencies above point B increases at variable rates towards 20 kHz.

These relative gain and frequency values are merely design objectives and the actual figures will likely vary from circuit to circuit depending on the actual value of components used. Furthermore, the gain and frequency values may be varied based on the type of sound or upon user preferences without departing from the spirit of the invention. For example, varying the number of the crossover networks and varying the resistor and capacitor values within each crossover network allows the overall perspective correction curve 2300 be tailored to the type of sound reproduced.

The selective equalization of the differential signal enhances ambient or reverberant sound effects present in the differential signal. As discussed above, the frequencies in the differential signal are readily perceived in a live sound stage at the appropriate level. Unfortunately, in the playback of a recorded performance the sound image does not provide the same 360-degree effect of a live performance. However, by equalizing the frequencies of the differential signal, a projected sound image can be broadened significantly so as to reproduce the live performance experience with a pair of loudspeakers placed in front of the listener.

Equalization of the differential signal in accordance with the overall correction curve 2300 is intended to de-emphasize the signal components of statistically lower intensity relative to the higher-intensity signal components. The higher-intensity differential signal components of a typical audio signal are found in a mid-range of frequencies between approximately 1 to 4 kHz. In this range of frequencies, the human ear has a heightened sensitivity. Accordingly, the enhanced left and right output signals produce a much-improved audio effect.

The number of crossover networks and the components within the crossover networks can be varied in other embodiments to simulate head related transfer functions (HRTF). Advantageously, an immersive sound effect can be positioned by applying HRTF-based transfer functions to the differential signal so as to create a fully immersive positional sound field.

FIG. 33 shows a differential perspective correction apparatus 3300 that allows a user to vary the amount of overall differential gain. In this embodiment, a fourth crossover network 3301 interconnects the emitters of transistors 3010 and 3012. In this embodiment, the fourth crossover network 3301 comprises a variable resistor 3302.

The variable resistor 3302 acts as a level-adjusting device and is ideally a potentiometer or similar variable-resistance device. Varying the resistance of the variable resistor 3302 raises and lowers the relative equalization of the overall perspective correction circuit. Adjustment of the variable resistor is typically performed manually so that a user can tailor the level and aspect of the differential gain according to the type of sound reproduced, and based on the user's personal preferences. Typically, a decrease in the overall level of the differential signal reduces the ambient sound information creating the perception of a narrower sound image.

Figure 34:
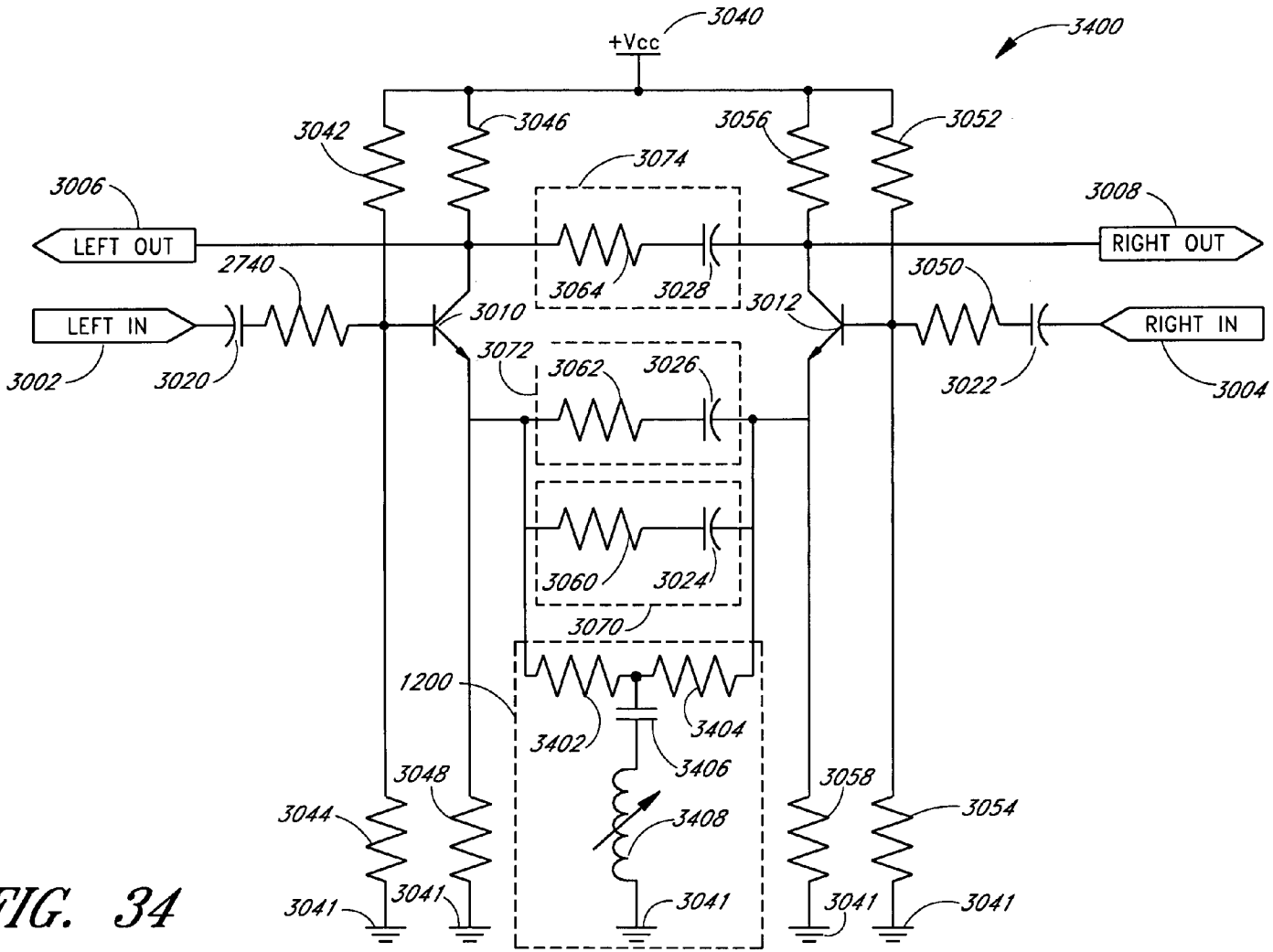
FIG. 34 illustrates a differential perspective correction apparatus that allows a user to vary the amount of common-mode gain.

FIG. 34 illustrates a differential perspective correction apparatus 3400 that allows a user to vary the amount of common-mode gain. The differential perspective correction apparatus 3400 includes contains a fourth crossover network 3401. The fourth crossover network 3401 includes a resistor 3402, a resistor 3404, a capacitor 3406 and a variable resistor 3408. The capacitor 3406 removes the differential information and allows the variable resistor and resisters 3402 and 3404 to vary the common-mode gain.

The resisters 3402 and 3404 can be a wide variety of values depending on the desired range of common-mode gain. The variable resistor 3408, on the other hand, acts as a level-adjusting device, which adjusts the common-mode gain within the desired range. Ideally, the variable resistor 3408 is a potentiometer or similar variable-resistance device. Varying the resistance of the variable resistor 3408 affects both transistors 3010 and 3012 equally and thereby raises and lowers the relative equalization of the overall common-mode gain.

Adjustment of the variable resistor is typically performed manually so that a user can tailor the level and aspect of the common-mode gain. An increase in the common-mode gain emphasizes the audio information, which is common to both input signals 3002 and 3004. For example, increasing the common-mode gain in a sound system will emphasize the audio information at the center stage positioned between a pair of loudspeakers.

Figure 35:
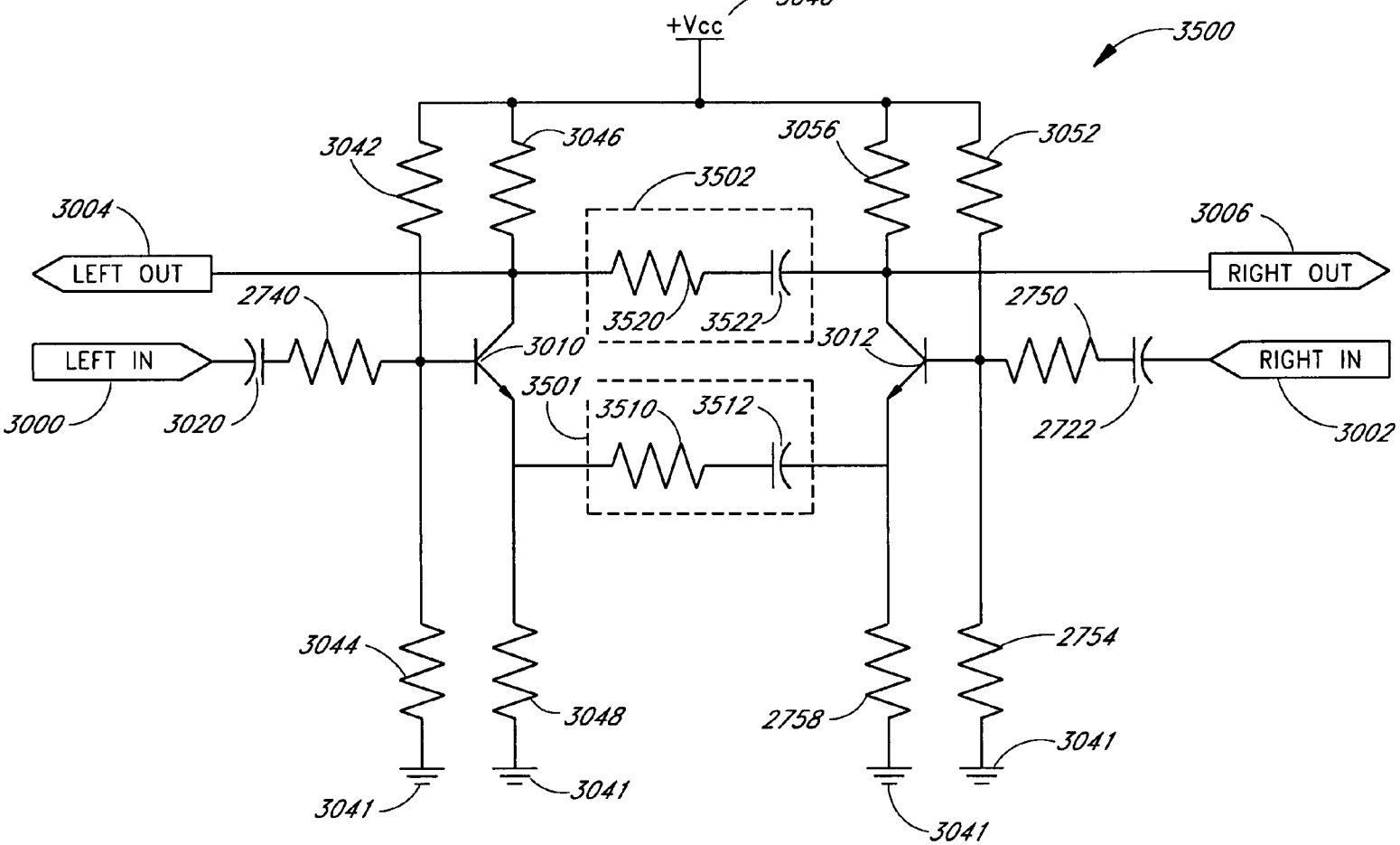
FIG. 35 illustrates a differential perspective correction apparatus that has a first crossover network located between the emitters of the transistors of a differential pair and a second crossover network located between the collectors of the differential pair.

FIG. 35 illustrates a differential perspective correction apparatus 3500 that has a first crossover network 3501 located between the emitters of transistors 3010 and 3012 and a second crossover network 3502 located between the collectors of transistors 3010 and 3012.

The first crossover network 3501 is a high-pass filter which de-emphasizes frequencies in the lower portion of the frequency spectrum. In this embodiment, the first crossover network 3501 comprises a resistor 3510 and a capacitor 3512. The values of the resistor 3510 and the capacitor 3512 are selected to define a high-pass filter with a cut-off frequency of approximately 350 Hz. Accordingly, the value of resistor 3510 is approximately 27.01 kohm and the value of the capacitor 3512 is approximately 0.15 microfarads. In operation, the frequencies below 30 Hz are de-emphasized relative to the frequencies above 350 Hz.

The second crossover network 3502 interconnects the collectors of transistors 3010 and 3012. The second crossover network 3502 is a low-pass filter which de-emphasizes frequencies in the lower portion of the frequency spectrum. In this embodiment, the second crossover network 3502 comprises a resistor 3520 and a capacitor 3522.

The values of the resistor 3520 and the capacitor 3522 are selected to define a low-pass filter with a cut-off frequency of approximately 27.3 kHz. Accordingly, the value of the resistor 3520 is approximately 9.09 kohm and the value of the capacitor 3522 is approximately 0.0075 microfarads. In operation, the frequencies above 27.3 kHz are de-emphasized relative to the frequencies below 27.3 kHz.

The first and second crossover networks 3501 and 3502 work in combination to spectrally shape the differential signal. The frequencies below approximately 5 kHz are de-emphasized relative to the frequencies near 5 kHz. In particular, below 5 kHz, the gain of the overall correction increases at a rate of approximately 5 dB per octave. Furthermore, above 5 kHz, the gain of the overall correction curve 1400 also decreases at a rate of approximately 5 dB per octave.

Figure 36:
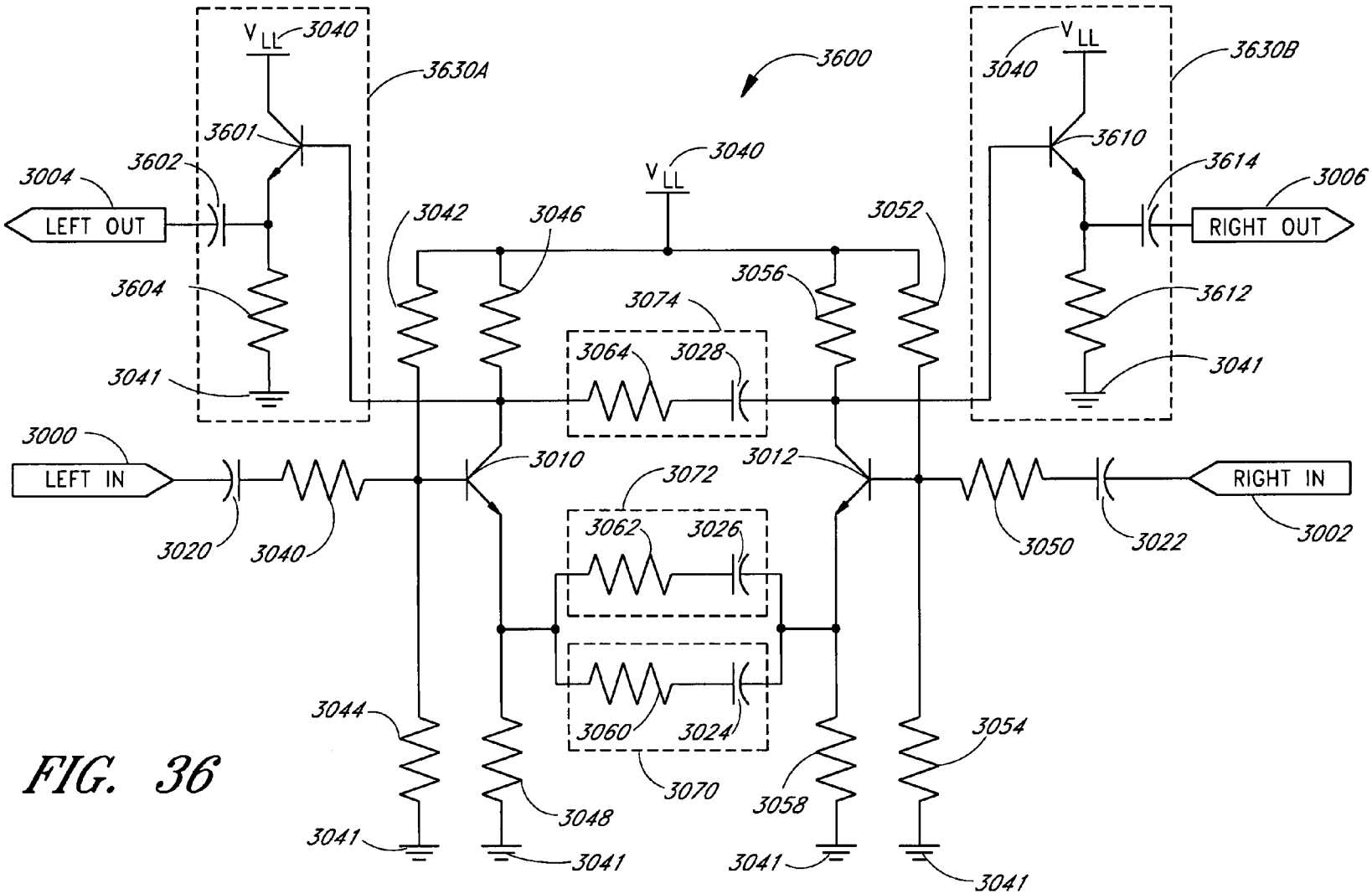
FIG. 36 shows a differential perspective correction apparatus with output buffers.

The above embodiments of a differential perspective correction apparatus can also include output buffers 3630 as illustrated in FIG. 36. The output buffers 3630 are designed to isolate the perspective correction differential apparatus from variations in the load presented by a circuit connected to the left and right output terminals 3004 and 3006. For example, when the left and right output terminals 3004 and 3006 are connected to a pair of loudspeakers, the impedance load of the loudspeakers will not alter the manner in which the differential perspective correction apparatus equalizes the differential signal. Accordingly, without the output buffers 3630, circuits, loudspeakers and other components will affect the manner in which the differential perspective correction apparatus 102 equalizes the differential signal.

In one embodiment, the left output buffer 3630A includes a left output transistor 3601, a resistor 3604 and a capacitor 3604. The power supply $V_{CC}$ 3040 is connected directly to the collector of transistor 3601. The collector of transistor 3601 is connected to the ground 3041 through the resistor 3604 and to the left output terminal 3004 through the capacitor 3602. In addition, the base of transistor 3601 is connected to the collector of transistor 3010.

In one embodiment, the transistor 3601 is an NPN 2N2222A transistor, the resistor 3604 is 1 kohms and the capacitor 3602 is 0.22 microfarads. The resistor 3604, the capacitor 3602 and the transistor 3601 create a unity gain. That is, the left output buffer 3630A primarily passes the enhanced sound signals to the left output terminal 3004 without further equalizing the enhanced sound signals.

Likewise, one right output buffer 3630B includes a right output transistor 3610, a resistor 3612 and a capacitor 3614. The power supply $V_{CC}$ 3040 is connected directly to the collector of the transistor 3610. The collector of transistor 3610 is connected to the ground 3041 through the resistor 3612 and to the right output terminal through the capacitor 3614. In addition, the base of transistor 3610 is connected to the collector of transistor 3012.

In one embodiment, the transistor 3610 is an NPN 2N2222A transistor, the resistor 3612 is 1 kohm and the capacitor 3614 is 0.22 microfarads. The resistor 3612, the capacitor 3614 and the transistor 3610 create a unity gain. That is, the right output buffer 3630B primarily passes the enhanced sound signals to the right output terminal 3006 without further equalizing the enhanced sound signals.

One skilled in the art will recognize that the output buffers 3630 can also be implemented using other amplifiers, such as, for example, opamps and the like.

Figure 37A:
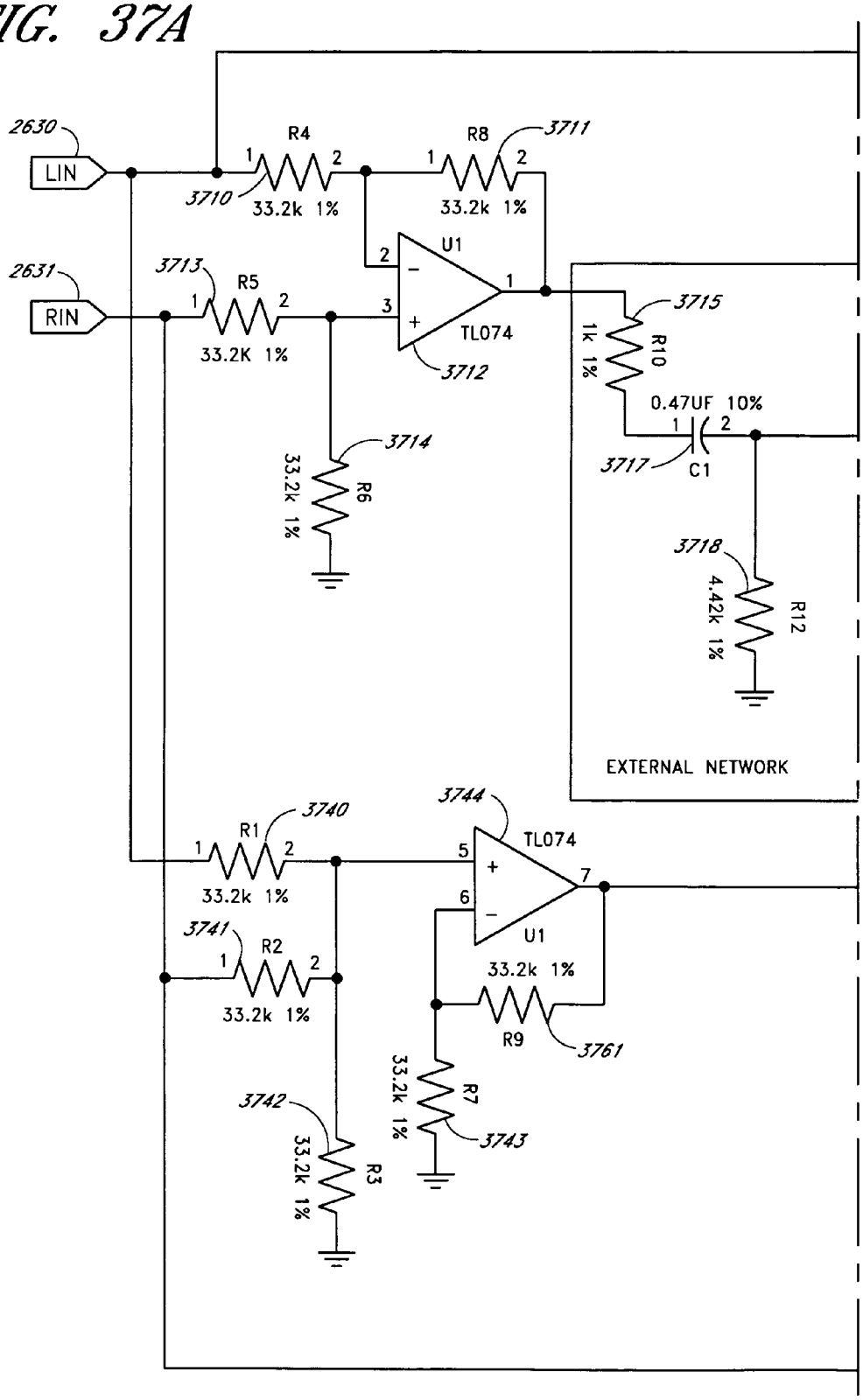
FIG. 37 shows a six opamp version of an image enhancement system.
Figure 37B:
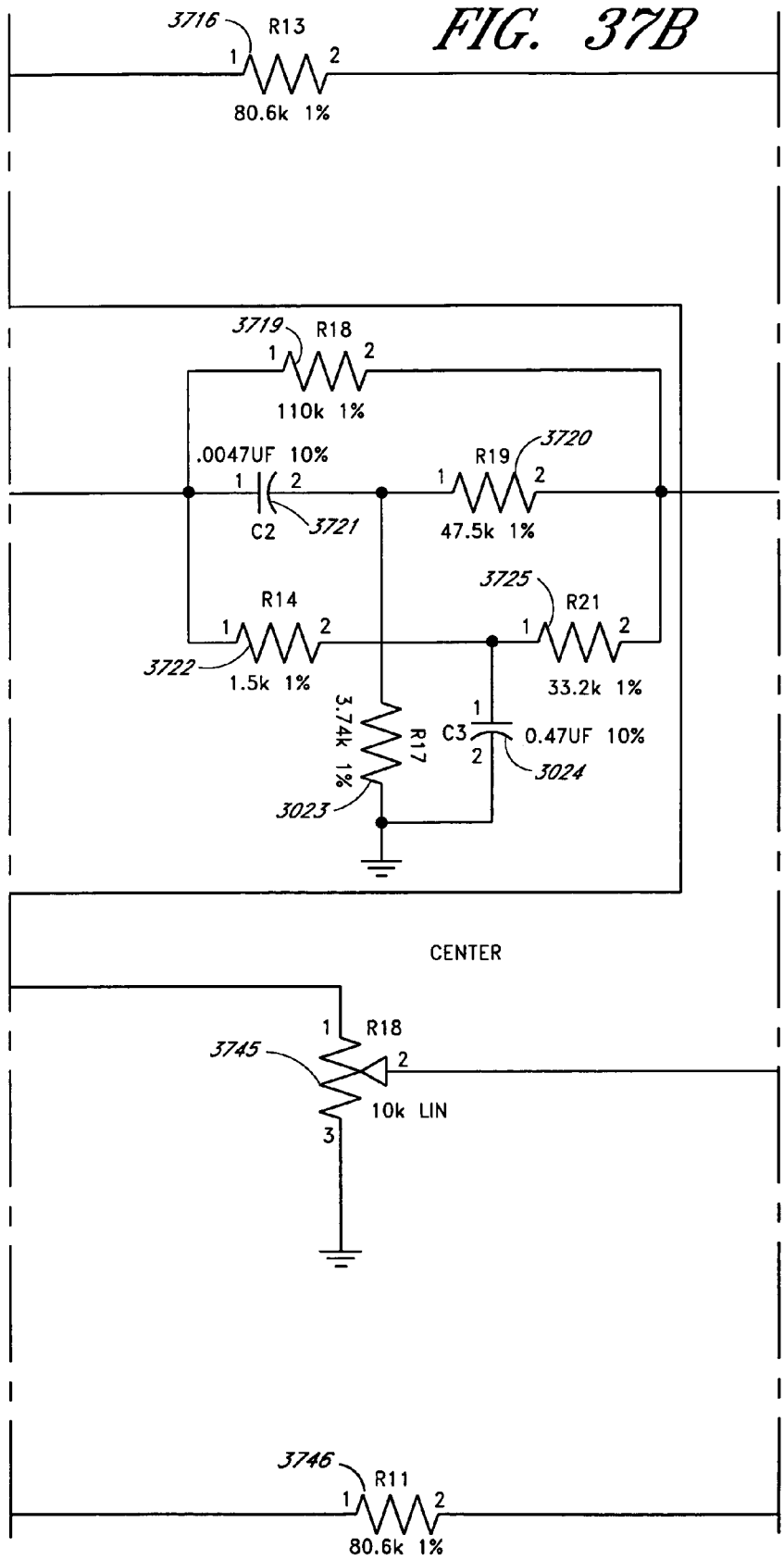
Figure 37C:
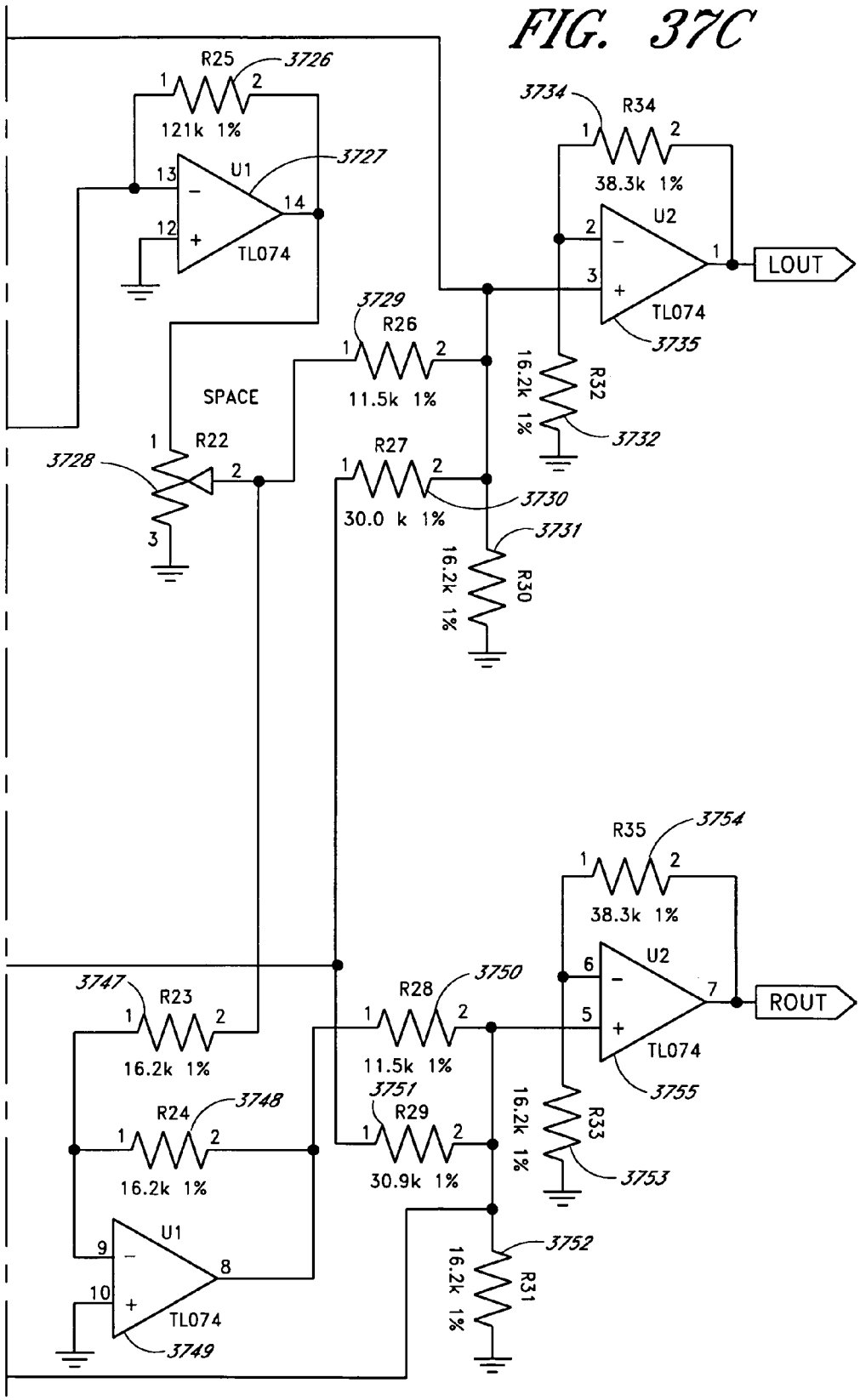

FIG. 37 shows yet another embodiment of the stereo image enhancement processor 124. In FIG. 37, the left input 2630 is provided to a first terminal of a resistor 3710, to a first terminal of a resistor 3716, and to a first terminal of a resistor 3740. The second terminal of the resistor 3710 is provided to a first terminal of a resistor 3711, and to an inverting input of an opamp 3712. The right input 2631 is provided to a first terminal of a resistor 3713, to a first terminal of a resistor 3741, and to a first terminal of a resistor 3746. The second terminal of the resistor 3713 is provided to a first terminal of the resistor 3714 and to a non-inverting input of the opamp 3712. The second terminal of the resistor 3714 is provided to ground. The second terminal of the resistor 3740 and a second terminal of the resistor 3741 are provided to a non-inverting input of the opamp 3744, and to a first terminal of the resistor 3742. The second terminal of the resistor 3742 provided to ground.

The output of the opamp 3744 in provided a first terminal of the resistor 3761. A second terminal of the resistor 3761 is provided to an inverting input of the opamp 3744. The second terminal of the resistor 3743 is provided to ground. Returning to the opamp 3712, an output of the opamp 3712 is provided to a second terminal of the resistor 3711. The output of the opamp 3712 is also provided in first terminal of the resistor 3715. The second terminal of the resistor 3715 provided to a first terminal of a capacitor 3717. A second terminal of the capacitor 3717 is provided to a first terminal of the resistor 3718, to a first terminal of the resistor 3719, to a first terminal of a capacitor 3721, and to a first terminal of a resistor 3722. The second terminal of the resistor 3718 provided ground. The second terminal of the resistor 3719 provided to a second terminal of the resistor 3720, and to the second terminal of the resistor 3725. The second terminal of the capacitor 3721 is provided to a first terminal of the resistor 3720 and to a first terminal of the resistor 33023. The second terminal of the resistor 3722 is provided to a first terminal of the resistor 3725 and to a first terminal of a capacitor 3724. The second terminal of the resistor 3023 and the second terminal of the capacitor 3024 are both provided to ground.

The second terminal of the resistor 3719 is also provided to a first terminal of a resistor 3726 and to an inverting input of an opamp 3727. A non-inverting input of the opamp 3727 is provided to ground. The second terminal of the resistor 3726 is provided to an output of the opamp 3727. The output of the opamp 3727 is provided to a first fixed terminal of a potentiometer 3728. A second fixed terminal of the potentiometer 3728 is provided ground. A wiper of the potentiometer 3728 is provided to the second terminal of a resistor 3747 and to a first terminal of a resistor 3729.

An output of the opamp 3744 is provided to a first fixed terminal of a potentiometer 3745. A second fixed terminal of the potentiometer 3745 is provided to ground. A wiper of the potentiometer 3745 is provided to the first terminal of the resistor 3730 and to a first terminal of the resistor 3751. A second terminal of the resistor 3747 is provided to a first terminal of a resistor 3748 and to an inverting input of an opamp 3749.

A non-inverting input of the opamp is 3749 provided to ground. An output of the opamp 3749 is provided to second terminal of the resistor 3748 and to the first terminal of the resistor 3750. The second terminal of the resistor 3750 is provided to a second terminal of the resistor 3729. A second terminal of the resistor 3730 provided to a non-inverting input of the opamp 3753. A first terminal of the resistor 3731 is also provided to the non-inverting input of the opamp 3735. The second terminal of the resistor 3731 is provided to ground. An inverting input of the opamp 3735 is provided to a first terminal of a resistor 3734 and to a first terminal of a resistor 3732. The second terminal of the resistor 3732 provided to ground. An output of the opamp 3735 provided to a second terminal of a resistor 3734. A second terminal of the resistor 3750, a second terminal of the resistor 3751, a second terminal of the resistor 3746, and a first terminal of a resistor 3752 are all provided to a non-inverting input of an opamp 3755. A second terminal of the resistor 3752 is provided to ground. A non-inverted input of the opamp 3755 is provided to a first terminal of a resistor 3753 and to a first terminal of a resistor 3754. An output of the opamp 3755 is provided to a second terminal of the resistor 3754.

The output of the opamp 3735 is provided as a left channel output and the output of the opamp 3755 is provided as a right channel output.

The resistors 3710, 3711, 3713, 3714, 3740, 3741, 3742, 3743, 37 and 3761 are all 33.2 K ohm resistors. The resistors 3716 and 3746 are both 80.6 K ohms. The potentiometers 3745 and 3728 are both 10.0K linear potentiometers. The resistor 3715 is 1.0K, the capacitor 3717 is 0.47 uf, the resistor 3718 is 4.42 K, the resistor 3719 is 121K, the capacitor 3721 is 0.0047 uf, the resistor 3720 is 47.5K, the resistor 3722 is 1.5K, the resistor 3723 is 3.74K, the resistor 3725 is 33.2K., and the capacitor 3724 is 0.47 uf. The resistor 3726 is a 121K. The resistors 3747 and 3748 are both 16.2 K. The resistors 3729 and 3750 are both 11.5 K. The resistors 3730 and 3751 are both 37.9 K. The resistors 3731, 3732, 3752, and 3753, are all 16.2K. The resistor 3734 and 3754 are both 38.3K. The opamps 3712, 3744, 3727, 3749, 3735, and 3755 are all TL074 types or equivalents.

Digital Signal Processor Implementation

The acoustic correction system can also be readily implemented in software as described in connection with FIG. 3. Suitable processors include general purpose processors, Digital Signal Processors (DSP), and the like.

Figure 38:
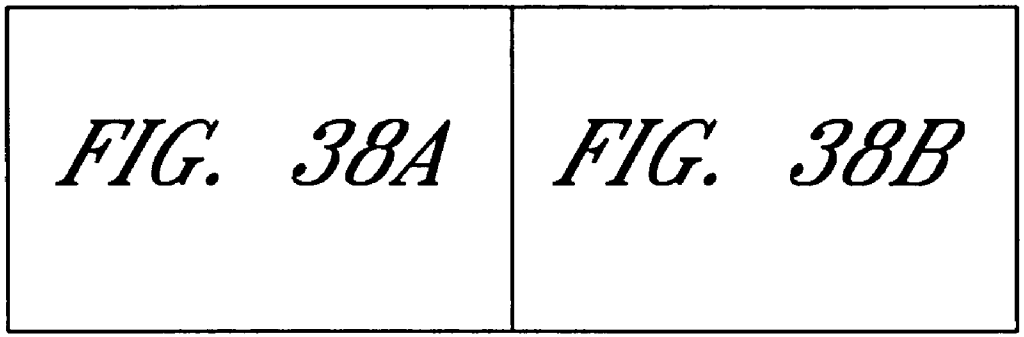
FIG. 38 is a block diagram of a software embodiment of the acoustic correction system.
Figure 38A:
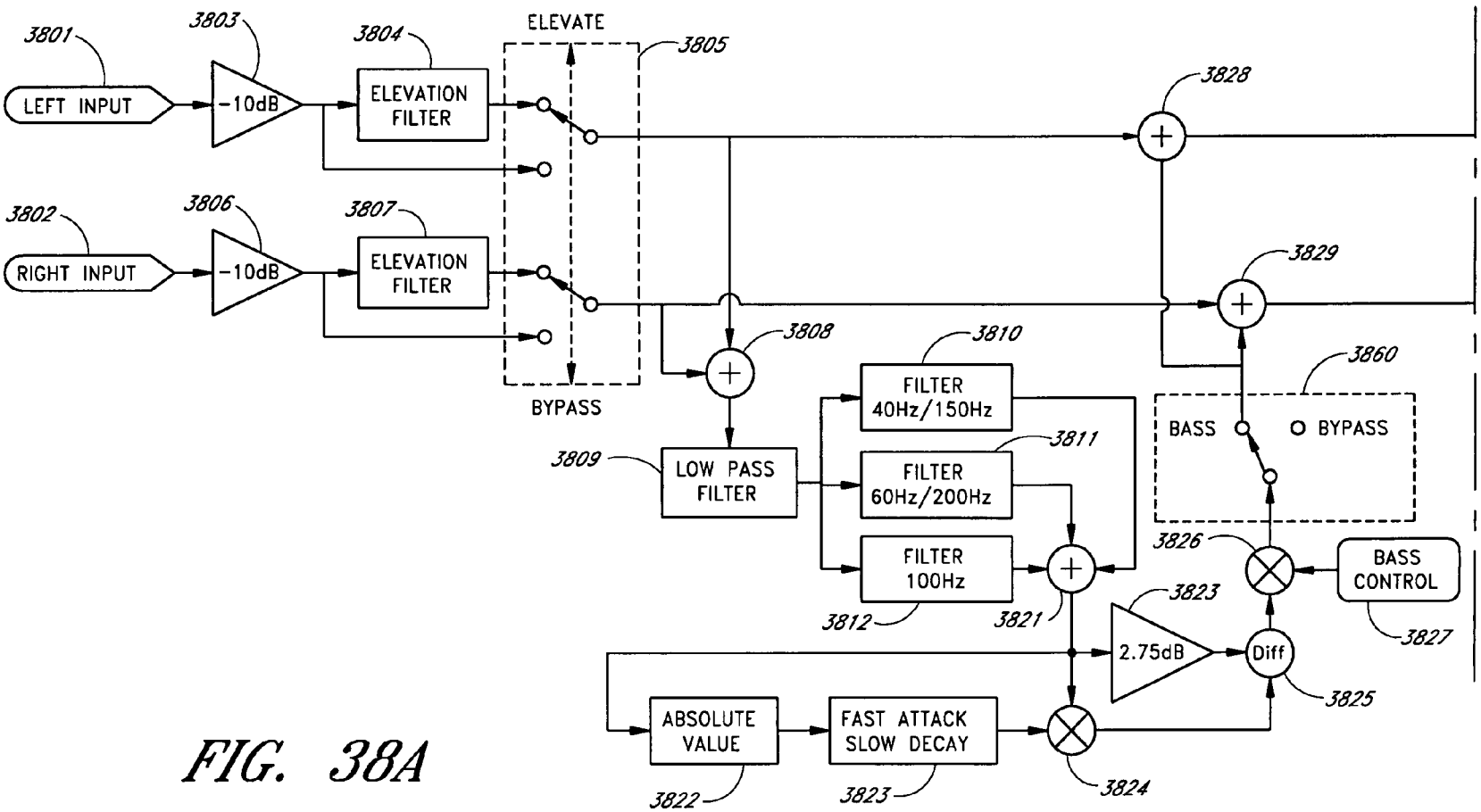
Figure 38B:
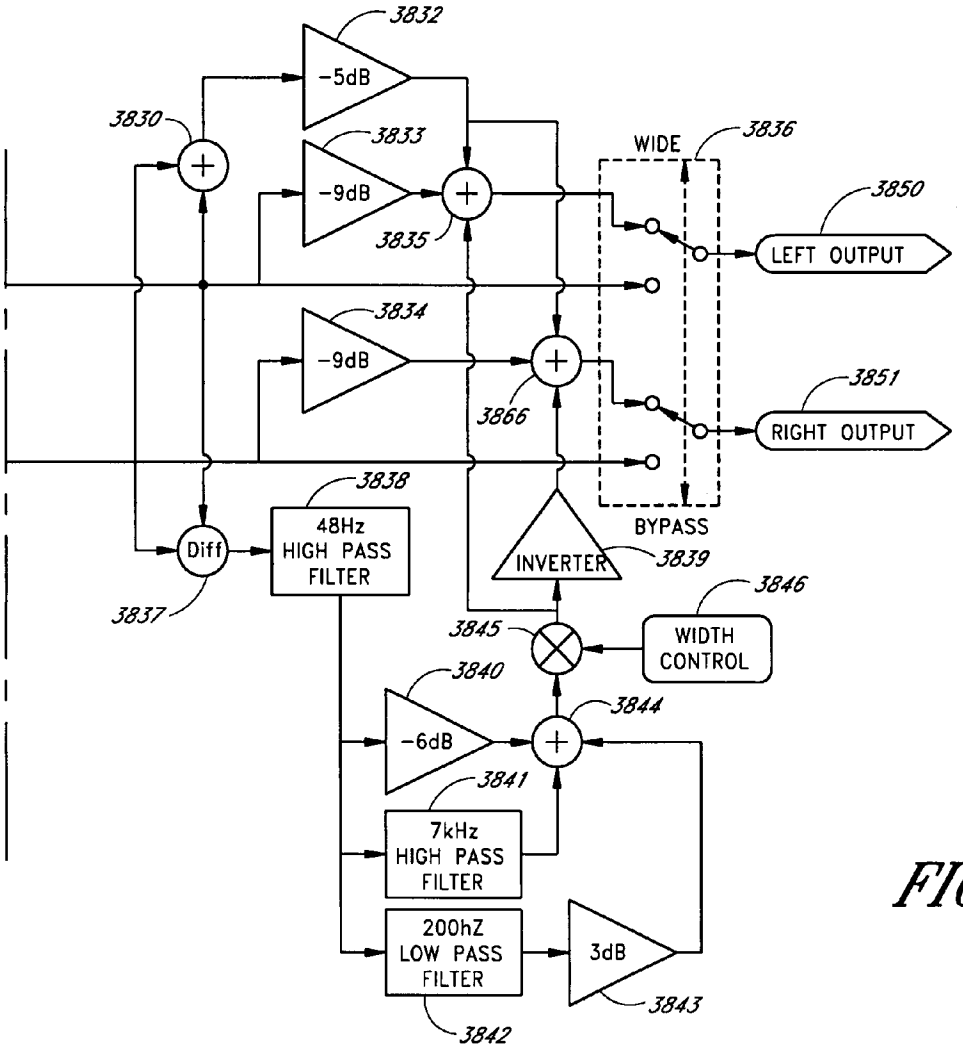
Figure 39:
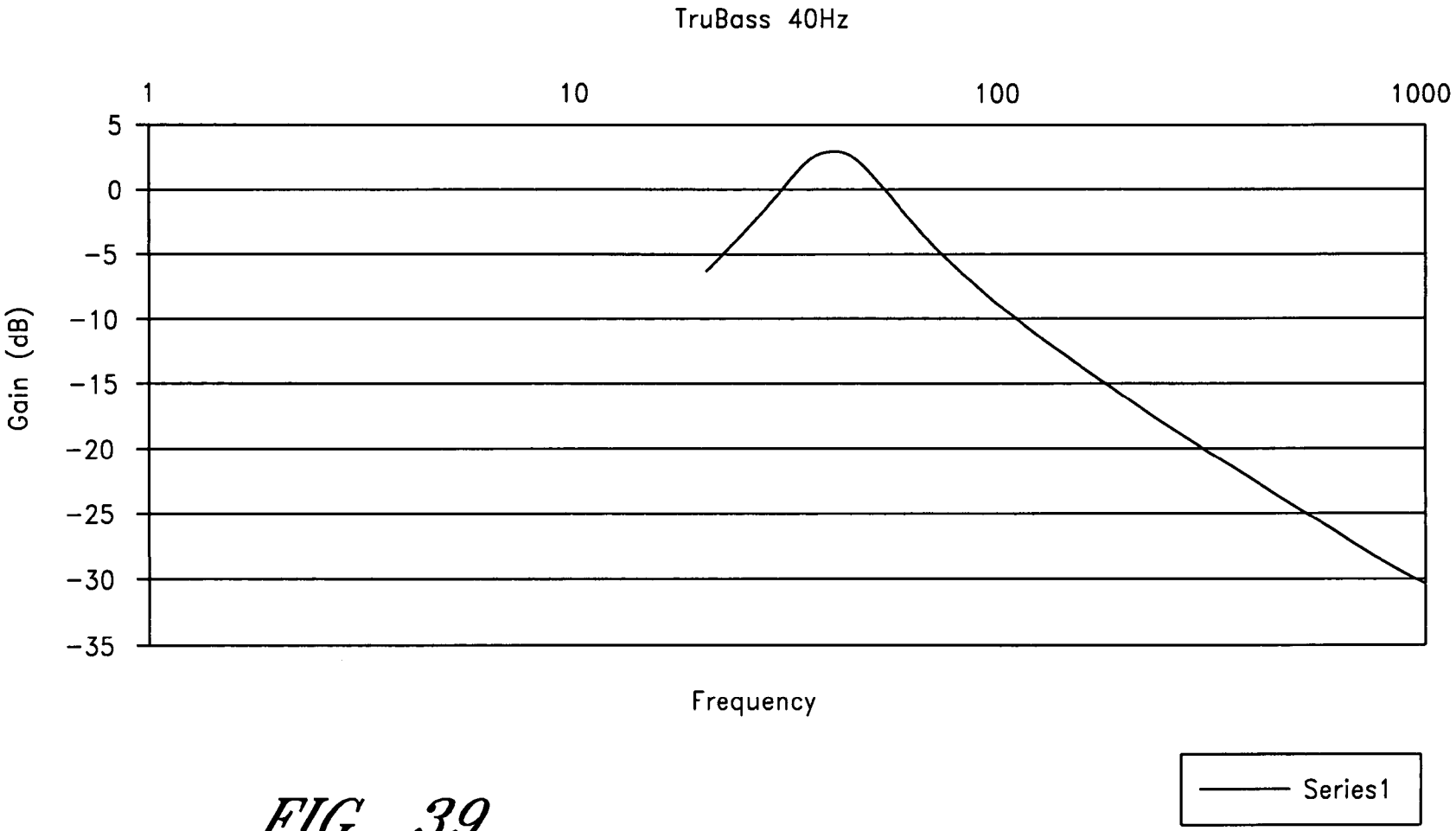
FIG. 39 is a plot of the transfer function of a 40 Hz bandpass filter for use with the block diagram shown in FIG. 38.
Figure 40:
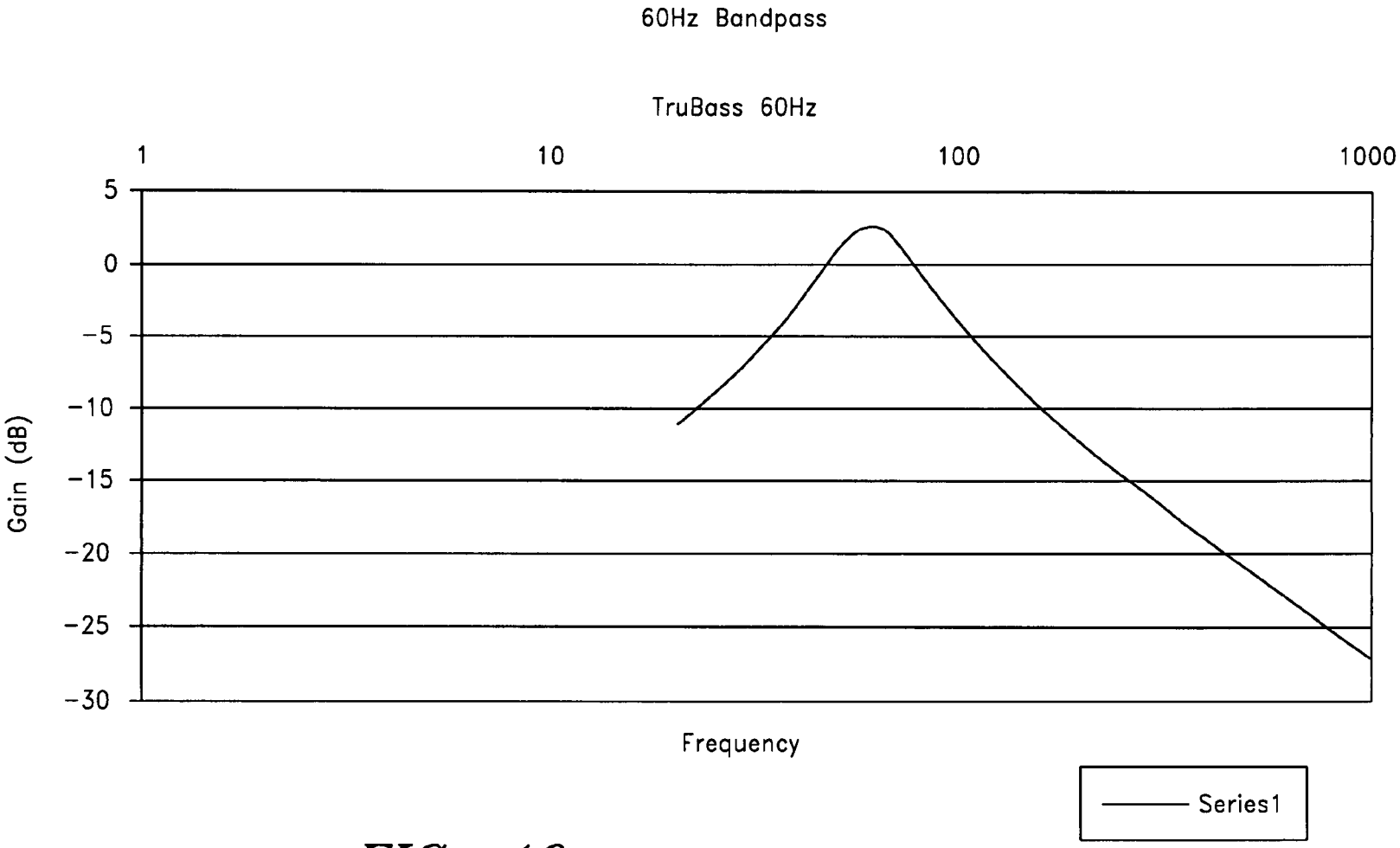
FIG. 40 is a plot of the transfer function of a 60 Hz bandpass filter for use with the block diagram shown in FIG. 38.
Figure 41:
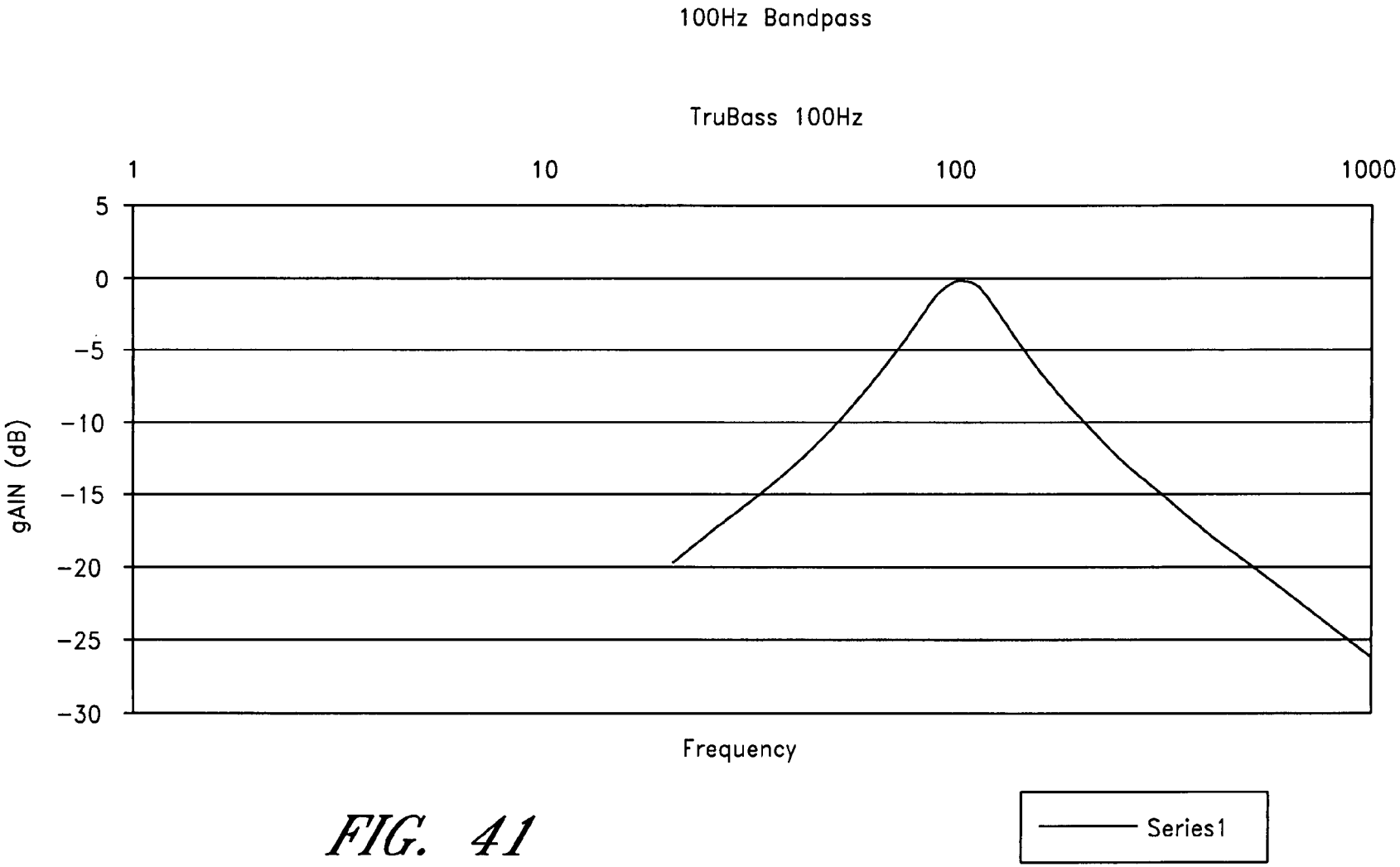
FIG. 41 is a plot of the transfer function of a 100 Hz bandpass filter for use with the block diagram shown in FIG. 38.
Figure 42:
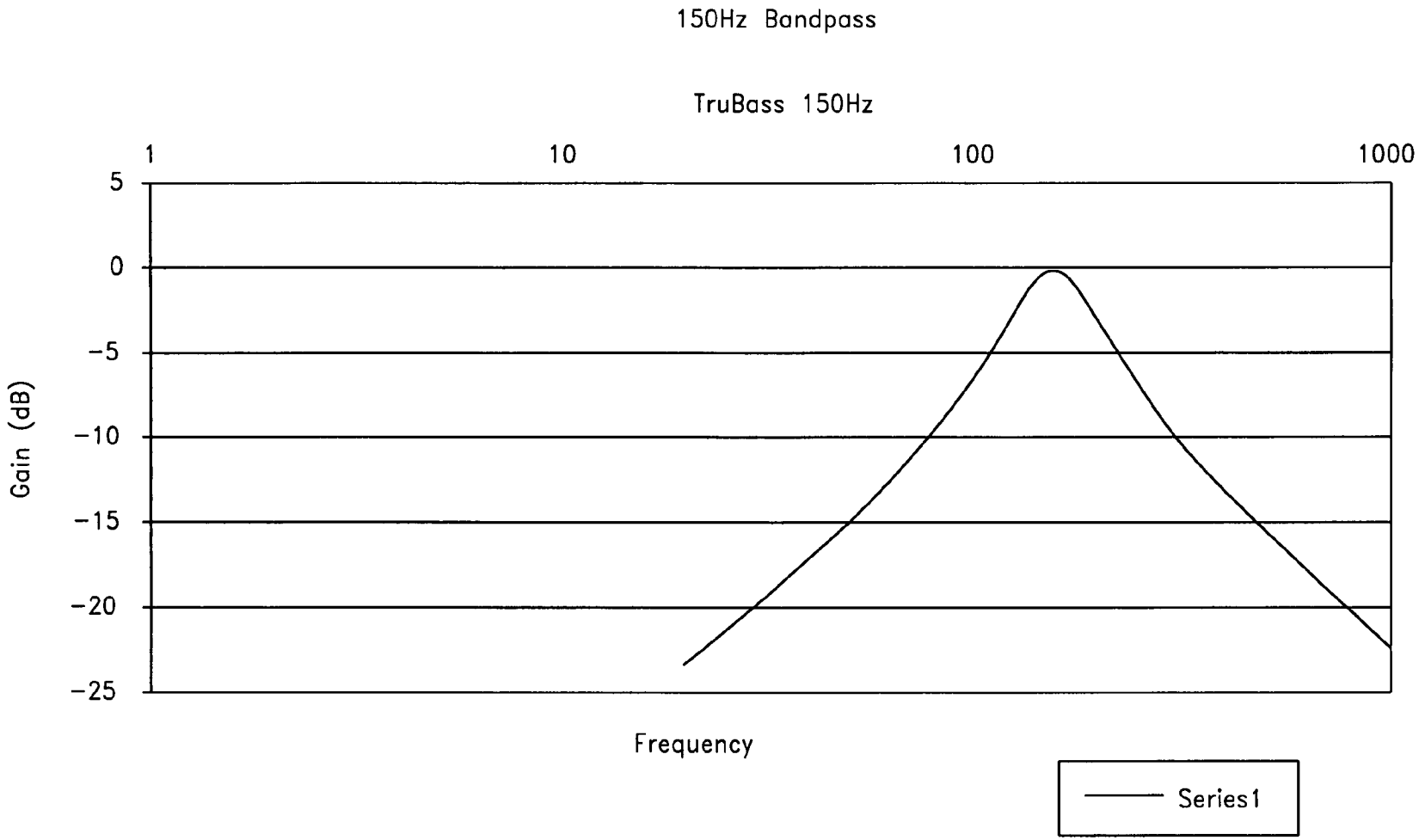
FIG. 42 is a plot of the transfer function of a 150 Hz bandpass filter for use with the block diagram shown in FIG. 38.
Figure 43:
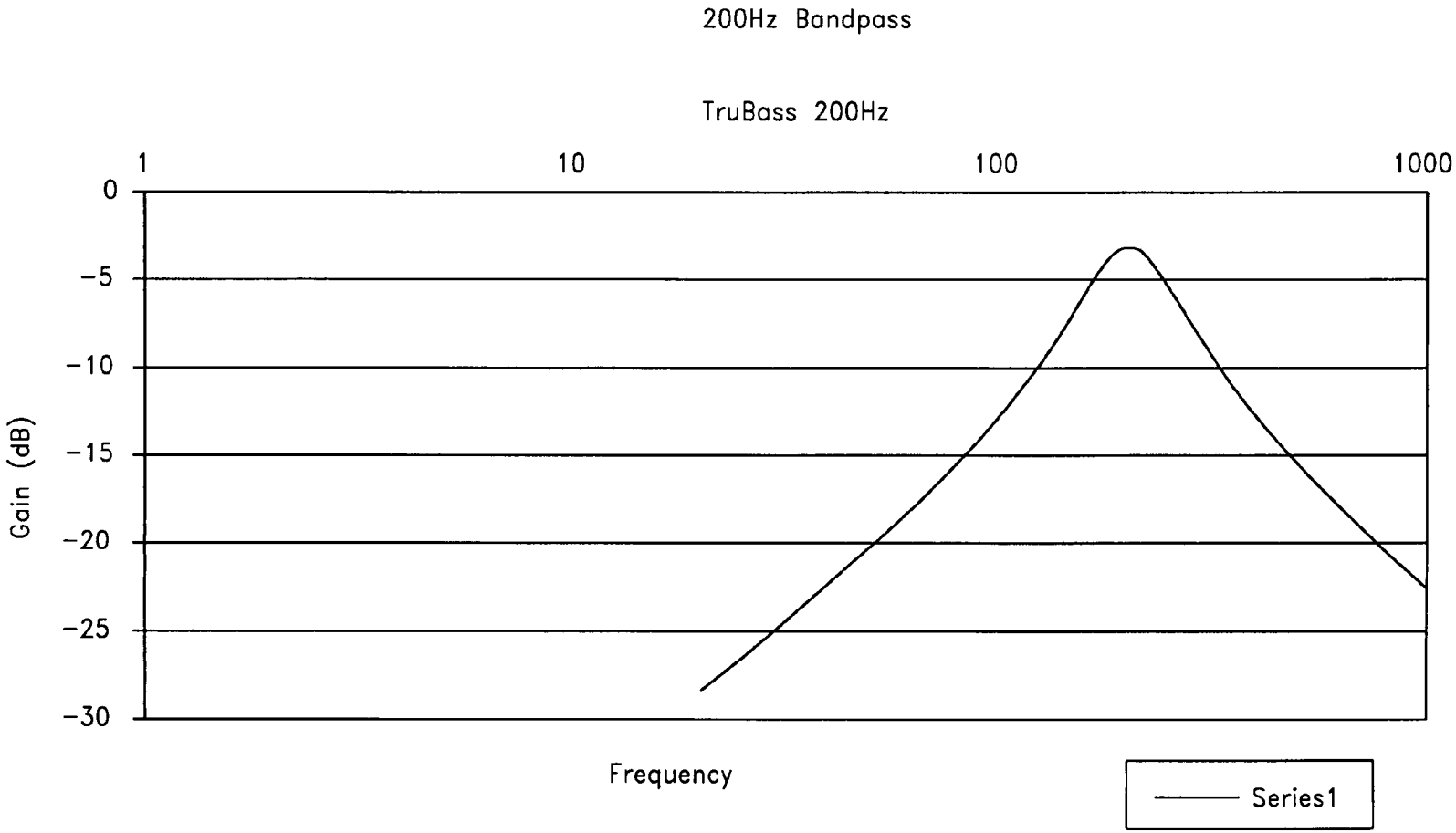
FIG. 43 is a plot of the transfer function of a 200 Hz bandpass filter for use with the block diagram shown in FIG. 38.

FIG. 38 is a block diagram of a software embodiment of the acoustic correction system 120. In FIG. 38, a left-channel input 3801 is provided in input of a 10 db attenuator 3803. An output of the attenuator 3803 is provided to an input of a filter 3804 and to a first throw of a DPDT switch 3805. An output of the filter 3804 is provided to a second throw of the switch 3805. A right-channel input 3802 is provided to an input of a 10 db attenuator 3806. An output of the attenuator 3806 provided to an input of a filter 3807, and to a first throw of the switch 3805. An output of the filter 3807 is provided a second throw of the switch 3805.

A first pole of the switch 3805 is provided to a first input of a summer 3828 and to a first input of a summer 3808. A second poll of the switch 3805 is provided to a first input of a summer 3829 and to a second input of the summer 3808. An output of the summer 3808 is provided to an input of the low pass filter 3809. An output of the low pass filter 3809 is provided to an input of a dual-band bandpass filter 3810, to an input of a dual-band bandpass filter 3811 and to an input of a 100 Hz band pass filter 3812.

An output of the filter 3810 is provided to a first input of a summer 3821, an output of the filter 3811 is provided the second input of the summer 3821, and an output of the filter 3812 provided to a third input of the summer 3812. An output of the summer 3821 is provided to an input of a 2.75 dB amplifier 3863, to a first input of a multiplier 3824, and to an input of an absolute-value block 3822. An output of the absolute-value block 3822 is provided in input of a Fast Attack Slow Decay (FASD) compressor 3823. An output of the FASD compressor 3823 is provided to a second input of the multiplier 3824.

An output of the amplifier 3863 is provided to a positive input of a subtractor 3825. An output of the multiplier 3824 provided to a negative input of the subtractor 3825. An output of the subtractor 3825 is provided to a first input of a multiplier 3826. An output of a bass control 3827 is provided to second input of the multiplier 3826. An output of the multiplier 3826 is provided through a SPDT switch 3860 to a second input of the summer 3828 and to a second input of the summer 3829.

An output of the summer 3828 is provided to a first input of a summer 3830, to an input of a 9 dB attenuator 3833, to a positive input of a subtractor 3837, and to a first throw of a DPDT switch 3836. An output of the summer 3829 is provided to a negative input of the subtractor 3837, to a second input of the summer 3830, to a input of a 9 db attenuator 3834, and to a first throw of the switch 3836.

Output of the summer 3830 provided an input of a 5 dB attenuator 3832. An output the attenuator 3832 provided to first input of a summer 3835 and to a first input of a summer 3866. An output of the attenuator 3833 is provided to a second input of the summer 3835. An output of the attenuator 3834 is provided to a second input of the summer 3866. An output of the summer 3835 provided to a second throw of the switch 3836. An output of the summer 3866 is provided to a second throw of the switch 3836.

An output of this subtractor 3837 is provided to an input of a 48 Hz highpass filter 3838. An output of the high pass filter 3838 is provided to an input of a 6 dB attenuator 3840, to an input of a 7 kHz highpass filter 3841, and to an input of a 200 Hz lowpass filter 3842. An output of the attenuator 3840 is provided the first input of a summer 3844, an output of the highpass filter 3841 is provided to a second input of the summer 3844, and an output of the low pass filter 3842 is provided through a 3 db attenuator 3843 to a third input of the summer 3844. An output of the summer 3844 is provided to a first input of a multiplier 3845. An output of a width control 3846 is provided to a second input of the multiplier 3845. An output of the multiplier 3845 is provided to a third input of the summer 3835, and through an inverter (i.e., a gain of −1) to a third input of the summer 3866.

The first pole of the switch 3836 provided to a left channel output 3850. A second pole of the switch 3836 is provided to a right output 3851.

As shown in FIG. 38, left and right stereo input signals are provided to left and right inputs 3801 and 3802 respectively. For the bass enhancement portion of the processing (corresponding to the bass enhancement block 101 shown in FIG. 1), the left and right channels are added together by the summer 3808, processed as a monophonic signal, then added back into left and right channels by the summers 3828 and 3829 to form an enhanced stereo signal. The bass information is processed as a monophonic signal because there is typically little stereo separation in a bass frequency signal, so there is little need to duplicate the processing for the two channels.

FIG. 38 shows software user controls including: a software control 3827 to control the amount of bass enhancement, a software control 3846 to control the width of the apparent sound stage, as well as software switches 3805, 3860, and 3836 to individually enable or disable the vertical, bass, and width image enhancements respectively. Depending on the application, these user controls can be either dynamically changeable or fixed to a specific configuration. The user controls can be "connected" to controls such as sliders, check boxes, and the like, in dialog box to allow the user to control the operation of the acoustic correction system.

In FIG. 38, the left and right inputs 3801 and 3802 are first processed with a gain of −10 dB to set the bypass level and prevent the signal from saturating during the processing that follows. Each channel is then processed through an elevation filter (filters 3804 and 3807 for left and right respectively) that performs the soundstage elevation and expansion as described in connection with FIGS. 4–6.

After the elevation filters, the left and right channels are mixed together and routed through the low pass filter 3809 followed by the bank of bandpass filters 3810–3812. The low pass filter 3809 has a cutoff frequency of 284 Hz. Each of the following three filters 3810–3812 is a second order band pass filter. The filter 3810 is selectable as either 40 Hz or 150 Hz. The filter 3811 is selectable as either 60 Hz or 200 Hz. Thus, there are three useful configurations for speaker size: small, medium and large. All three configurations use the three band pass filters, but with different center frequencies for the filters 3810 and 3811.

The outputs of the three active filters are then summed together by the summer 3821 and the sum is provided to the bass control stage.

The bass control stage includes an expander circuit having the absolute value detector 3822, the fast attack slow decay peak detector 3823 and the multiplier 3824. The output of the peak detector 3823 is used as a multiplier for the expander input signal to expand the dynamic range of the signal.

The second part of the bass control stage subtracts an expanded version of the stage's input signal from the same input signal with a 2.75 dB gain applied by the amplifier 3863. This has the effect of limiting the level of high amplitude signals while adding a small constant gain to lower amplitude signals.

The output of the bass control stage is added into both the left channel signal and the right channel signal by the summers 3828 and 3829 respectively. The amount of enhanced bass signal that is mixed into the left and right channels is determined by the Bass Control 3827.

The resulting left and right channel signals are then summed together by the summer 3830 to form a L+R signal, and subtracted by the subtractor 3837 to form a L−R signal. The L−R signal is shaped spectrally by processing it through the perspective curve (see FIG. 7), which is implemented with a network of filters and gain adjustments as follows. First, the signal passes through the 48 Hz high pass filter 3838. The output of this filter is then split and passed through the 7 kHz high pass filter 3841 and the 200 Hz low pass filter 3842. Then the three filter outputs are summed together by the summer 3844 to form the perspective curve signal, using the following gain adjustments: −6 dB for the 48 Hz high pass filter 3838, 0 dB (no adjustment) for the 7 kHz high pass filter 3841 and +3 dB for the 200 Hz low pass filter 3842. The Width Control 3846 determines the amount of perspective curve signal that is passed through to the final summers 3835 and 3866.

Finally, the left channel, right channel, L+R and L−R signals are mixed together by the summers 3835 and 3866 to produce the final left and right channel outputs respectively. The left channel output is formed by mixing the L+R signal with a −5 dB gain adjustment, the left channel signal with a −9 dB gain adjustment, and the perspective curve signal with no gain adjustment other than the gain adjustment provided by the Width Control 3846. The right channel output is formed by mixing the L+R signal with a −5 dB gain adjustment, the right channel with a −9 dB gain adjustment, and an inverted perspective curve signal with no gain adjustment other than the Width Control.

The algorithm for the Fast Attack Slow Decay (FASD) Peak Detector 3823 is represented in pseudocode as follows:

```
if [in >out(previous)] then
    out=in −[[in−out(previous)]*attack]
else
    out=in +[[out(previous)−in]*decay]
endif
```

Where out(previous) represents the output from the previous sample period.

The values for attack and decay are sample-rate dependent since the slew rates must be correlated to real time. The formulas for each are provided below:

```
attack=1−(1/(0.01*sampleRate))

decay=1−(1/(0.1*sampleRate))
```

Where sample rate is in samples/second.

The input to the FASD Peak Detector 3123 is always greater than or equal to zero, since it comes from the output of the absolute value function 3122.

Figure 44:
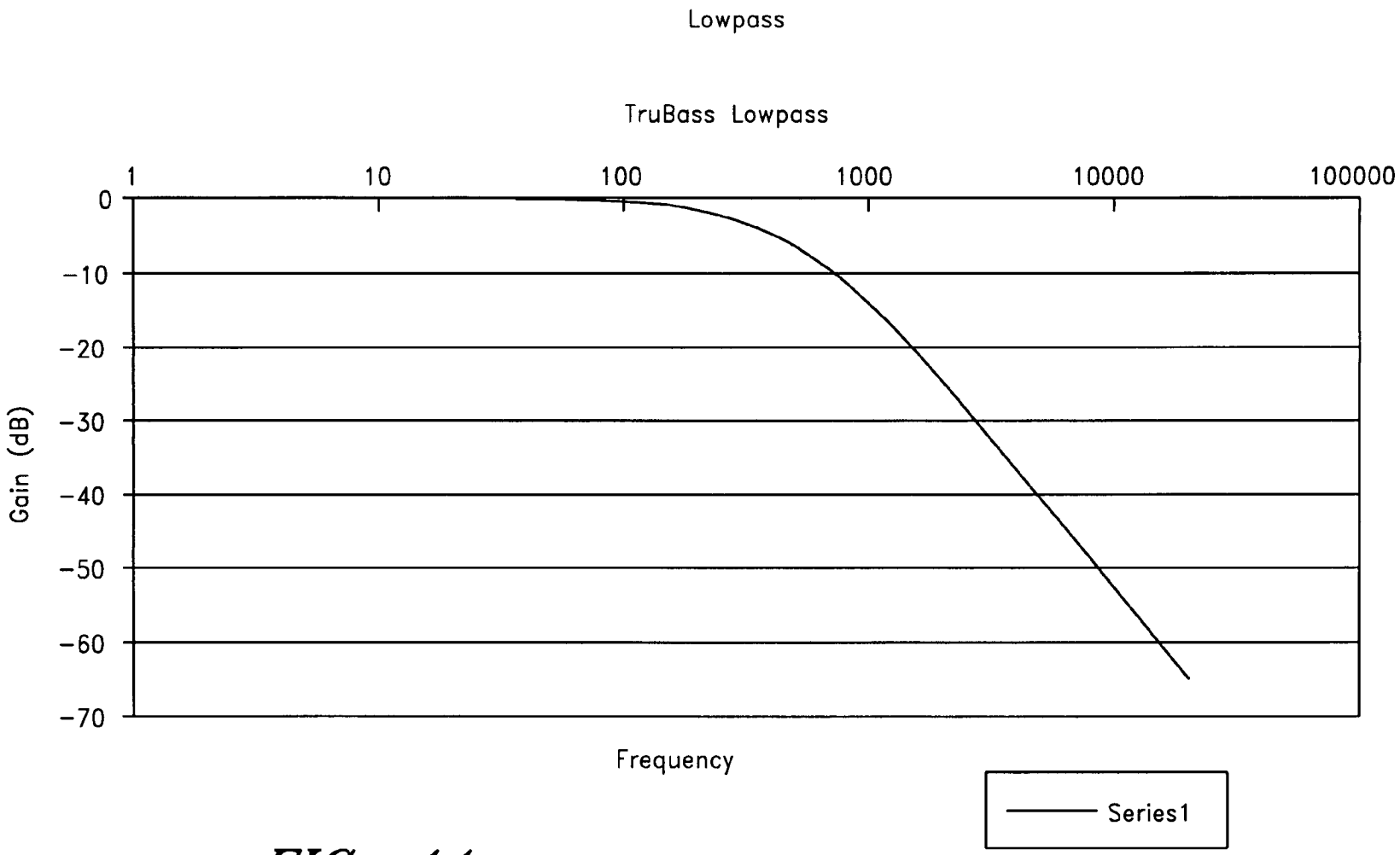
FIG. 44 is a plot of the transfer function of a lowpass filter for use with the block diagram shown in FIG. 38.

The filters 3809–3812 are implemented as Infinite Impulse Response (IIR) filters at a sampling frequency of 44.1 kHz. The filters are designed using the bilinear transform method. Each filter is a second order filters having one section. The filters are implemented using 32 bits fractional fixed point arithmetic. Specific information for each filter is given in Table 1 below. In addition, the transfer functions of the filters 3810 through 3812 are shown in FIGS. 39 through 43. The transfer function of the lowpass filter 3809 is shown in FIG. 44.

TABLE 1

Bandpass Filters

| Filter Frequencies (Hz) | −3 dB Low (Hz) | Center (Hz) | −3 dB High (Hz) | Bandpass Gain | Bandpass Gain (dB) |
|---|---|---|---|---|---|
| 40 | 30 | 38.7 | 50 | 1.43 | 3.12 |
| 60 | 45 | 58.1 | 75 | 1.43 | 3.12 |
| 100 | 78 | 96.8 | 129 | 1.00 | 0.0 |
| 150 | 116 | 145.1 | 192 | 1.00 | 0.0 |
| 200 | 150 | 193.6 | 250 | 0.71 | −2.93 |

Lowpass Filter

| −3 dB (Hz) | −15 dB (Hz) | Bandpass Gain | Bandpass Gain (dB) |
|---|---|---|---|
| 285 | 1021 | 1.00 | 0.0 |

The Bass Control 3827 determines the amount of bass enhancement that is applied to the audio signal and provides a value between 0 and 1 to the multiplier 3826.

The Width Control 3846 determines the amount of stereo width enhancement that is applied to the final output. The width control provides a value between 0 to 2.82 (9 dB) to the multiplier 3845.

OTHER EMBODIMENTS

The entire acoustic correction system disclosed herein may be readily implemented by software running on a DSP or personal computer, by discrete circuit components, as a hybrid circuit structure, or within a semiconductor substrate having terminals for adjustment of the appropriate external components. Adjustments by a user currently include the level of low-frequency and high-frequency energy correction, various signal-level adjustments including the level of sum and difference signals, and orientation adjustment.

Through the foregoing description and accompanying drawings, the present invention has been shown to have important advantages over current acoustic correction and stereo enhancement systems. While the above detailed description has shown, described, and pointed out the fundamental novel features of the invention, it will be understood that various omissions and substitutions and changes in the form and details of the device illustrated may be made by those skilled in the art, without departing from the spirit of the invention. Therefore, the invention should be limited in its scope only by the following claims.

The invention claimed is:

1. An audio correction system for enhancing spatial and frequency response characteristics of sound reproduced by two or more loudspeakers, said audio correction system comprising:

an image correction module configured to correct a perceived vertical image of sound when said sound is reproduced by a plurality of loudspeakers, said image correction module altering said sound as a first function of frequency over a first frequency range and altering said sound as a second function over a second frequency range, wherein said first function of frequency is independent of said second function of frequency;

a bass enhancement module configured to enhance a bass response of said sound when said sound is reproduced by said plurality of loudspeakers, said bass enhancement module modulates the amplitude of a higher-frequency signal with a lower-frequency signal to produce a signal envelope where said higher-frequency signal is modulated by said lower-frequency signal, wherein said base enhancement module comprises:

a first band pass filter that filters said sound at a first frequency;

at least a second band filter that filters said sound at a second frequency, wherein said second frequency is different than said first frequency;

a third band pass filter that filters said sound at a third frequency, wherein said third frequency is different than said first and second frequencies;

a combiner that combines the output of said first, second and third band-pass filters to generate a combined filtered signal;

a compressor that reduces the gain of the at least a portion of the high amplitudes in the combined filtered signal; and a base punch circuit that increases the gain of at least a portion of the low amplitudes in the combined filtered signal; and an image enhancement module configured to spectrally shape difference information associated with said sound to enhance a horizontal image of sound when said sound is reproduced by said plurality of loudspeakers.

2. The audio correction system of claim 1, wherein correction provided by said image correction module precedes enhancement provided by said bass enhancement module.

3. The audio correction system of claim 1, wherein bass enhancement provided by said bass enhancement module precedes image enhancement provided by said image enhancement module.

4. The audio correction system of claim 1, wherein correction provided by said image correction module precedes image enhancement provided by said image enhancement module.

5. A sound enhancement system comprising:

a first sound enhancement module configured to correct a perceived height of an apparent sound stage produced by a plurality of loudspeakers;

a second sound enhancement module configured to modulate a midbass signal with a low-frequency signal by multiplying the amplitude of said midbass signal with said low-frequency signal to produce a signal envelope, wherein said second sound enhancement module comprises:

a first band pass filter that filters said apparent sound stage at a first frequency;

at least a second band filter that filters said apparent sound stage at a second frequency, wherein said second frequency is different than said first frequency;

a third band pass filter that filters said apparent sound stage at a third frequency, wherein said third frequency is different than said first and second frequencies;

a combiner that combines the output of said first, second and third band-pass filters to generate a combined filtered signal;

a compressor that reduces the gain of the at least a portion of the high amplitudes in the combined filtered signal; and a base punch circuit that increases the gain of at least a portion of the low amplitudes in the combined filtered signal; and a third sound enhancement module configured to correct a perceived width of said apparent sound stage produced by said loudspeakers.

6. The sound enhancement system of claim 5, wherein said first sound enhancement module is further configured to correct a perceived vertical location of said apparent sound stage.

7. The sound enhancement system of claim 5, said first sound enhancement module comprising a left-channel filter to filter sounds in a left signal channel and a right-channel filter configured to filter sounds in a right signal channel.

8. The sound enhancement system of claim 7, said left-channel filter and said right-channel filter configured to filter said left and right channels in accordance with a variation in frequency response of a human auditory system as a function of vertical position of a sound source.

9. The sound enhancement system of claim 7, said left-channel filter and said right-channel filter configured to emphasize lower frequencies relative to higher frequencies.

10. The sound enhancement system of claim 5, said second sound enhancement module configured to emphasize portions of lower frequencies relative to higher frequencies.

11. The sound enhancement system of claim 6, said second sound enhancement module configured to receive a plurality of input signals and to emphasize common-mode portions of lower frequencies of said input signals relative to higher frequencies of said input signals.

12. The sound enhancement system of claim 5, said second sound enhancement module comprising:

a first combiner configure to combine a least a portion of a left channel signal with at least a portion of a right channel signal to produce a combined signal;

a filter configured to select a portion of said combined signal to produce a filtered signal;

a variable gain module configured to adjust said filtered signal in response to said signal envelope a second combiner configured to combine at least a portion of said bass enhancement signal with said left channel signal; and a third combiner configured to combine at least a portion of said bass enhancement signal with said right channel signal.

13. The sound enhancement system of claim 12, said variable gain module comprising an expander.

14. The sound enhancement system of claim 12, said variable gain module comprising a compressor.

15. The sound enhancement system of claim 5, said third sound enhancement module configured to receive input signals comprising a left-channel input and a right-channel input, said third sound enhancement module further configured to provide a common-mode behavior in response to common-mode portions of said input signals and to provide a differential-mode behavior in response to differential mode portions of said input signals.

16. The sound enhancement system of claim 5, said third sound enhancement module configured to provide a common-mode transfer function and a differential-mode transfer function.

17. The sound enhancement system of claim 16, wherein said differential-mode transfer function emphasizes lower frequencies relative to higher frequencies.

18. The sound enhancement system of claim 16, wherein said differential-mode transfer function is configured to provide a first de-emphasis for frequency components in a first frequency band, provide a second de-emphasis for frequency components in a second frequency band, provide a third de-emphasis for frequency components in a third frequency band, and provide a fourth de-emphasis for frequency components in a fourth frequency band, said first frequency band lower than said second frequency band, said second frequency band lower than said third frequency band, and said third frequency band lower than said fourth frequency band, said second de-emphasis less than said first de-emphasis and said third de-emphasis.

19. A method for enhancing audio sounds to improve a perceived sound stage and to improve perceived bass components of said sound, comprising the acts of:

height-correcting a sound signal to improve a perceived height of an apparent sound stage produced by a plurality of loudspeakers;

bass-enhancing the sound signal, said sound signal comprising a low-frequency audio signal and a higher frequency audio signal, said low-frequency audio signal missing from the apparent sound stage, said bass-enhancing comprising multiplying the amplitude of the higher-frequency audio signal by the low-frequency audio signal to produce a signal envelope where said higher-frequency signal is modulated by said lower-frequency signal, wherein bass-enhancing comprises:

filtering said sound signal at a first frequency to produce a first filtered signal;

filtering said sound signal at a second frequency to produce a second filtered signal, wherein said second frequency is different than said first frequency;

filtering said sound signal at a third frequency to produce a third filtered signal, wherein said third frequency is different than said first and second frequencies;

combining the first, second and third filtered signals to generate a combined filtered signal;

reducing the gain of the at least a portion of the high amplitudes in the combined filtered signal; and increasing the gain of at least a portion of the low amplitudes in the combined filtered signal; and width-enhancing the sound signal to improve a perceived width of the apparent sound stage produced by said loudspeakers.

20. The method of claim 19, wherein said act of height-correcting comprises filtering said sound signal to change a perceived vertical location of said apparent sound stage as heard by a listener.

21. The method of claim 20, where said act of height-correcting comprises the acts of filtering signals in a left signal channel and filtering signals in a right signal channel.

22. The method of claim 21, wherein said act of filtering comprises adjusting frequency components of said left signal channel and said right signal channel in accordance with a variation in the vertical spatial frequency response of human hearing.

23. The method of claim 21, wherein said act of filtering comprises emphasizing lower frequencies relative to higher frequencies.

24. The method of claim 19, wherein said act of bass-enhancement comprises emphasizing portions of lower frequencies relative to higher frequencies.

25. The method of claim 19, wherein said act of bass-enhancement comprises emphasizing common-mode portions of lower frequencies of an input signal relative to higher frequencies of said input signal.

26. The method of claim 19, wherein said act of bass-enhancement comprises the acts of:

combining at least a portion of a left channel signal with at least a portion of a right channel signal to produce a combined signal;

filtering said combined signal to produce a filtered signal;

amplifying said filtered signal according to said signal envelope of said to produce a bass enhancement signal;

combining at least a portion of said bass enhancement signal with said left channel signal; and combining at least a portion of said bass enhancement signal with said right channel signal.

27. The method of claim 26, wherein said act of amplifying comprises compressing said filtered signal during an attack time period.

28. The method of claim 26, wherein said act of amplifying comprises expanding said filtered signal during a decay time period.

29. The method of claim 19, wherein said act of width-enhancing comprises the acts of identifying a common-mode portion of said sound signal and adjusting said common-mode portion according to a common-mode behavior, and identifying a differential-mode portion of said sound signal and adjusting said differential-mode portion according to a differential mode behavior.

30. The method of claim 19 wherein said act of width-enhancing comprises applying a common-mode transfer function and applying a differential-mode transfer function to said sound signal.

31. The method of claim 30, wherein said act of applying a differential-mode transfer function comprises the act of emphasizing lower frequencies relative to higher frequencies.

32. The method of claim 30, wherein said act of applying a differential-mode transfer function comprises:

de-emphasizing frequency components in a first frequency band according to a first de-emphasis value;

de-emphasizing frequency components in a second frequency band according to a second de-emphasis value, said second frequency band higher in frequency than said first frequency band;

de-emphasizing frequency components in a third frequency band according to a third de-emphasis value, said third frequency band higher in frequency than said second frequency band, said second de-emphasis value relatively less than said first de-emphasis value and said third de-emphasis value; and de-emphasizing frequency components in a fourth frequency band according to a fourth de-emphasis value, said fourth frequency band higher in frequency than said third frequency band, said fourth de-emphasis value relatively less than said first de-emphasis value and said third-de-emphasis value.

33. A sound enhancement system comprising:

a height-corrector for correcting a perceived height of an apparent sound stage;

a bass-enhancer configured multiply the amplitude of a higher-frequency sound signal by a lower-frequency sound signal, to produce a signal envelope where said higher-frequency signal is modulated by said lower-frequency signal, wherein said apparent sound stage is missing low-frequency sound energy corresponding to said lower-frequency sound signal, and wherein said bass-enhancer comprises:

a first band pass filter that filters said apparent sound stage at a first frequency;

at least a second band filter that filters said apparent sound stage at a second frequency, wherein said second frequency is different than said first frequency;

a third band pass filter that filters said apparent sound stage at a third frequency, wherein said third frequency is different than said first and second frequencies;

a combiner that combines the output of said first, second and third band-pass filters to generate a combined filtered signal;

a compressor that reduces the gain of the at least a portion of the high amplitudes in the combined filtered signal; and a base punch circuit that increases the gain of at least a portion of the low amplitudes in the combined filtered signal; and a width-corrector for correcting a perceived width of said apparent sound stage.

34. A sound enhancement system comprising:

a height-corrector for correcting a perceived height of an apparent sound stage;

means for enhancing bass response of a sound signal, said means for enhancing bass response multiplies a higher-frequency sound signal with a low-frequency sound signal to produce a signal envelope where said higher-frequency signal is modulated by said lower-frequency signal, wherein said means for enhancing bass comprises:

a means for filtering said apparent sound stage at a first frequency;

a means for filtering said apparent sound stage at a second frequency wherein said second frequency is different than said first frequency;

a means for filtering said apparent sound stage at a third frequency, wherein said third frequency is different than said first and second frequencies;

a means for combining the output of said first, second and third means for filtering to generate a combined filtered signal;

a means for reducing the gain of the at least a portion of the high amplitudes in the combined filtered signal; and means for increasing the gain of at least a portion of the low amplitudes in the combined filtered signal; and a width-corrector for correcting a perceived width of said apparent sound stage.

35. A sound enhancement system comprising:

a height-corrector for correcting a perceived height of an apparent sound stage;

a bass-enhancer configured to multiply a higher-frequency sound signal with a low-frequency sound signal to produce a signal envelope where said higher-frequency signal is modulated by said lower-frequency signal said bass-enhancer comprises:

a first band pass filter that filters said apparent sound stage at a first frequency;

at least a second band filter that filters said apparent sound stage at a second frequency, wherein said second frequency is different than said first frequency;

a third band pass filter that filters said apparent sound stage at a third frequency, wherein said third frequency is different than said first and second frequencies;

a combiner that combines the output of said first, second and third band-pass filters to generate a combined filtered signal;

a compressor that reduces the gain of the at least a portion of the high amplitudes in the combined filtered signal; and a base punch circuit that increases the gain of at least a portion of the low amplitudes in the combined filtered signal; and means for correcting a perceived width of said apparent sound stage.

* * * * *

UNITED STATES PATENT AND TRADEMARK OFFICE

CERTIFICATE OF CORRECTION

PATENT NO. : 7,031,474 B1
APPLICATION NO. : 09/411143
DATED : April 18, 2006
INVENTOR(S) : Thomas C.K. Yuen, Alan D. Kraemer and Richard Oliver It is certified that error appears in the above-identified patent and that said Letters Patent is hereby corrected as shown below:

At sheet 11 of 53, line 3, delete “0db” and insert -- 0dB --, therefor.

At sheet 11 of 53, left hand side at the bottom, delete “--50db” and insert -- -50dB --, therefor.

Figure 26B:
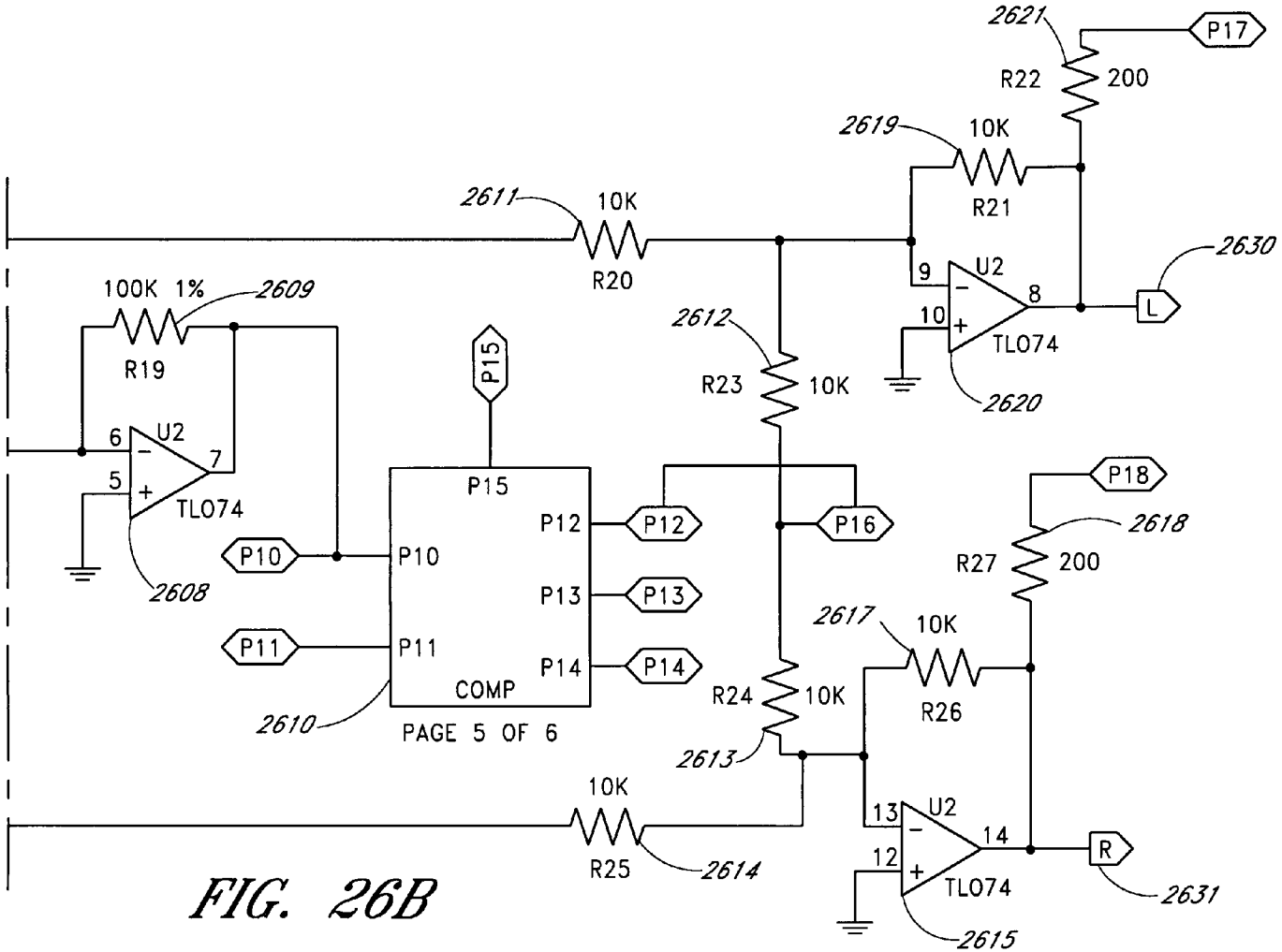

At sheet 29 of 53, line 1, delete “FIG. 26A FIG. 26A” and insert -- FIG. 26A FIG. 26B--, therefor.

At sheet 31 of 53, FIG. 27, delete “CONNECTP6” and insert -- CONNECT P6 --, therefor.

At sheet 47 of 53, line 1, delete “200hZ” and insert -- 200Hz --, therefor.

At sheet 50 of 53, left hand side, delete “gAIN” and insert -- GAIN --, therefor.

At column 1, line 2, after “11/1993” insert -- H04S 01/00 --.

At column 1, line 3, after “8/1997” insert -- H04S 01/00 --.

At column 1, line 27, delete “Bice, Jr” and insert -- Bice, Jr. --, therefor.

At column 2, line 2, after “LLP” insert -- . --.

At column 2, line 3, delete “pp” and insert -- pp. --, therefor.

At column 2, line 4, delete “pdf>.” And insert -- pdf>, --, therefor.

At column 2, line 20, after “8/1983” insert -- H04S 01/00 --.

At column 8, line 57, after “6B” insert -- is --.

At column 23, line 54, before “A pole” delete “The”.

At column 23, line 65, delete “allow” and insert -- allows --, therefor.

At column 23, line 66, after “namely” delete “150” and insert -- 40-150 --, therefor.

At column 24, line 1, after “1413” insert --, 1415 --.

UNITED STATES PATENT AND TRADEMARK OFFICE

CERTIFICATE OF CORRECTION

PATENT NO. : 7,031,474 B1
APPLICATION NO. : 09/411143
DATED : April 18, 2006
INVENTOR(S) : Thomas C.K. Yuen, Alan D. Kraemer and Richard Oliver It is certified that error appears in the above-identified patent and that said Letters Patent is hereby corrected as shown below:

At column 24, line 39, delete "1505" and insert -- 1501 --, therefor.

At column 28, line 58, after "signals" delete "3".

At column 35, line 4, delete "P114." and insert -- P14 --, therefor.

At columns 37 and 38, line 63-67 and 1-4, please delete "The differential gain between the left and right..... Frequency of the left and right input signals." and insert the same on line 64 of Col. 37 as a new paragraph.

At column 42, line 15, delete "kohms" and insert -- kohm --, therefor.

At column 42, line 16, delete "microfarads." and insert -- 3023. --, therefor.

At column 43, line 6, delete "33023." and insert -- 3023. --, therefor.

At column 48, line 8, in claim 1, delete "base" and insert --"bass"--, therefor.

At column 48, line 23, in claim 1, delete "base" and insert --"bass"--, therefor.

At column 49, line 4, in claim 5, delete "base" and insert --bass--, therefor.

At column 49, line 29, in claim 11, delete "claim 6," and insert -- claim 5, --, therefor.

At column 49, line 36, in claim 12, delete "a least" and insert -- at least --, therefor.

At column 49, line 42, in claim 12, after "envelope" insert -- ; --.

UNITED STATES PATENT AND TRADEMARK OFFICE

CERTIFICATE OF CORRECTION

PATENT NO. : 7,031,474 B1
APPLICATION NO. : 09/411143
DATED : April 18, 2006
INVENTOR(S) : Thomas C.K. Yuen, Alan D. Kraemer and Richard Oliver It is certified that error appears in the above-identified patent and that said Letters Patent is hereby corrected as shown below:

At column 50, line 53 (approx.), in claim 21, delete "where" and insert -- wherein--, therefor.

At column 51, line 12, in claim 26, after "envelope" delete "of said".

At column 51, line 58, in claim 32, delete "third-de" and insert -- third de --, therefor.

At column 52, line 41 (approx.), in claim 34, after "frequency" insert -- , --.

At column 52, line 20 (approximately), in claim 33, delete "base" and insert --bass--, therefor.

At column 54, line 4, in claim 35, delete "base" and insert --bass--, therefor.

Signed and Sealed this

Sixth Day of February, 2007

JON W. DUDAS
*Director of the United States Patent and Trademark Office*